US005499682A

United States Patent [19]

Sieber

[11] Patent Number: 5,499,682

[45] Date of Patent: Mar. 19, 1996

[54] METHOD FOR SETTING A SLOTTED FACE WELLBORE DEVIATION ASSEMBLY USING A RECTILINEAR SETTING TOOL

[76] Inventor: Bobby G. Sieber, Rte. 1, Arp, Tex. 75750

[21] Appl. No.: 420,018

[22] Filed: Apr. 11, 1995

Related U.S. Application Data

[62] Division of Ser. No. 201,800, Feb. 25, 1994, Pat. No. 5,425,419.

[51] Int. Cl.[6] ..... E21B 23/00

[52] U.S. Cl. ..... 166/382

[58] Field of Search ..... 166/381, 382, 166/117.6

[56] References Cited

U.S. PATENT DOCUMENTS

| | | | |
|---|---|---|---|
| 2,362,529 | 11/1944 | Barrett et al. | 255/1.6 |
| 2,558,227 | 6/1951 | Yancey et al. | 255/1.4 |
| 2,821,362 | 1/1958 | Hatcher | 255/1.6 |
| 3,115,935 | 12/1963 | Hooton | 166/117.6 |
| 4,397,355 | 8/1983 | McLamore | 166/297 |
| 4,765,404 | 8/1988 | Bailey et al. | 166/117.6 |
| 5,035,292 | 7/1991 | Bailey et al. | 175/45 |
| 5,109,924 | 5/1992 | Jurgens et al. | 166/117.5 |
| 5,113,938 | 5/1992 | Clayton | 166/117.6 |
| 5,154,231 | 10/1992 | Bailey et al. | 166/298 |
| 5,193,620 | 3/1993 | Braddick | 166/382 |
| 5,379,845 | 1/1995 | Blount et al. | 166/382 |

*Primary Examiner*—Michael Powell Buiz
*Attorney, Agent, or Firm*—C. W. Alworth

[57] ABSTRACT

A method for setting an oil field Wellbore Deviation Apparatus, for deviating a wellbore, which uses an improved whipstock incorporating a slotted face, attached to a hydraulic or mechanical anchor packer is disclosed. The method permits the proper "set" of a mechanical packer without fear of shearing the releasable attachment device currently used in the industry and permits an operator to "bottom hole wash" while setting a mechanical packer in a wellbore. The same method, with slight modifications, is used for both mechanical or hydraulic packers.

15 Claims, 40 Drawing Sheets

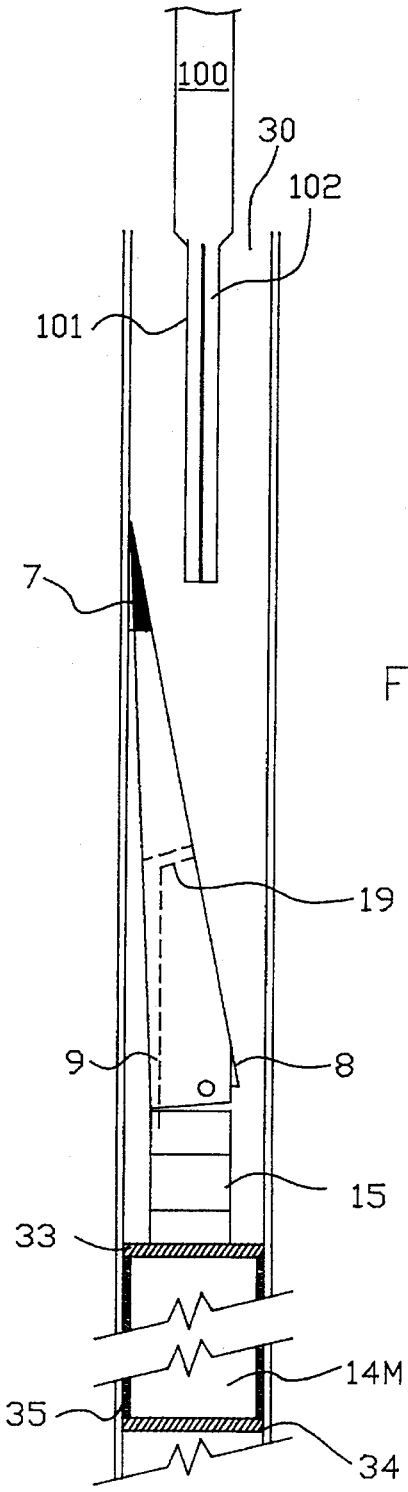
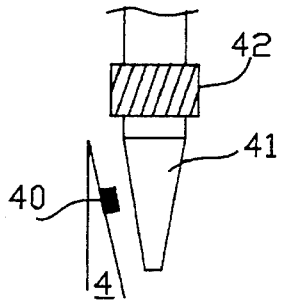
PRIOR ART
FIGURE 25A
FIGURE 25

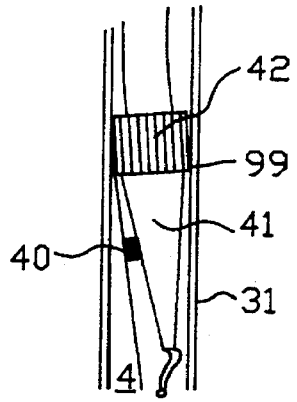
PRIOR ART
FIGURE 27B
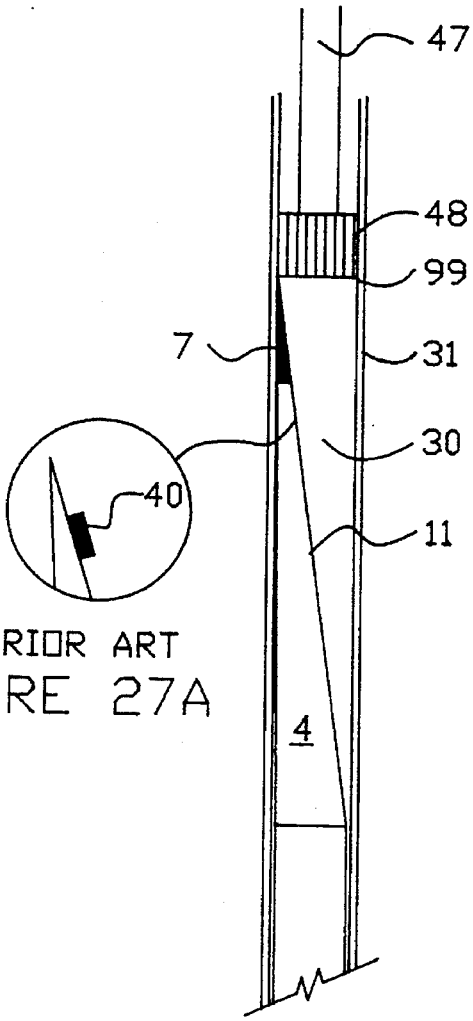
PRIOR ART
FIGURE 27A
FIGURE 27

ALTERNATE MAKE UP

METHOD FOR SETTING A SLOTTED FACE WELLBORE DEVIATION ASSEMBLY USING A RECTILINEAR SETTING TOOL

This is a divisional application of U.S. patent application Ser. No. 08/201,800 filed on Feb. 25, 1994, now U.S. Pat. No. 5,425,419.

TECHNICAL FIELD OF THE INVENTION

The present invention relates to oil and gas drilling equipment and more specifically relates to an apparatus and method for drilling deviated holes from an existing wellbore.

BACKGROUND OF THE INVENTION

At times it is desirable to sidetrack (deviate) existing well bores for various reasons in producing a more economical well bore. It is well known in the oil and gas industry that whipstocks are used in drilling to direct or deviate a drill bit or cutter at an angle from a well bore. The well bore can be cased (lined with pipe) or uncased (open hole; not lined with pipe). It has been customary to follow plug and abandonment (P&A) procedures when using a whipstock. These P&A procedures vary as to cased or uncased well bores. Most P&A procedures follow OCS guidelines as the operator does not want communication between the "old" well bore and the "new" bore. OCS guidelines would not be followed where the operator is drilling additional "drain" bores in an existing well. For the cased well bore, the operator will set a cement plug in the well bore (100 hundred feet thick at a minimum) followed by a bridge plug or EZ-drill plug. The bridge plug is a wire line device which is set three to five feet above the casing collar (or joint) near the required point that deviation of the well bore is needed. The position of the bridge plug and the whipstock is critical because the deviated hole must NOT penetrate the casing at or near a casing collar (or joint). The whipstock is traditionally set several feet above the bridge plug. Great care is exercised to coordinate wire line and pipe measurements to assure that the whipstock is clear of the casing collar (or joint). In an uncased hole, only a cement plug of the proper length is used. The length of the plug is determined by the depth of the uncased hole to the point at which the deviation is required. The downhole tool is traditionally set above the cement plug.

The complete downhole assembly generally consists of the whipstock assembly attached to some form of packer assembly. There are presently two conventional whipstock types available, the "Packstock" and the "Bottom Trip". The Packstock is a whipstock and a packer assembly that is combined to form a single downhole unit. The bottom trip device is a single whipstock with a plunger, sticking out of the bottom of the downhole tool, which when set down on the bottom of the hole, will release a spring loaded slip or wedge within the whipstock which in turn holds the tool in place. The whipstock is the actual oil-tool that causes the drill bit or cutter to deviate from the well bore. The packer is another oil-tool that holds the whipstock in place once the whipstock has been set in the well bore at the desired orientation. This packer is given the name anchor packer and it is this packer that rests above the bridge plug in a cased hole and above the cement plug in an uncased hole. In the case of the bottom trip whipstock, it is the bridge plug that forces the plunger to release the spring loaded slips or wedges; thus, holding the tool in place. It should be apparent that there are two fundamental types of packer in use; the first operates in a cased hole and the second operates in an uncased hole. The bottom trip device operates only in a cased hole; it is an old device; and, it is fraught with problems because it has only a single slip or wedge which can work loose.

The whipstock is a triangularly shaped tool about 10 to 12 feet long. It is slightly less then the diameter of the well bore at its bottom and slopes so that its diameter approaches infinitely at its top. The back of the tool usually rests against the low side of the well bore, where the low side of the well bore is defined as that side of the hole most affected by gravity. The tool face is cup-shaped and guides the hole drilling equipment off to the side of the hole in the direction set by the orientation of the tool face. The bottom of the tool is attached to the packer.

Traditionally the whipstock must be chosen for each well bore so that its bottom diameter matches the well bore and the packer, if used. Its top end must match the inside diameter of the well bore so that the drilling equipment sees a smooth transition off to the side of the hole; and the back of the tool should match the internal diameter of the well bore. In addition the cupped face of the tool has been chosen to match the bore size in order to properly guide the drilling equipment. This means that the oil or gas field operator must keep a stock of different whipstocks to match the various standard well bores used in the industry.

This invention standardizes the whipstock tool to three varieties to fit hole sizes from 3¾ inches up to 12½ inches. The invention proposes one style of whipstock for use with both mechanically set packers and hydraulically set packers. And finally, the invention proposes an apparatus and method for retrieval of the valuable and expensive downhole assembly after the deviated hole is completed. This retrievable whipstock would be invaluable in multiple drain holes in a single well bore and would be used in both cased and open hole (uncased) conditions.

PRIOR ART

The whipstock has passed through two generations of tool since its introduction in the early nineteen-thirties. The initial apparatus and method of use involved a multi-step procedure. Standard P&A procedures were followed prior to the use of the tool; i.e., the well bore was properly plugged below the desired deviation point. An anchor packer was then set in the hole in order to support and maintain the orientation of the whipstock. The packer had a key slot in its bottom which would mate with a "stinger" on the whipstock. Wireline tools would be run into the hole to determine the orientation of the key slot and the stinger on the whipstock would be adjusted to match the packer key slot so that when the whipstock was run into the hole, the whipstock would orientate itself in the correct direction. This procedure required multiple runs into and out of the well bore and was fraught with risk. After the whipstock was "set", a starting mill tool would be run into the well bore to remove attachment points on the face of the whipstock, cut into the side of a cased hole, and generally prepare the well bore for a deviated hole. The starting mill tool is used for about the first twenty inches of hole. These same procedures are followed in the next generation tool and will be explained later.

The next generation (second), which is the presently used technique, mated the whipstock to the anchor packer. The combination of the whipstock and the anchor packer is attached to the drill stem using a shear pin which in turn is attached to a raised face attachment point, known as the shear pin block, mounted on the face of the whipstock. The downhole assembly is lowered into the well bore until it touches bottom. (Bottom would be defined as the bridge plug in a cased hole and the cement plug in an uncased hole.) The assembly is then raised slightly and the orientation of the whipstock is checked using wireline tools. The drill stem is rotated one way or another and the orientation is checked again. This procedure is continued until the face of the whipstock is properly orientated. The anchor packer is then "set" in the well bore.

There are two types of packer, mechanical set and hydraulic set. The most commonly used packer is the hydraulically set packer. U.S. Pat. No. 5,193,620 (Braddick) discloses a whipstock setting apparatus and method for a mechanical packer. Mechanical packers are "set" by applying weight to the packer which, in turn, causes the packer slips to extend against the well bore; thus, locking (or setting) the packer in place. This is similar to the bottom set whipstock device in that there is a plunger extending from the bottom of the packer; however, spring loaded slips are not used as in the bottom set whipstock. One other difference, the bottom set whipstock will not have any packing or resilient material that expands against the hole to seal the lower hole section.

U.S. Pat. No. 4,397,355 (McLamore) discloses a whipstock setting method and apparatus for a hydraulic packer. Hydraulic packers are "set" by applying Hydraulic pressure to the packer, which, in turn, causes the packer slips to extend against the well bore; thus, locking (or setting) the packer in place. The hydraulic pressure is obtained through a device called a "running tool". The running tool converts the drill stem mud pressure to hydraulic pressure; the hydraulic oil being run from the running tool to the hydraulic packer through tubing to the whipstock and then through a series of channels within the whipstock and onto the packer. The packer is set by pressuring up the drill stem which then passes that pressure onto the packer.

Once the packer is "set", the whipstock must be broken free from the drill stem before any milling or regular drilling operations may proceed. This is a simple operation—the drill stem is raised. The packer, if properly anchored in the well bore, will not move and the shear pin will shear. All that remains is to remove the shear pin block which is mounted on the face of the whipstock and to cut into the side of the well bore.

The removal of the shear pin block is undertaken by "milling". In both the first generation and initial second generation tool a starter mill bit is placed on the drill stem and lowered into the well bore. The starter mill is rotated and in turn removes the raised face. This same milling tool makes the initial cut into the side of the casing in a cased hole. The initial milling operation makes about a twenty inch (20") deep hole. That is to say the operator only runs the starter mill for about twenty inches total depth before coming out of the well bore and changing his starter mill bit assembly. Once this first mill run is complete, the starter mill is replaced with a second and larger mill, known as a window mill. Another mill, known as a water-melon mill, is mounted above the window mill. The window mill and water-melon mills operate together to enlarge the deviated opening in the well bore so that regular drilling operations may pass without restriction. Generally the window/water-melon bit combination is used for seven to ten feet into the deviated hole.

McLamore improved the second generation apparatus and method by placing the initial mill assembly on the end of the drill stem immediately above the whipstock. Thus, once the whipstock was freed from the drill stem, initial milling could proceed immediately. This was certainly an improvement because one trip into and out of the well bore was eliminated, however, the initial milling operation can only last about twenty inches before the mill must be removed. This is because the setting tool, that is the piece of metal between the mill and the whipstock which holds the whipstock to the drill stem, will bump against the casing of a cased hole and cause the mill to cut into the whipstock rather than the casing. This has caused problems in the past because the whipstock face can be damaged or the whipstock can be cut into requiring that another complete assembly be placed in the hole.

Braddick uses the same initial milling technique as McLamore. Braddick has other disadvantages. In a mechanical set packer, the application of sufficient weight to set the packer is an absolute necessity. Braddick uses the shear pin between the setting tool and the whipstock to transfer weight to the mechanical packer. This means that the shear pin must be carefully chosen so that it will transfer drill stem weight to the packer for setting and yet be sufficiently weak to shear when the drill stem is pulled upwards. It is possible for the packer to move upward and rotate when the stem is pulled out of the hole in order to shear the retaining pin because the pin may be stronger than the packer retaining force.

A major impediment for the second generation whipstock is the shear pin block on the face on the whipstock which must be milled away so that the face becomes a smooth cupped face. The shear pin block ranges in size from one to one and one-half inches thick (1"–1½"), two and one-half to three inches wide (2½"–3"), and three to four inches long (3"–4"). It takes a considerable amount of time to mill this block away after setting the whipstock. Reports from the field indicate that this block can cause numerous problems and often results in several trips with fresh starter mills in order to remove the shear pin block and make the initial twenty inch plus or minus (20"±) starting cut in the casing (or formation).

Second generation whipstocks have further detriments. One of these further detriments is found in the location of the shear pin itself and the fact that this shear pin can shear if the downhole assembly is rotated. That is, not only will the pulling force shear the pin when shearing of the pin is required, the torsional force which can be induced when the whipstock is being rotated ill the hole can inadvertently shear the pin. This inadvertent shearing is a disaster! The possibility of inadvertent shearing due to rotational forces becomes very large in a high angle well bore. Well bore angle is defined as angle from vertical; thus, a high angle hole approaches a horizontal bore.

A further detriment for the second generation whipstock occurs in nearly vertical or low angle hole. The back of the whipstock must rest against the well bore and the whipstock is designed to pivot about a hinge pin near the bottom of the tool just above the anchor packer. In a medium to high angle hole the whipstock easily falls against the well bore, but in a nearly vertical hole there is little gravity component to pull the tool against the wall. This can cause some problems during the initial (or starting) mill operation—that is the whipstock chatters against the well bore. There remains an unfulfilled requirement to be able to force the tool against the well bore in a low angle hole.

The final detriment for second generation whipstocks is that retrieval of the tool after use is practically impossible. Retrieval of the tool will be invaluable in modern production operations where multiple drains are desired in a well bore.

There are a number of other prior art patents as listed in the following table that relate generally to whipstocks.

| U.S. Pat. No. | Inventor | Title | Issued |
|---|---|---|---|
| 2,362,529 | Barrett et al. | Side Tracking Apparatus | 11/14/44 |
| 2,558,227 | Yancey et al. | Sidewall Core Taking Apparatus | 06/26/51 |
| 2,821,362 | Hatcher | Extensible Whipstock | 01/28/58 |
| 3,115,935 | Hooton | Well Device | 12/31/63 |
| 4,765,404 | Bailey et al. | Whipstock Packer Assembly | 08/23/88 |
| 5,035,292 | Bailey et al. | Whipstock Starter Mill with Pressure Drop Tattletail | 07/30/91 |
| 5,109,924 | Jurgens et al. | One Trip Window Cutting Tool and Apparatus | 05/05/92 |
| 5,113,938 | Clayton | Whipstock | 05/19/92 |
| 5,154,231 | Bailey et al. | Whipstock Assembly with a Hydraulically Set Anchor | 10/13/92 |

Barrett et al. disclose "Side Tracking Apparatus" or a whipstock with roller bearings in its face. The roller bearings are meant to force the mill against the casing. The whipstock is particularly designed to be used with casing that has hardened such that conventional milling techniques would not work—i.e. the mill would probably mill into the whipstock rather than the casing. This whipstock could be called the first of the second generation whipstocks as it has its own set of slips built into the whipstock; the slips being set by forcing the whipstock against the bottom of the bore hole. The whipstock is held to its mill by a shear pin. The roller bearings run the entire face of the whipstock. The whipstock design is somewhat different then those used today in that the whipstock does not have an angled slope to kick the mill into the casing (or side track the hole) but rather has a straight offset section that runs the entire length of the desired window. The whipstock then has a very sharp slope at the bottom of the whipstock which would act to shove the mill to the side. Additionally this disclosure has no method for orientation of the whipstock.

Yancey et al. disclose a "Sidewall Core Taking Apparatus" which uses a whipstock to force a core taker into the side of a well bore. The device uses a ver sharp angle on the whipstock face which requires that the core taker use a set of universal joints in order to be able to make the bend towards the side wall. The universal joints must be guided and the device provides a set of roller bearings in the face of the whipstock. These bearings will also act to improve the mechanical efficiency of the device. It should be noted that the milling surface of the core taker does not act on these bearings.

Hatcher discloses an "Extensible Whipstock" which is retrievable. The device is not designed to be orientated in the hole and is set by placing weight on the whipstock; there is no releasable device. Once the deviated hole is drilled, the whipstock will be withdrawn from the hole with the removal of the drill string. There is no anchor packer associated with the device and the device can only be used at the bottom of a hole in a rocky formation into which the whipstock can grip with a sharp point. The sharp point is meant to prevent rotation of the whipstock during the drilling operation.

Hooton discloses a "Well Device" which is an improvement to the whipstock by providing a well plug at the bottom of a standard whipstock which can be set in place "by hydraulic, pneumatic, explosive or mechanical means." The disclosure shows an anchor packer attached to the whipstock which in turn is attached to the drill stem by a shear pin. The mechanical setting means is by loaded spring action and not by setting drill string weight onto the anchor packer. Also disclosed is a single spring which functions to force the whipstock against the well bore. The disclosure claims that the single spring is releasably held in place, but does not show nor claim the apparatus to accomplish this function. This disclosure states that the shear pin is sheared by applying downward force to the shear pin; this method could be used to set a mechanical packer; but, because the shear pin is broken by the downward force, there is no method left to check and see if the packer is properly secured in the well bore. (Normally the operator pulls upward, if there is large movement in the drill stem, then it is known that the packer did not set. If on the other hand there is only slight movement—the natural spring of the string—followed by jump, then it is known that the packer is properly set.)

Bailey et al. ('404) disclose a "Whipstock Packer Assembly" which is designed to be used with a single trip whipstock assembly and starter mill. This patent is an improvement to the McLamore device.

Bailey et al. ('292) disclose a "Whipstock Starter Mill with Pressure Drop Tattletail" which is designed to be used with the single trip whipstock assembly. This device causes a pressure drop in the drill string when the starter milling operation has past a predetermined point on the face of the whipstock.

Jurgens et al. disclose a "One Trip Window Cutting Tool and Apparatus" which utilizes a whipstock assembly, a window mill and one or more water melon mills. The disclosure also states that the whipstock slope should be between 2 and 3 degrees, but there is no claim as to a given angle nor a statement as to why such an angle is disclosed. The device uses a "shear pin block" which is milled off by the water melon mill. Other parts of the disclosure are similar, if not the same, as all other second generation whipstocks.

Clayton discloses a "Whipstock" which will allow bore hole deviation from the low side of the hole. The whipstock uses two springs to force the whipstock against the top side of the hole. The device is designed to operate in conjunction with a hydraulic packer and the setting tool runs through the face of the whipstock. The running tool keeps the whipstock springs in their compressed position; the springs are released when the setting tool is removed. The setting tool also provides hydraulic pressure to the packer from the running tool. The setting tool is secured by threads and release of the setting tool from the whipstock is accomplished by "a few right hand rotations to unscrew the setting tool conduit from the threads."

Bailey et al. ('231) disclose a "Whipstock Assembly with a Hydraulically Set Anchor" which uses the traditional whipstock in conjunction with an novel hydraulic packer. The hydraulic packer utilizes a better technique to set itself in the well bore and will remain so set upon loss of hydraulic pressure. The patent proposes two methods of setting the assembly. The first uses a method for setting the assembly without a starter mill; thus, requiring a minimum two pass operation. The second calls for setting the assembly with a starter mill in place which results in a minimum one pass operation. In general this patent is an improvement to previous devices disclosed by Bailey et al.

Thus, the prior art has left a number of disadvantages:

- it is difficult to use a mechanically set packer, which is cheaper than the hydraulic packer.
- the retaining shear pin can inadvertently shear when the whipstock is being positioned within the well bore.
- the raised face of the mounting attachment to the whipstock face (shear block) must be milled off before any deviation operations can commence.
- the whipstock assembly must be specifically designed to fit the given dimensions of the well bore; thus, many sizes must be warehoused.
- it is easy to mill into the face of the tool during the initial (or start) milling operation.
- there is no method of using an MWD (Measurement While Drilling) Tool to determine whipstock orientation; only wireline techniques can presently be used.

In summary therefore, existing whipstocks used with sidetracking (or deviation) operations are inflexible as to various well bore sizes and the different conditions encountered downhole. This inflexibility leads to increased manufacturing costs and added risk of failure because the whipstock is extended beyond its design criteria. This invention resolves a number of inflexible constraints.

SUMMARY OF THE INVENTION

The whipstock of this invention can be permanent or retrievable and consists essentially of a setting tool which holds the whipstock assembly to the drill stem, a deflector head which attaches to the top of the whipstock body and is sized to the diameter of the bore, a whipstock body which is available in three size, and an optional bottom end spacer. There is no shear pin block on the face of the whipstock that must be milled off; initial starting guidance for the window mill is provided by the deflector head. The deflector head, which varies between one foot and two feet long depending on bore hole size, is furnished in hardened steel with optional PCD (polycrystaline diamond) inserts. The hardened surface with or without the optional inserts serves to stop the initial milling operation from cutting into the whipstock and, as stated, further force the mill against the well bore. The whipstock body has a retrieval system centered at the mid point of the body which will interlock with a fish hook to allow for retrieval of the whipstock, deflector head and anchor packer. The whipstock incorporates a set of springs in the hinge which are held in a compressed state until the unit is set at which time the springs can be released to help hold the back of the whipstock against the well bore. The whipstock body and setting tool are adapted to operate with either a mechanically set anchor packer or a hydraulically set anchor packer with the choice being made in the field.

In addition to providing for an improved and workable tool, an object of the invention is to minimize required oil tool inventory which is accomplished by using three body sizes, 8", 5½" and 3½", for the whipstock. Thus, three whipstock bodies can be used for bore holes from 3¾" through 12½". The deflector head, which is attached to the top of the whipstock body and occupies at least the topmost one foot of the whipstock assembly, allows for different bore sizes within the range of the three whipstock bodies. An optional spacer may be required at the bottom of the whipstock, below the hinge, to take up the gap between the whipstock body and the well bore.

When the whipstock is used with a mechanically set packer, it is easy to use MWD (Measurement While Drilling) tools for whipstock tool face orientation. Mud circulation is maintained through the port in the running tool that is normally used for hydraulic oil when the downhole tool is used with a hydraulically set packer. Of course standard wire line orientation techniques are still useable for tool face orientation. MWD is possible with a hydraulic packer, but an additional tool incorporating a pinned by-pass valve would be required because the exit port on the running tool would be attached to the hydraulic system.

The whipstock incorporates a special slot (setting/retrieval slot) in the face of the tool which starts just below the deflector head and runs to approximately the mid point of the tool. The slot is of variable depth because the tool face has an angle and the slot is to form a perpendicular entry into the tool face. The setting tool fits into this slot and bottoms at the bottom of the slot. The setting tool is held in place by a shear pin located near the bottom of the slot, which enters fromm the tool back and is screwed into the setting tool. Thus, vertical force can readily be asserted on the tool and anchor. If the force is in the downward direction, that force is transferred directly to the tool and anchor. If the force is upward, the shear pin must bear the force or fracture. On the other hand, if the force is torsional, then that torsional force is transferred to walls of the setting slot.

The setting slot also acts as a guide for the retrieval tool. A retrieval slot is located slightly above the bottom of the setting slot. The retrieval slot runs from the front of the setting slot to the back of the tool and is designed to fit about a hook located on a specially designed retrieval tool. The retrieval tool has an opening in the hook face which allows drilling fluid to pass through it. Thus, MWD tools can be used in conjunction with the retrieval tool to help in establishing hook orientation. The hook also has a spring loaded/pinned valve which is designed to close when the hook properly engages the retrieval slot. Closure of this valve will cause a pressure pulse at the surface which tells the operator that the retrieval tool has properly engaged the whipstock. The hook is further designed so that it tends to straighten out the whipstock when a pulling force is applied. A properly designed whipstock is meant to fall against the "backside" of a well bore and if the tool is not pulled straight, then the top of the tool will catch against each joint in the casing. The retrieval tool helps reduce this problem.

Finally, there is an integral spring loaded shear pin within the retrieval tool which is designed to prevent inadvertent release of the retrieved whipstock while reciprocating the whipstock in order to help it past an obstruction in the well bore. The spring loaded shear pin springs into a matching cavity within the setting/alignment slot within the tool face of the whipstock as the retrieval tool fish-hook properly engages the retrieval slot. The spring loaded shear pin prevents independent downward motion between the whipstock and the retrieval tool; thus, locking the fish-hook in place. Note that the spring loaded pin can be sheared; thus, allowing for "controlled releasability".

The further advantage to this design is the "controlled releasability" of the Retrieving Tool. The spring loaded shear pin will shear and allow the retrieval tool to disengage from the whipstock whenever sufficient downward weight is applied to the drill string. Complete retrieval is then performed by slacking off the retrieval tool which will back away from the retrieval slot because the hook is tapered from its base to its face and then rotating the drill string by a quarter turn, thus, turning the hook of the retrieval tool away from the slot. As the hook initially pulls away from the whipstock, the wash port(s) will open and at the same the mud circulation pumps can be re-started. The excess mud pressure appearing at the wash port(s) will be a tremendous aid in releasing the hook from the whipstock.

The method of use is relatively simple. First, one of the three body sizes of whipstock is chosen to most closely match the well bore. Second, a deflector head is chosen that matches the well bore and is secured to the appropriate whipstock. Third, the proper sized anchor packer is chosen that most closely matches the well bore and, if required, the optional bottom spacer is bolted to the whipstock body. Finally the running tools must be chosen. If the anchor packer is hydraulic, then both a setting tool and all improved piston sub are required; however, only the setting tool is required for a mechanical anchor packer. The setting tool is sized to the appropriate whipstock body and the same tool serves for both mechanical or hydraulic packers. The complete downhole tool is assembled in the standard manner on the drill floor/rotary/table with proper attachment made between the whipstock and the setting tool via a shear pin. The downhole tool is then lowered into the well bore.

In the case of the mechanically set packer/whipstock downhole tool assembly, the tool is lowered into the well bore until it hits bottom. The drill string is then raised, as per standard procedures, and mud circulation started. The circulation allows orientation signals from the MWD tool to pass to the surface. The drill string is then manipulated until the proper orientation is obtained. The packer is then set by placing the required weight on the downhole assembly. Orientation could be checked immediately after setting by MWD. The drill stem is pulled free from the whipstock and the string is returned to the surface. Note that standard wireline orientation techniques can still be utilized.

The running tool is replaced and a window mill and watermelon mill(s) run into the hole; there is NO need for a starting mill as there is no shear pin block to remove from the face of the whipstock. Standard milling techniques follow and the initial side track established. The milling tools are then removed and regular drilling operations begun. Thus, the whipstock invention still results in a two-pass operation as does the present second generation device unless the operator wants to enlarge the window beyond that obtainable with the second pass.

In the case of the hydraulic set packer, the complete downhole tool is assembled and attached to its setting tool. The setting tool is in turn attached to a piston sub tool which converts mud pressure to hydraulic pressure in order to set the packer. Hydraulic tubing is run through the channels provided in the whipstock and connected between the setting tool/running tool assembly and the hydraulic packer. All other installation details are the same as presently used in the industry. Note that standard wireline techniques must be used for tool face orientation with the hydraulic packer. It is possible to use MWD techniques to orientate to tool face; however, experience has shown that there are high failure rates with the downhole tool which permits the use of MWD with hydraulic running tools, known as pinned by-pass valves.

Retrieval of the whipstock is relatively straightforward for operators who are experienced with "fishing techniques." The retrieval tool is attached to the bottom of a downhole string which includes all MWD tool and any required fishing jars. The drill string is run into the hole and circulation is maintained. In the area of the whipstock, the retrieval tool is orientated to closely align with the setting slot which acts as the tool guide for the retrieval tool. The mud port in the retrieval hook guides the circulation in such a manner that the setting slot and retrieval slot can be flushed clear of any debris (cuttings, sand, etc.) that could interfere with the retrieval operation. The drill string is then lowered until it 'bottoms'; the drill string is then raised which causes the hook to pull into the retrieval slot. As soon as proper engagement is made with the retrieval slot, the mud port valve(s) close, which send(s) a pressure pulse to the surface announcing engagement of the retrieval slot. At almost the same time, the spring loaded shear pin will latch the retrieval tool into the whipstock. Mud circulation should cease and the drill string raised to set the retrieval tool into the retrieval slot. Note that the spring loaded shear pin which locks into the face of the setting slot can be used as a landing point in order to "reset" any fishing jars that may be included in the downhole retrieval assembly. The weight required to shear this locking pin is much higher than the weight needed to re-set the fishing jars; thus, "controlled releasability" is maintained.

As the drill string is raised, the pulling force should increase. An increase in pulling force is a second indication of engagement. With the retrieval tool properly engaged and as the tool is pulled upward, the hook will move further back into the retrieval slot and pull the whipstock tool face into alignment with the whipstock base and anchor. Additionally, the extra length of the hook will extend beyond the whipstock back assuring that the tool top will not rub against the well bore. This means that the chances of the tool top (or head) catching against each and every casing joint are substantially reduced. The optional fishing jars can be reset as needed in order to assist in the retrieval of the whipstock.

The anchor packer used with a retrievable whipstock, be it mechanically set or hydraulically set, is chosen so that it incorporates shear screws in the upper set of slips (or wedges). As the whipstock/packer is raised, the pulling force will increase and shear the upper slip shear screws. This releases the upper slips on the anchor packer and the packer can now move upward. As the packer moves upwards, the packing will collapse as the packer extends against the bottom set of slips, which should release. It should be noted that the lower set of slips on a packer are designed to grip in the downward direction; thus, if the lower slips do not release, the packer can still be pulled out of the well bore. The entire whipstock/packer assembly is now free to be withdrawn from the well bore and a standard trip operation now follows.

It should be noted a setting slot and, if necessary, a retrieval slot can be manufactured or placed in the tool face of existing whipstocks. In fact existing warehouse stock could be modified in the field to incorporate a setting slot and a retrieval slot. This would allow the techniques described above to be used with second generation whipstocks. This concept will be discussed at a later time.

BRIEF DESCRIPTION OF THE DRAWINGS

FIGS. 1AA through 1EE are cross-sectional views of the WHIP-ANCHOR taken at the lines indicated in the main figure.

FIGS. 1A through 1E are cross-sectional views of the WHIP-ANCHOR taken at the lines indicated in the main figure showing the prior art.

FIGS. 2AA through 2FF are cross-sectional views of the WHIP-ANCHOR taken at the lines indicated in the main figure.

FIGS. 2A through 2F are cross-sectional views of the WHIP-ANCHOR taken at the lines indicated in the main figure showing the prior art.

FIG. 12AA is a cross section of the First Embodiment of the retrieval tool taken at AA/AA in FIG. 12A.

FIG. 12BB is a cross section of the Second Embodiment of the retrieval tool taken at BB/BB in FIG. 12B.

FIG. 12CC is a section view of the Piston and Surrounding Spring of the Piston Sleeve Valve taken at CC in FIG. 12C.

FIGS. 16 and 17 show the First (or Preferred) Embodiment of the setting tool, whereas FIGS. 18 and 19 show the Second (or Alternate) Embodiment of the setting tool, both respectively used for setting Mechanical and Hydraulic Packers.

FIGS. 25 and 26 show the drill stem, setting tool, and downhole assembly in place in a well bore after shearing the shear pin at the end of the first pass for a Mechanical and Hydraulic Packer respectively.

FIGS. 25A and 26A show the respective prior art.

FIG. 27 shows the complete milling assembly at the beginning of the second pass operation in a cased well bore for either a Mechanical and Hydraulic Packer respectively.

FIGS. 27A and 27B show the prior art.

DESCRIPTION OF THE PREFERRED EMBODIMENT

Figure 1:
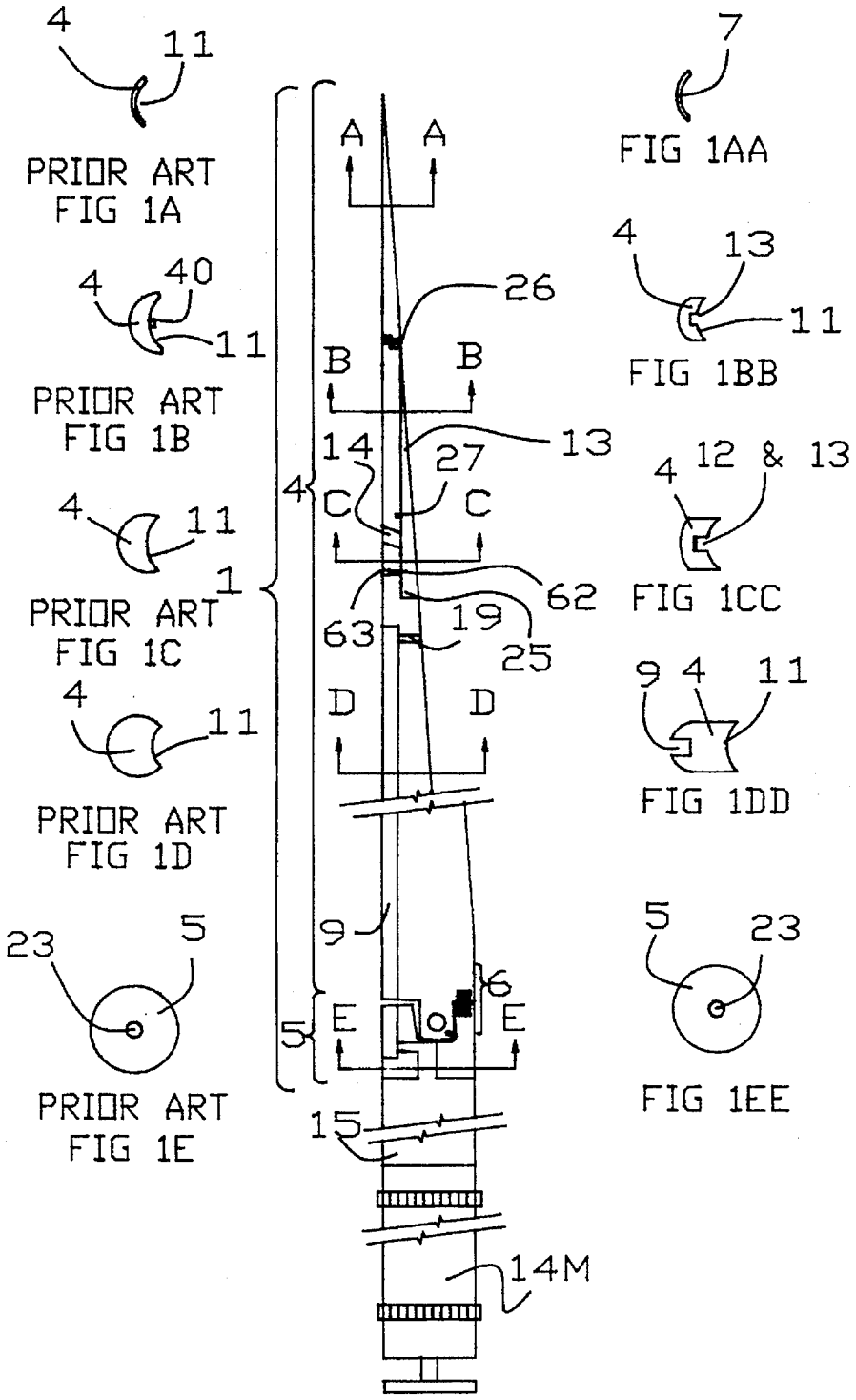
FIG. 1 is an elevational view of the WHIP-ANCHOR used with a mechanical packer whose OD is approximately the same as the WHIP-ANCHOR.

The present invention will be described in detail in what is termed as a two pass operation in which the whipstock (the item of the invention) and an anchor packer (be it a hydraulically or mechanically set packer) are releasably secured to a setting tool and any other required tools, all of which are in turn, connected to a drill string. The entire downhole whipstock and anchor-packer assembly will be referred to as a Whip-Anchor in this discussion.

A two pass operation begins when the drill string, with the Whip-Anchor attached via a setting tool, is lowered to the desired level in a well bore and then manipulated and so that the whipstock faces in the desired direction. The drill string is then further manipulated to set the anchor packer which in turn holds the whipstock in the desired orientation in the well bore. Once the packer is properly set the drill string is freed from the Whip-Anchor by pulling upward on the drill string. The drill string is withdrawn from the hole; thus, completing the first pass.

In a cased hole, a window and watermelon mill assembly is then placed on the drill string and the drill string lowered into the well bore for the second pass operation. (Note that the window and watermelon mill assembly generally consists of a single window mill and one or more watermelon mills.) The drill string is then used to cut a window in the casing for drilling the well bore in a deviated direction. Once the window is complete the drill string is withdrawn from the hole; thus, completing the second pass. If the well bore is open hole or uncased, the second pass may be omitted and regular deviated hole drilling may be commenced. All of these procedures are well known in the art and the main discussion of this invention will center about its use in cased holes. It should be understood that this discussion does not serve to limit the use of the invention in cased holes; but only serves to aid in the description of the device and method where needed comments will be made about the apparatus and its use in open hole.

In discussing multiple pass operations for setting the prior art whipstock or the instant invention, it must be realized that, although preparation of the bore hole is critical, proper preparation of the bore hole is NOT considered to be a part of the setting operation for a whipstock. The well bore must be clean and free from any and all obstructions and hole conditions must be known. (That is: size of casing, if cased; type of cement; where cement is; formation type; etc.) The term "hole conditions" is a term well used in the art and also refers to the ability to circulate drilling fluids in the well bore.

Part of the preparation for setting a whipstock involves making a trip into the well bore with a full gauge taper mill plus two full gauge watermelon mills (a so called "locked up bottom hole assembly") to below the point of planned sidetrack. A "trip" is a term of art which describes entering a bore hole with a drill string and exiting the bore hole, although the term can be used for a "one-way trip". Once the bottom hole assembly is below the planned point, drilling fluid is circulated until the hole is clean. A "clean hole" is readily determined by those skilled in the art of well bore drilling by observing circulation rates, pump horse power requirements, mud plasticity (rheology), net weight on bit, as the bottom hole assembly is lowered and raised in the hole, etc. If the hole conditions do not allow free movement (reciprocation) of the drill string and bottom hole assembly, then the planned setting of the whipstock should be abandoned. Those skilled in the art of setting whipstocks know that running a whipstock/packer assembly into a well bore with unknown conditions is foolish and dangerous.

Well bores are notorious for collapsing, for having highly twisted conduits, and other myriad problems. Thus, when the actual whipstock is run into the well bore, it is often necessary to rotate the whipstock/anchor assembly and reciprocate that assembly. The same may be said when a whipstock is retrieved from a well bore; thus, the retrieval tool must be capable of retaining the whipstock/packer assembly during reciprocation of the drill string.

The current technique of mounting the whipstock to the drill string via a shear pin and shear block does not prevent torsional shear on the pin, nor does the method allow for large downward exertion of force on the whipstock; thus, the shear pin can shear when it should not! This invention resolves these problems; however, it does not resolve the upward exertion of force because the shear pin must shear at a given force which may be less than the force needed to free a stuck whipstock. The mere fact that increased downward force is available could save a well bore if the whipstock becomes stuck. This is because the stuck whipstock can be forced to the point of deviation, orientated and used: or the stuck whip-stock could be forced below the point of deviation and abandoned.

In sidetracking well bores, the deviation to the new well path must be established from the old well bore. This can be accomplished by setting the present art whipstock/packer assembly and proceeding through a series of milling operations. The amount of deviation of the new well path from the old well bore path is limited by the strength of materials from which the mill bodies are made, when using rotary drilling techniques to sidetrack the old well bore. These mill bodies can only withstand a certain amount of bending (or flexing) stress before they fracture. Experience has shown that:

- 3⅜" OD mill bodies which are used on hole sizes from 3¾" OD to 5¼ " OD will safely withstand a maximum of 2.5 degrees of deflection per 100' whist milling:
- 4¾" OD mill bodies which are used on holes sizes from 5¼" OD to 7⅞" OD will safely withstand a maximum of 3 degrees of deflection per 100' whist milling:
- 6½" OD mill bodies which are used on holes sizes from 7⅞" OD to 9½" OD will safely withstand a maximum of 6 degrees of deflection per 100' whist milling: and
- 8" OD mill bodies which are used on holes sizes from 9½" OD to 12½" OD will safely withstand a maximum of 12 degrees of deflection per 100' whist milling.

Thus, current whipstock manufactures adjust the Tool Face slope to meet these criteria; however, each sized whipstock has its own particular slope and body size. When a whipstock is set in a well bore, it is centered within that well bore.

The hinge in a whipstock allows the centered whipstock to drop or fall against the well bore so that the top has no gap and the mill "sees" a continuous surface that is properly deflected at the correct slope.

The inventor has noted that the "effective tool face slope" will increase whenever the tool drops against the back of the well bore. Advantage of this fact can be taken by proposing three (or more) Whip-Anchor types. For example, in an 8¼" ID bore, with a Whip-Anchor having an 8" OD body and having a tool face slope of 3.18 degrees, the effective tool face slope will increase to about 3.28 degrees. This is because the back of the tool falls against the well bore; thus, increasing the deflection angle. The resulting "effective tool face angle" is well within the constraints listed above. In a similar manner, in a 12½" ID bore using a Whip-Anchor having an 8" OD the effective tool face angle will increase to about 4.07 degrees. But again, this effective angle is well within the above listed constraints.

Similar examples can be stated for other sizes of well bore and the inventor proposes that three types (or sizes) of Whip-Anchor will safely and effectively operate in common well bores sized from 3¾ inches to 12½ inches. This concept could readily be extended to larger (or smaller) bore sizes and the choice of three types of Whip-Anchor should not be taken as a limitation on the invention. These three types will cover the most commonly encountered well bores in the industry and will serve to reduce inventory stock of whipstocks. With all these points in mind the instant invention, which is a series of singular small inventions and improvements forming a workable downhole tool, will be described.

Figure 2:
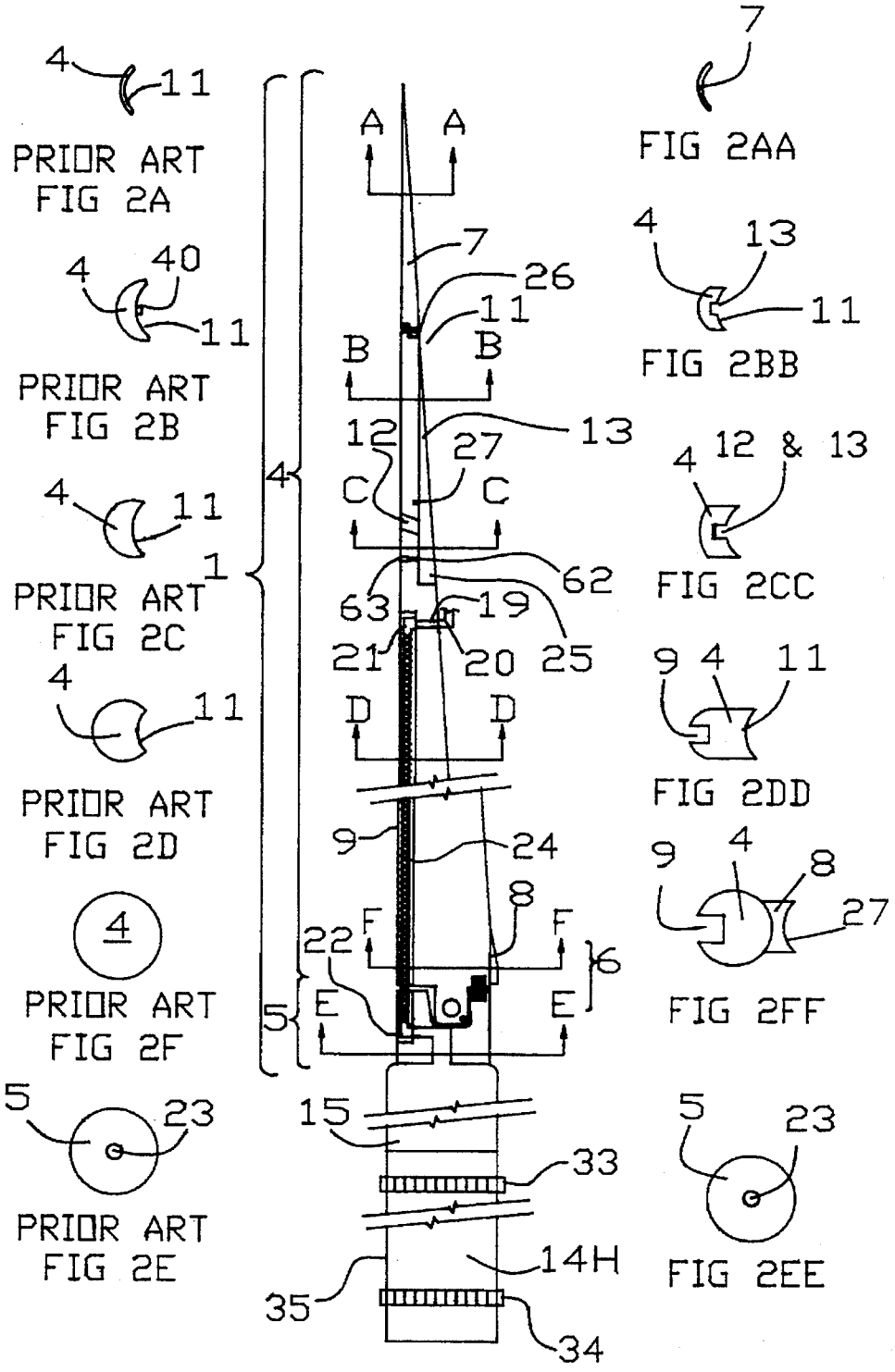
FIG. 2 is an elevational view of the WHIP-ANCHOR used with a hydraulic packer whose OD is larger than the WHIP-ANCHOR. This figure serves to illustrate a variant of the WHIP-ANCHOR system which uses the optional spacer.
Figure 3:
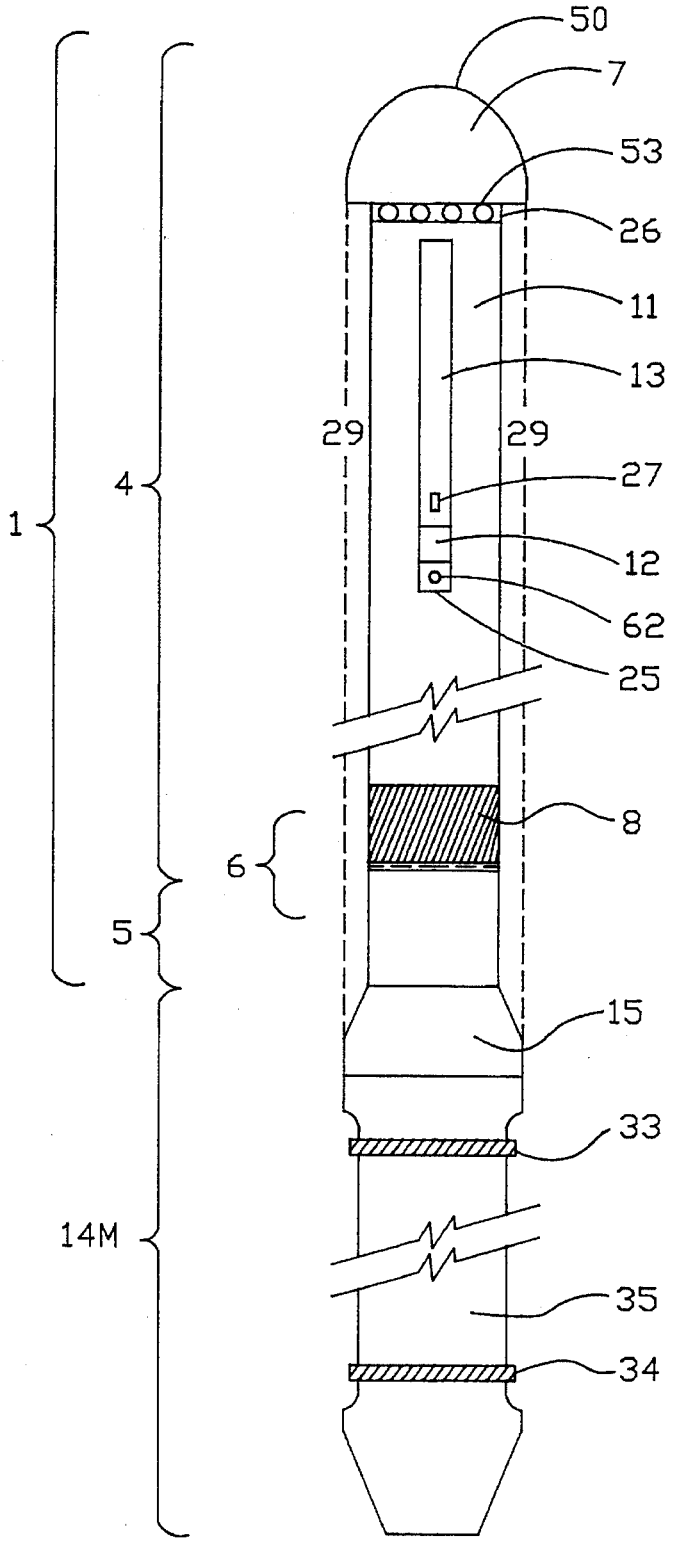
FIG. 3 is a frontal elevational view of the WHIP-ANCHOR system looking directly at the tool face and used with a mechanical packer whose OD is larger than the WHIP-ANCHOR. The illustration shows the prior art profile.

Attention is first directed to FIGS. 1, 2, and 3 of the drawings which illustrate the instant invention as it would appear prior to being placed inside a well bore. FIGS. 1 and 2 show a side elevational view and a series of cross-sectional views of the main part of the instant invention, namely the improved whipstock mounted to a mechanical packer (FIG. 1) and to a hydraulic packer (FIG. 2). There is little difference between the two Whip-Anchors in FIGS. 1 and 2 as regards the whipstock. Very little discussion of the packer will be undertaken since it does not form a part of this invention; however, the type of packer used does affect the 'plumbing' of the instant invention and the make-up of the tools used to manipulate the Whip-Anchor. FIG. 3, on the other hand, shows a front elevational view of the tool attached to a mechanical packer which is the simplest embodiment of the instant invention.

The invention, as previously stated is a series of inventions which make up a complete system (apparatus) and a series of methods for setting and retrieving Whip-Anchors. The system is made up of:

A deflector head,
A whipstock body with a spring hinge section,
An optional spacer,
A cross-over sub, and
A mechanical packer, and
  A mechanical setting tool, or
A hydraulic packer, and
  A hydraulic setting tool, and
    an improved piston sub, or
A retrieving tool, plus
Other necessary (existing) drill string tools.

Starting with FIGS. 1 and 3, which illustrate the instant invention in its simplest embodiment, the top of the tool body, 4, is shown with its deflector head, 7, in place. The deflector head is further illustrated in FIGS. 4A–D and will be discussed in detail later. The deflector head, 7, is mounted to its whipstock body, 4. Both the deflector head and the whipstock body must be chosen to fit the particular well bore size, 30. FIGS. 1AA through 1EE (as well as 2AA through 2FF) show cross-sectional views of the whipstock body; the equivalent prior art cross-sectional views are shown on the left-hand side of the illustration. The difference between the prior art and the instant invention are clearly illustrated. In the prior art the cupped or curved face, 11, of the whipstock ran completely from one side of the well bore to the other side; the inventor has discovered that this complete cupped face is not necessary and that a shortened version as shown in the cross-sectional views will suffice. On the other hand the deflector head, 7, must run from side to side of the well bore in order to deflect the window mill to the side of the well bore. Once the window mill has started its cut into the well bore side, it need only be guided by the partial cupped face of the instant invention. The fulcrum effect of the drill string will also aid in directing the window mill to the side of the well bore.

This discovery further means that a single whipstock body can serve in a number of different sized well bores which is completely different from the prior art in which a whipstock body could only be used in a given bore size for which the body was designed. Thus, the inventor contemplates three types (or sizes) of whipstock bodies as given in the table below, which will operate in well bores from 3¾ inches to 12½ inches.

TABLE 1

WHIP-ANCHOR TYPE (OR SIZE) AND PARAMETERS

| Type | Body Size | Fits Bore Size | Fits Casing Size | Tool Face | |
|---|---|---|---|---|---|
| Whipstock | | Inches | Inches | Angle | Curvature |
| I | 3½ | 3¾–5½ | 4½–6⅝ | 2.09° | 5½ |
| II | 5½ | 5¾–8 | 7–8⅝ | 2.62° | 8 |
| III | 8 | 8¼–12½ | 9⅝–13⅜ | 3.18° | 12½ |
| C | other | as needed | | | |

It should be noted that the given sizes of well bore are in common use and these sizes are not intended to act as a limitation on the invention, as the concept could easily be extended to smaller or larger bores by the simple expedient of changing the size of the body. In a similar manner additional body sizes could be inserted in the table so that the optional spacer, to be discussed, would become unnecessary. The actual whipstock body would be manufactured using current materials and techniques. A mild steel will be used; however, the tool face should have a hardened surface formed from Tungsten Carbide to resist wear. The finishing technique goes by such trade names as "Clusterite" or "Zitcoloy". These are proprietary and well established welding techniques for placing a hard finish on a surface that will resist wear.

As a specific example of whipstock configuration consider that the operator is cutting an 8½ inch window and drilling a new well path from 47 PPF (pound per foot) 9⅝ inch casing. The deflector head must match the ID of the 9⅝ inch casing and its tool face must match the 8½ inch window mill. This deflector would be mounted on a Type III whipstock whose back face will have a curvature of 8 inches and whose tool face will have a curvature of 12½ inches with a tool slope angle of 3.18°. These dimensions are given for example only and are not to be considered a limitation on this invention.

The deflector head, shown in FIGS. 4A–4D, must be sized to fit the bore of the well bore. The object of the deflector head is to "shove" the initial window mill into the side of the bore. It has been noted that the initial milling operation places severe wear on the top section of a whipstock. Thus, the deflector head is made of hardened steel with optional PCD (polycrystaline diamond—industrial diamond) inserts in the face of the head, 51. The deflector head length, 58, ranges in length from about one foot to about two feet; the actual length being determined by the bore size. For example in a 3½ inch bore size, the head should be about one foot long; whereas in a 12½ inch bore size the head should be about two feet long. The back of the deflector head, 57, is shaped to match the bore. That is, the back of the head will lie "flat" against the curved surface of the bore. The leading edge, 50, of the head is about 1/16 inch thick and matches the bore at its backside.

Starting from the leading edge and running down to the joint, 52, between the deflector head and the whipstock body, the tool face slopes outward from its back, forming a cupped surface with a tool face slope ranging from about two degrees (2°) to about 4 degrees (4°). The actual tool face slope will depend on the bore size, the deflector head length and the whipstock body tool face angle. For example the deflector head would have a tool face angle chosen to match the 2.09° angle found in the Type I whipstock, the 2.62° angle found in the Type II whipstock, and the 3.18° angle found in the Type III whipstock.

As specific example of deflector head configuration, if the operator is cutting an 8½ inch window and drilling a new well path from 47 PPF (pound per foot) 9⅝ inch casing, then the deflector head back would have curvature to match the ID of the 9⅝ inch casing—namely 8.681 inches. The deflector head tool face would have 8½ inch curvature with a 3.18° tool face slope angle and the length would be just over 16 inches. Again, it must be noted that these angles and dimensions should not be taken as a restriction on the invention as they only serve to give the best known tool face parameters as set by the bore conditions. If larger or smaller bores are in use, these parameters would have to be changed.

The deflector head will be manufactured from 4340 steel or from a material that has a similar hardness. Optional PCD inserts, 51, are placed in the standard pattern to minimize wear and actually can be considered as acting as a bearing surface for the window mill. Techniques for the insertion of PCD inserts and heat treating of metal to maintain a given hardness are well known in the art and will not be discussed.

Figure 4A:
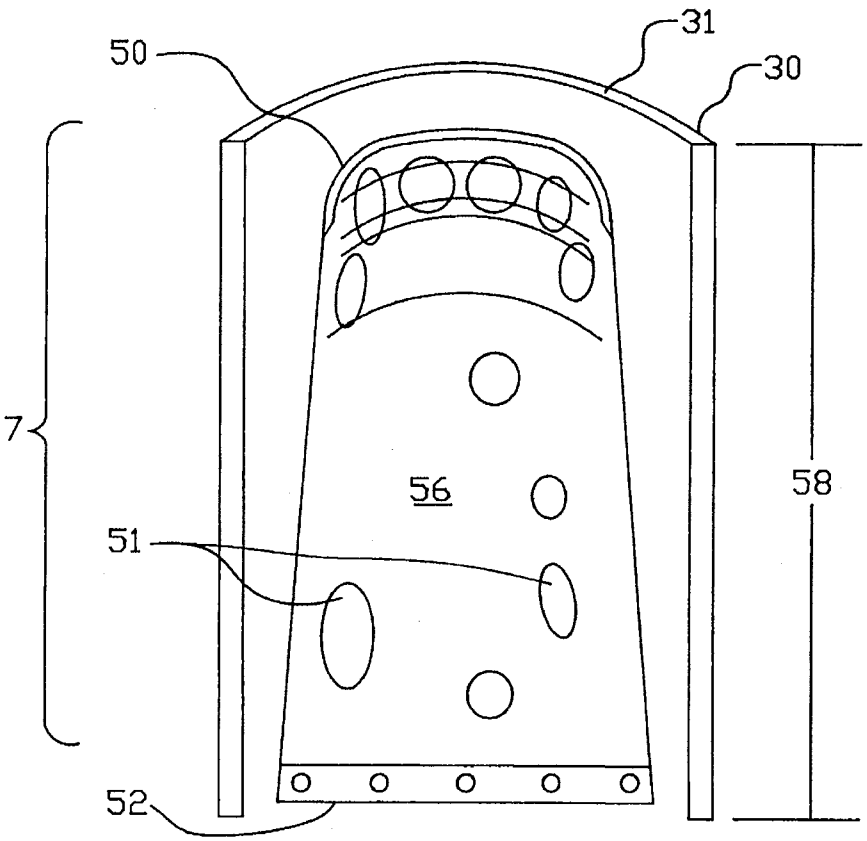
FIGS. 4A through 4D show a series of views the deflector head used on the WHIP-ANCHOR system.
Figure 4B:
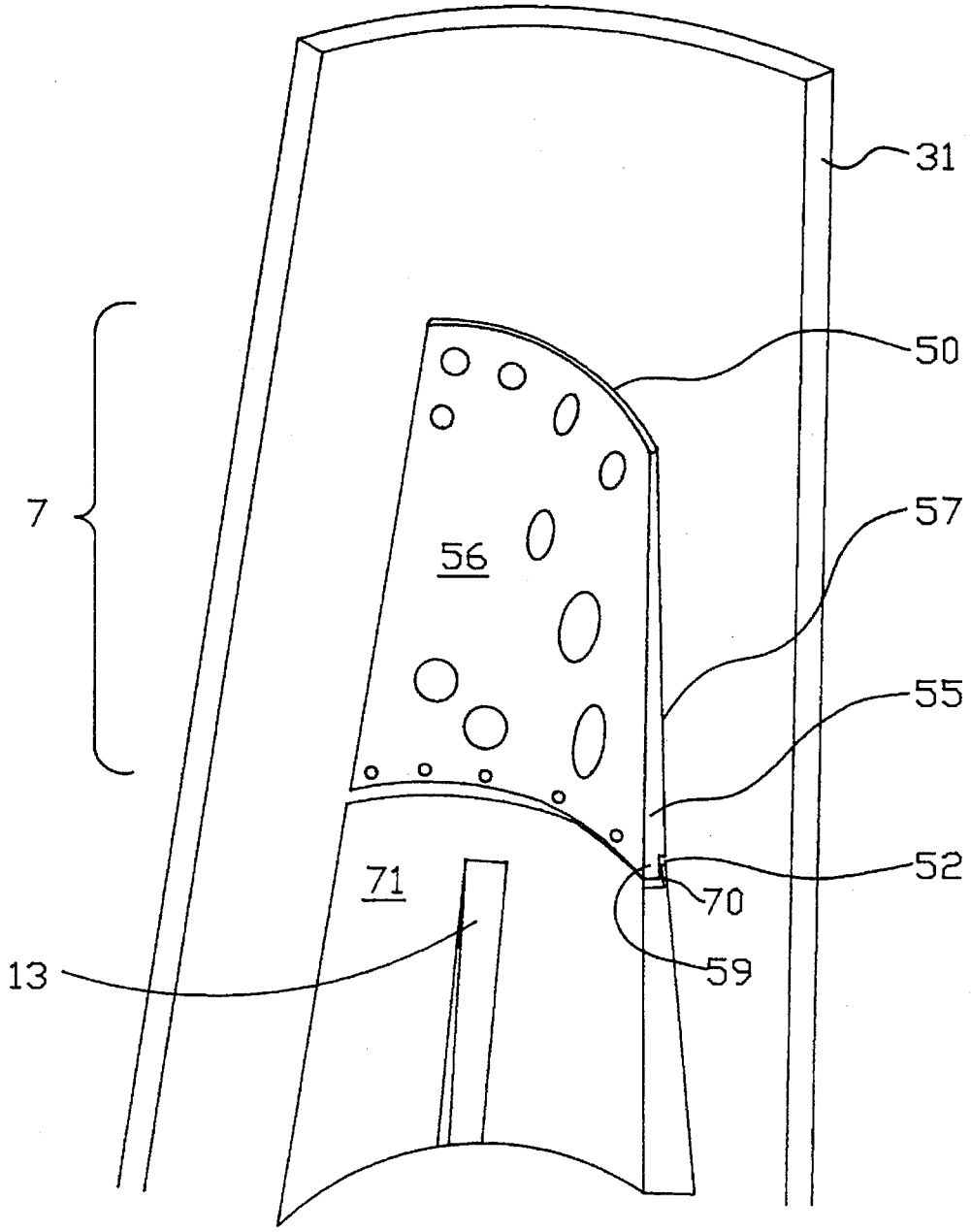
Figure 4C:
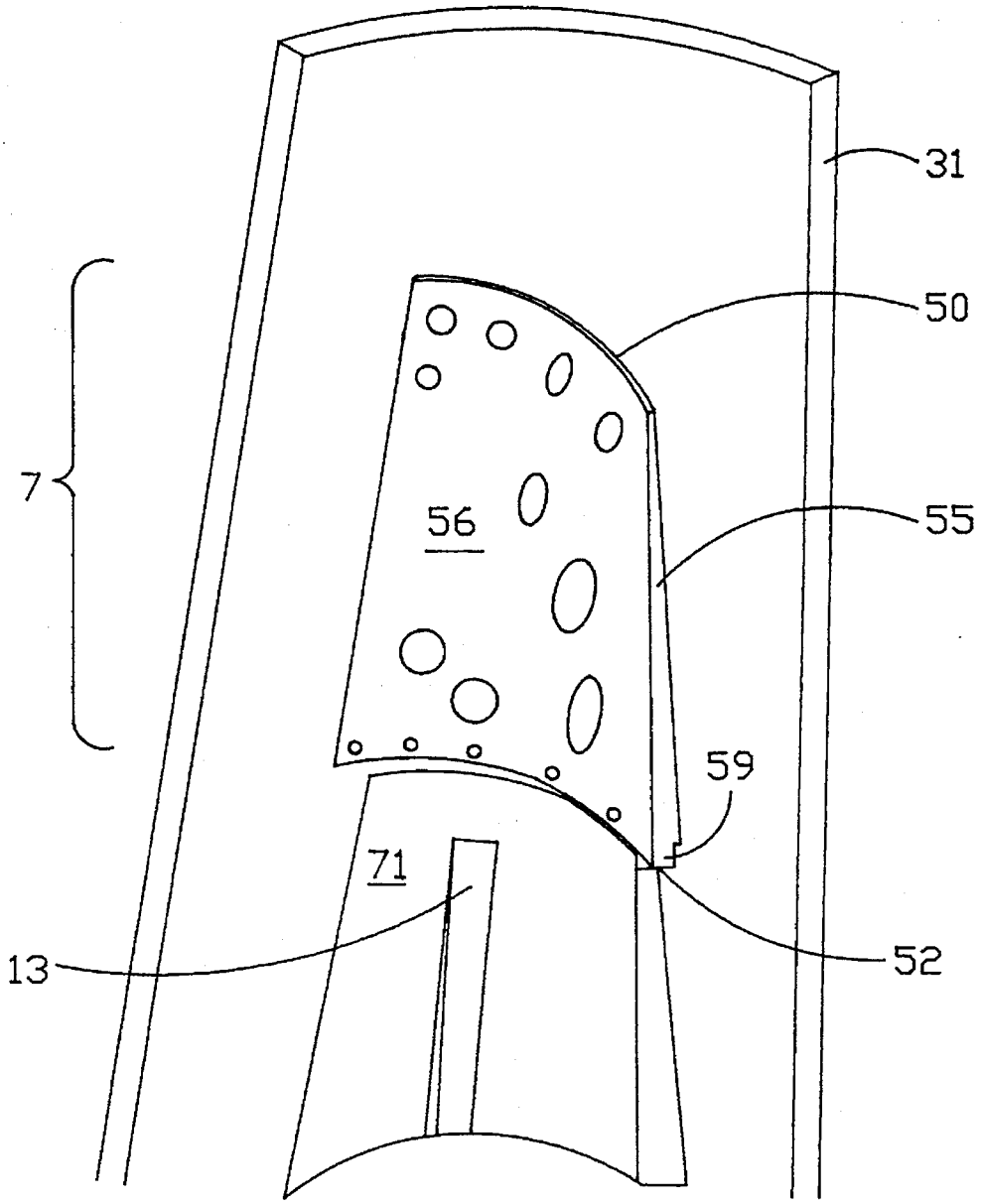
Figure 4D:
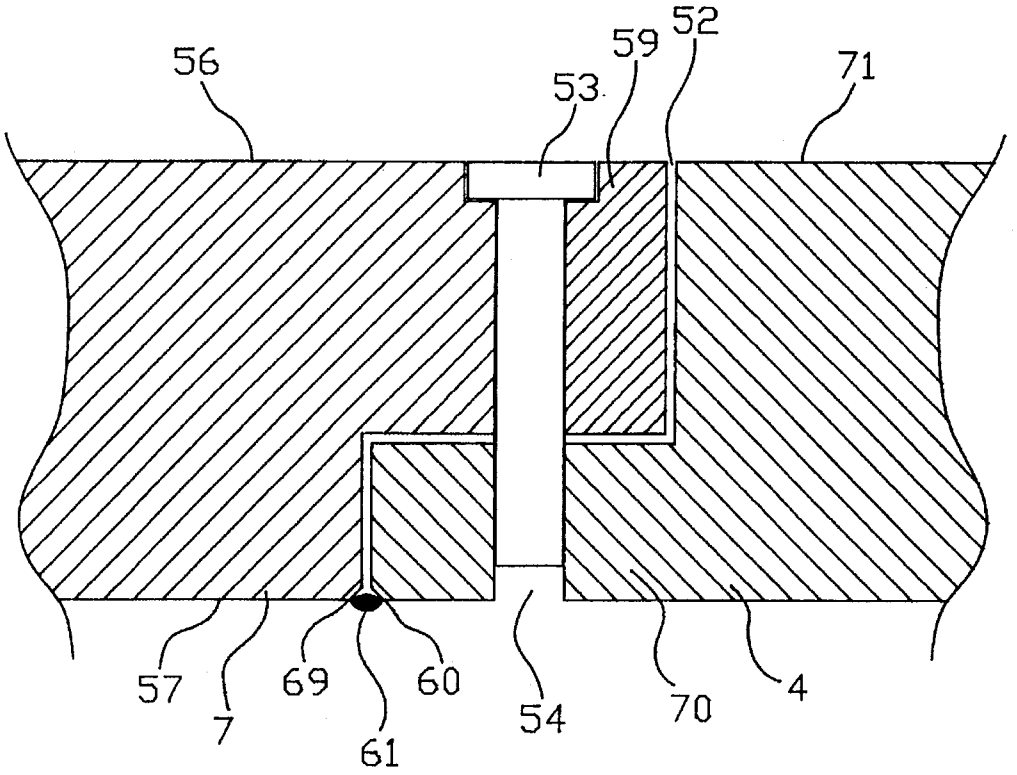

The deflector is attached to the whipstock body by pins, 53, press-fitted into holes, 54, in the whipstock body. As the deflector head will suffer considerable vibration when the window mill is on it, a number of pins will be needed and most likely the two sections will be welded to each other along the back junction gap, 60 and 69. The weld must be ground to match the back curvature of the deflector head. FIG. 4B clearly illustrates the deflector head attached to the whipstock body when the head and the body are of equal curvature, i.e. 3½" body to 3½" deflector head, 5½" body to 5½" deflector head, or 8" body to 8" deflector head. FIGS. 4C and 3 illustrate the larger deflector OD when attached to the smaller whipstock body OD, i.e. a 12½" deflector head attached to the Type III or 8" body.

TABLE 2

DEFLECTOR HEAD PARAMETERS

| WHIP-ANCHOR Type and Size | Slope | Length | Thickness at Connection |
|---|---|---|---|
| I - 3½" OD | 2.09 | 13¾" | ½" |
| II - 5½" OD | 2.62 | 16½" | ¾" |
| III - 8" OD | 3.18 | 18" | 1" |

A table of recommended dimensions for the three deflector heads that the Whip-Anchor system will require is given above. The radius of curvature for the backside of the various deflector head is not given because the required radius will be set by the bore ID in which the head is being used. A person skilled in the art of drilling well bores can easily supply the required radius remembering that the backside radius of curvature must be chosen so that the backside of the deflector head rests firmly against the bore. This, of course, will require a proper radius of curvature equal to that of the ID of the bore and a curved cone shape across the top side of the deflector head. All of these calculations are currently practiced and well known. The table is given for illustration only and is not intended to serve as a limitation on the instant invention. As previously noted, the sizes (or types) of whipstock can be modified to fit larger or smaller bores than those presently discussed.

The Setting Tool Slot, 13, can be found starting at or a couple of inches below the deflector head to whipstock body joint, 26. The relative position of the setting slot can best be seen in FIG. 3. The setting tool slot is about one inch (1") wide in the type I tool, about one and one half inches (1½") wide in the type II tool, and about two inches (2") wide in the type III tool. The width is actually determined by strength of material considerations based on the force required to set a mechanical packer and by the retrieval tool slot (these considerations will be discussed). The setting slot has a variable depth determined by the tool face angle. The back of the setting tool slot is perpendicular to the base of the whipstock and parallel to the back of the whipstock; thus, its variable depth as the slot continues towards the base of the whipstock. The slot terminates above the mid point of the whipstock. The actual termination point, 25, is determined by the type of whipstock (Type I, II or III) and is set by the properties of strength of materials. The depth of the slot at the bottom will range from about ½-inch in the Type I tool to about 1 inch in the Type III tool.

TABLE 3

SETTING TOOL PARAMETERS

| WHIP-ANCHOR Type and Size | Slope | Setting Slot Length, Width, Depth | Thickness to Back of Tool | Deflection of Milling Tool |
|---|---|---|---|---|
| I - 3½" OD | 2.09 | 22¼" × 1 1/32" × 0.81" | ½" | 1.31" |
| II - 5½" OD | 2.62 | 19½" × 1 5/32" × 0.90" | ¾" | 1.65" |
| III - 8" OD | 3.18 | 18" × 2 1/32" × 1" | 1" | 2.00" |

A recommended set of parameters is given in the table above for the setting slots used in the three types of Whip-Anchor system. These parameters are given to illustrate the instant invention and should not be considered as limitations on the present invention. If additional types of Whip-Anchor are proposed, the same constraints that apply to the example table below will yield the required parameters for smaller or larger Whip-Anchor types.

In the table above, the column entitled "Deflection of the Milling Tool" denotes the distance the Whip-Anchor Tool Face has moved the Window Mill into the casing (or bore side wall in an uncased hole). And the column entitled "Thickness to Back of Tool" is the distance measured at the bottom or base, 25, of the setting slot from the setting slot face to the tool back (this is shown as length 66 in a number of Figures).

It should be noted that all setting slots should end at the setting slot base, 25, at about thirty-six inches (36") from the top of the Whip-Anchor. The setting slot length is restricted because the milling tool must be able to fulcrum (lever) off of a smooth cupped face in order to properly guide the milling operation on its deviated trajectory. Additional discussion on trajectory appears later in this discussion.

The setting slot also provides access to the retrieval slot, 12, which runs from the face of the setting slot at an upward angle and exits at the back of the whipstock body. The retrieval slot is the same width as the setting slot and its bottom starts from about 1½ to 2½ inches above the bottom of the setting slot extending upward for about 10 inches. These dimensions depend on the Type of Whip-Anchor and will be discussed along with the retrieval slot and its function in a later portion of this discussion. Slightly above the retrieval tool slot, 12, is the location of the retrieval tool shear pin aperture or mechanism, 27; the choice being made by the particular embodiment being described. This location operates in conjunction with the Retrieval Tool latching system and its purpose will be explained later.

An upper hydraulic passageway, 19, is found at the saddle point of the cupped tool face slightly below the bottom of the settling slot. This passageway runs from the saddle point of the cupped tool face to a 'cut-a-way', 9, located in the back of the whipstock. The hydraulic passageway is threaded at both ends to accept a hydraulic street-ell fitting. The 'cut-a-way', 9, extends from the hydraulic passageway to the base of the whipstock below the hinge, 6. These components operate in conjunction with a hydraulic anchor packer and serve to conduct hydraulic fluid from a running tool located on the drill string to the hydraulic anchor packer when one is used with the Whip-Anchor system. This subsystem will be explained later.

Figures 5A, 5B, 5C:
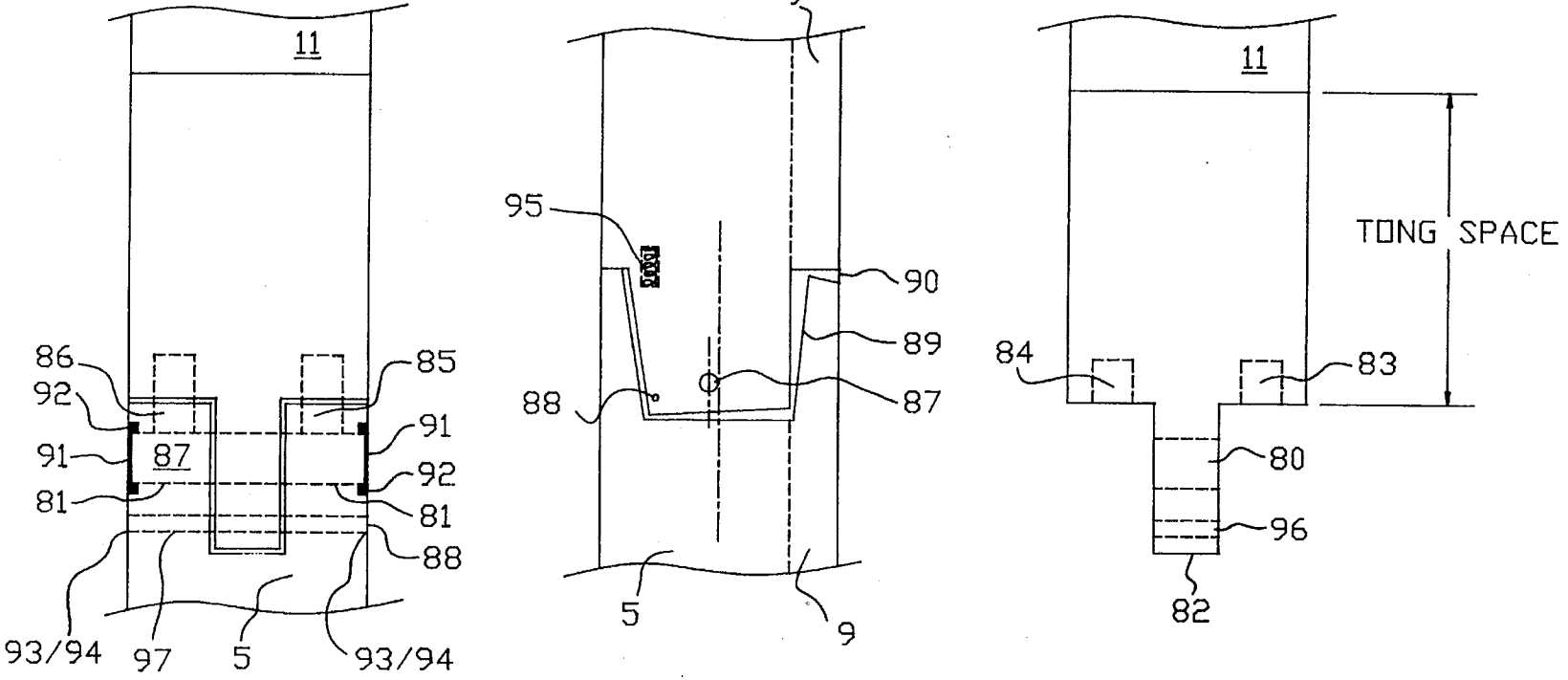
FIGS. 5A through 5C show a series of views of the WHIP-ANCHOR hinge, hinge pin, hinge springs, and spring retainer shear pin.

The upper section of the whipstock, 4, is hinged to the whipstock base, 5, via a hinge assembly, 6. The hinge assembly is shown in detail in FIGS. 5A through 5C and is similar to a prior art hinge except that springs, 95, have been added in spring openings, 83 through 86 and the hinge center is offset from the Whip-Anchor center line by about ¾-inch towards the tool face. These springs serve to ensure that the whipstock will fall away from the point of deviation against the back of the well bore. These springs are similar to those found in 'valve-lifters' used in engines. The springs are retained in their compressed position while the whipstock is being manipulated by a spring retainer shear pin, 88. This pin is approximately ¼-inch in diameter and runs through its respective spring retainer shear pin opening in the upper section, 96, and base section, 97, of the whipstock. The upper section opening, 96, and base section opening, 97, will only align when the springs are compressed and when the whipstock is perpendicular to its base. The spring retainer shear pin, 88, is held in place by two snap rings, 93, in a snap ring groove, 94, at either end of the pin within the base opening, 97. The technique for shearing this pin, when the whipstock is set, will be explained later.

The upper and base sections of the whipstock are hinged together using a hinge pin, 87, which passes through the hinge pin opening, 81, in the base, and through the corresponding hinge pin opening, 80 in the upper section of the whipstock. It should be noted that the center of the hinge pin is offset towards the front of the whipstock by about ¾-inch; unlike the present art. This offset assures that the spring retainer shear pin, 88, will shear whenever weight is applied in the downward direction on the Whip-Anchor as it is set. Careful observation of FIG. 5B will show that a large downward force will tend to push the upper section of the whipstock backwards or away from the tool face. This is the direction that the whipstock must fall (or move towards) in order for proper hole deviation to occur. The downward force will pivot about the off-set hinge, 87, shearing the spring retaining pin, 88. This releases the hinge springs which will hold the back of the whipstock against the well bore. The back of the hinge base, 89, is sloped to assure that the upper hinge section 82, is not prohibited from its backward motion while shearing the spring retainer shear pin, 88. In a similar manner the top of the back of the hinge base, 90, is also sloped to avoid any chance of interference.

The spring force feature will find great utility in near vertical holes (within ±5° of vertical) and in holes where the operator wishes to deviate from the low side of the well bore. Deviation from the low side is seldom performed because of the high failure rate that most operators have experienced.

The base section of the whipstock continues the 'cut-a-way', 9, which is designed to hold a high pressure hydraulic line for use with a hydraulic packer. The 'cut-a-way', 9, terminates in a another hydraulic fluid passageway, 23. This passageway runs from the cut-a-way, 9, in the base section, through the center of the base, and terminates in the bottom flange of the base where it can communicate with a hydraulic packer, 14H, through a cross-over sub, 15. The base hydraulic passageway, 23, has threads for a street-ell connection where it enters the 'cut-a-way', 9. The actual hydraulic plumbing will be explained later.

In the prior art of setting Whipstocks, it was generally accepted that the OD or profile, 29, of the Whipstocks should have an approximate clearance of, or slightly more than, one half inch (½) within the well bore. It is possible in special situations, where the well bore is in very "good condition", to reduce this clearance to one quarter inch (¼). This invention has three sizes of whipstock bodies to fit bore sizes from 3¾ inches to 12½ inches ID. Thus, for example, in a well bore using 60 PPF (pounds per foot) casing having an ID of 12½ ", the correct Whip-Anchor would be the Type III, which has a body OD of 8". After the Whip-Anchor was anchored (centered) in the 12½" ID well bore, there would be a 2¼" clearance or gap between the 8" OD Whip-Anchor body and the 12½" ID well bore. Depending on the degree of inclination in the well bore to be sidetracked and the direction of the intended sidetrack, an Optional Spacer, 8, may be required to reduce this clearance (gap) to a minimum of ½" in the direction of the intended sidetrack. This example is given for illustration only and optional spacer requirements for given well bores can easily be calculated using known art.

The drill string has a fulcrum effect created by the milling/drilling tool and the watermelon mill(s) whenever it is deflected (or deviated) to the "high side" of a well bore having some degree of inclination from vertical. Thus, as the window milling operation proceeds, the drill string acts as a lever to force the window mill into the casing (or wall of an uncased hole) under the guidance of the Deflector Head and subsequent travel along the Tool Face of the Whip-Anchor body. Once the initial cut into the side of the well bore has been made and once the mills have moved along the Tool Face of the Whip-Anchor, they have formed a "line of trajectory" equal to (or more than) the degree of slope placed on the Tool Face of the Whip-Anchor. When the window mill reaches the bottom of the Tool Face, it will have milled nearly all the casing wall (or side of an uncased hole). The watermelon mill(s) will still be on the Tool Face of the Whip-Anchor, giving guidance and "fulcruming" the window mill away from the old well bore.

Figure 6A:
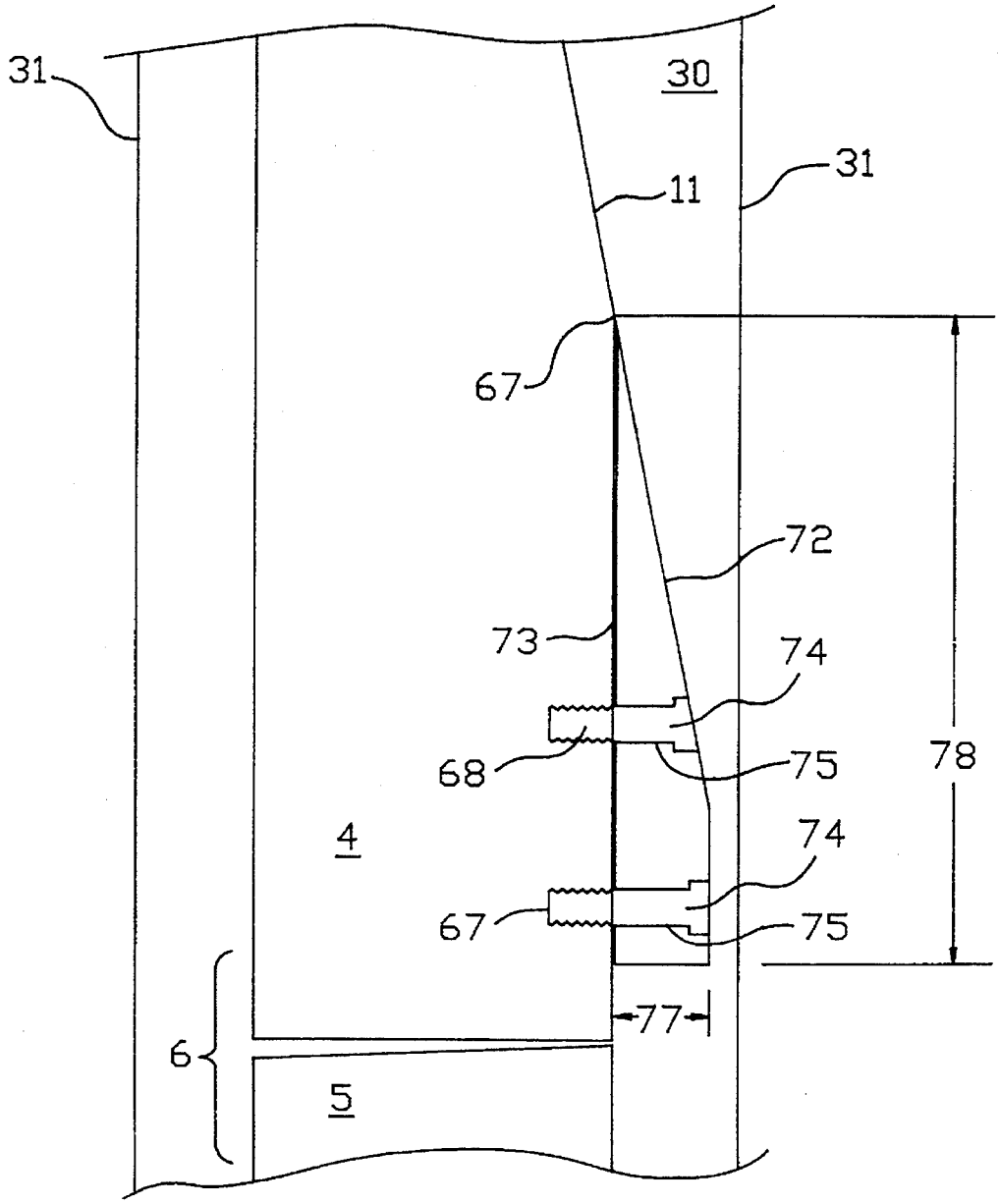
FIGS. 6A through 6C show the details of the optional spacer block.
Figure 6C:
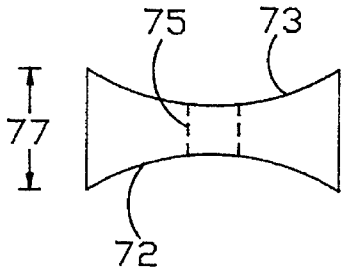
Figure 6B:
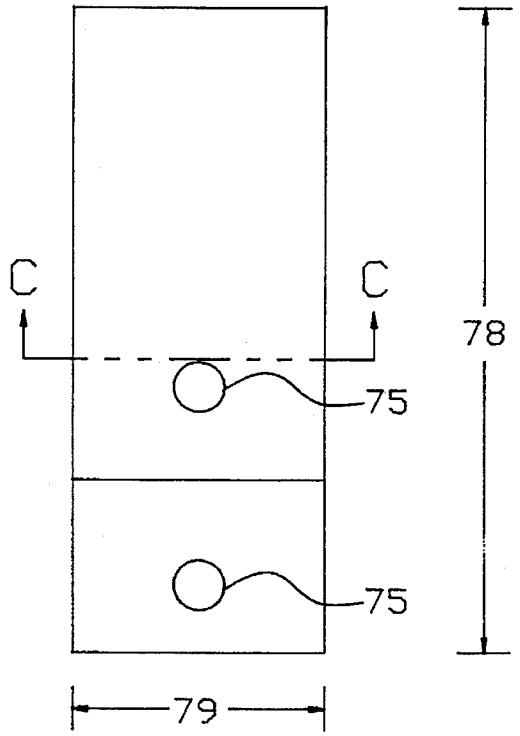

In the instant invention, it may be necessary to use an optional spacer at the base of the Whip-Anchor Tool Face whenever the gap between the well bore and the Whip-Anchor body exceeds 1" and the Whip-Anchor System is being used in a well bore with less than 10 degrees of inclination. The higher the degree of inclination from vertical in a well bore, the more pronounced the "fulcrum effect" and the spacer is not necessary. It might be noted, that as the top of the Whip-Anchor rests against the 12½" well bore, the "trajectory path" created by the 8" OD Whip-Anchor Tool Face increases from 3.18 degrees to 4.07 degrees. This increase in deviation from the old well bore further enhances the movement of the new path away from the old well bore. FIGS. 6A and 6B give greater details on the optional spacer and its attachment to the Whip-Anchor body to extend the Tool Face and lessen the gap. (In general, all illustrations of the Whip-Anchor system which use a hydraulic packer are shown with this optional spacer; see for example FIG. 2.) In designing this Whip-Anchor system, the bottom or base, 25, of the setting slot should be located above the fulcrum point for the watermelon mills. If this is not done, then special watermelon mills must be used which do not bit into the setting slot when in use.

The optional spacer, 8, is attached to the lower portion of the upper section of the Whip-Anchor by two (or more if required) studs, 74. The tool face side of the spacer, 72, is a continuation of the Whip-Anchor Tool Face, 11. As a consequence, the tool face of the optional spacer will have the same slope and cupping as the type (size) Whip-Anchor body to which it is attached. The two studs, 74 pass through apertures in the optional spacer, 75, and into threaded openings, 68 which are in the Whip-Anchor body. The back of the spacer has the same curvature as the body OD of the type of Whip-Anchor to which it is being attached. The width of the optional spacer, 79, will be the same as the width of the upper section of the Whip-Anchor and the length of the spacer, 78, will be set by the Whip-Anchor type (size). The optional spacer depth, 77, and the spacer base length, 76, will be set by parameters to be determined by the Whip-Anchor type (size) and bore hole diameter.

The table below gives approximate dimensions for commonly used well bores and conditions. The table is not intended to serve as a limitation on this disclosure but is offered only as illustration and guidance for those skilled in the art. Remember that a spacer is not generally necessary and the optional spacer will find its greatest use whenever the well bore is within 10 degrees of vertical and when the gap between the centered (set) whipstock body and the well bore exceeds about one inch.

The base of the whipstock, 5, is attached to a cross-over sub, 15, which in turn is attached to a mechanical packer, 14M. The packer that is shown in FIG. 1 is a very old style called a "set-down" packer. This packer is shown for illustration and ease of explanation only and is not considered to be a limitation on the invention. This invention is designed to be used with any style of mechanical (or hydraulic) anchor packer.

TABLE 4

| OPTIONAL SPACER PARAMETERS | | | | | | |
|---|---|---|---|---|---|---|
| Whipstock | | | Bore Size | Spacer | Curve | Tool Face |
| Type | Size | Casing Size | Depth | Back | Cup | and Slope |
| I | 3½ | 4½–6⅝ | 3¾–4½ | 0 | NA | NA at NA |
| I | 3½ | 4½–6⅝ | 4¾–5½ | ½ | 3½ | 5½ at 2.09 |
| II | 5½ | 7–8⅝ | 5¾–7 | 0 | NA | NA at NA |
| II | 5½ | 7–8⅝ | 7¼–8 | ⅝ | 5½ | 8 at 2.62 |
| III | 8 | 9⅝–13⅜ | 8¼–10 | 0 | NA | NA at NA |
| III | 8 | 9⅝–13⅜ | 10–11 | 1 | 8 | 12½ at 3.18 |
| III | 8 | 9⅝–13⅜ | 11½–12½ | 1¾ | 8 | 12½ at 3.19 |

The instant invention can readily be adapted for use with a hydraulic packer as shown in FIG. 2. The exact same whipstock is used except for additional plumbing features. A hydraulic street-ell, 20, is screwed into the matching threads within the upper hydraulic passageway, 19, in the face of the whipstock. In a similar manner another hydraulic street-ell, 21, is screwed into the backside entry of the same upper hydraulic passageway, 19. Finally a further hydraulic street-ell, 22, is screwed into the base hydraulic passageway. A high pressure hydraulic hose, 24, is attached between the two street-ells located in the 'cut-away', 9, in the backside of the whipstock. Standard hydraulic packer procedures are now followed. A cross-over sub, 15, is screwed onto the whipstock followed by a hydraulic packer, 14H. A hydraulic connection is made between the face street-ell, 20, and the setting tool. This part of the invention and procedure will be explained later.

Thus, one model of Whip-Anchor System using three sizes of whipstock body can serve as a whipstock/packer assembly in well bores from 3½ inches to 12½ inches and the same one model can be used with mechanical or hydraulic packers. As will be explained in a latter part of the discussion, this Whip-Anchor is retrievable.

Attention should now be directed to the Setting Tool illustrated in FIGS. 7 through 10. It should be remembered that the same setting tool will operate a mechanical or hydraulic packer used in conjunction with the instant invention. The general setting tool will be described first and then the necessary changes that make it a mechanical or hydraulic Whip-Anchor setting tool will be described. There are three different sizes of setting tool because there are three different sizes (or types) of Whip-Anchor. The setting slot, 12, is determined by strength of material and requires set by the size of the tool and the pull that will be required to retrieve the tool. Thus, the slot width varies from about 1 inch for the Type I tool, to about 1½ inches for the Type II tool, and to about 2 inches for the Type III tool. It should be noted that other sizes of Whip-Anchor could be used and the setting slot width will still be determined by similar strength of material consideration; thus, this example width should not be construed as a limitation on the instant invention. In a similar manner the length of the tool, 109, as measured from the sub, 100, to the bottom face of the setting tool, 108, will vary with the Whip-Anchor type.

Figure 7:
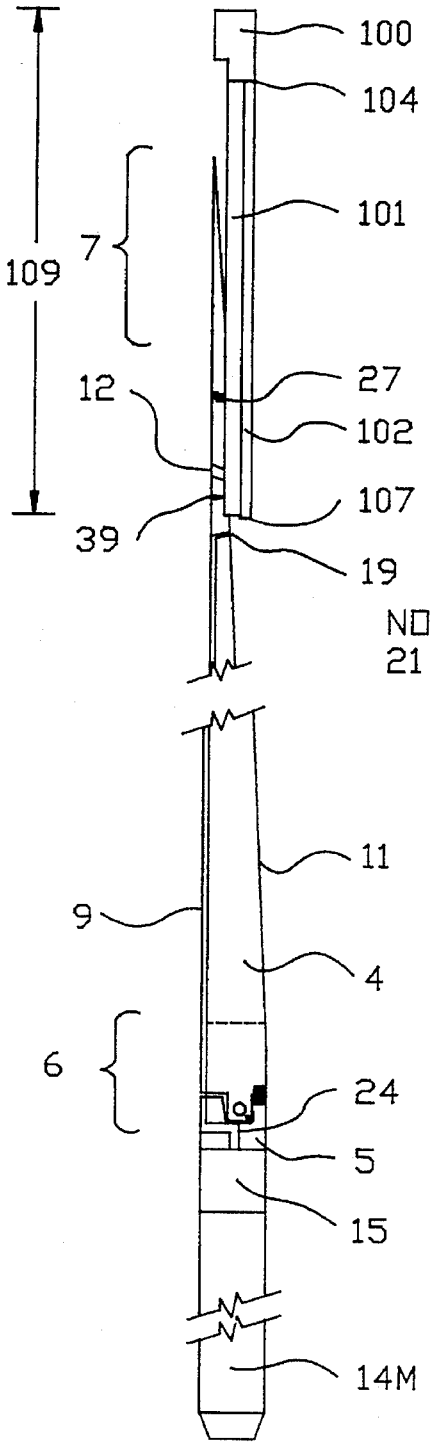
FIG. 7 is a side elevational view of the WHIP-ANCHOR system attached to its respective variant of the Mechanical Setting Tool.
Figure 8:
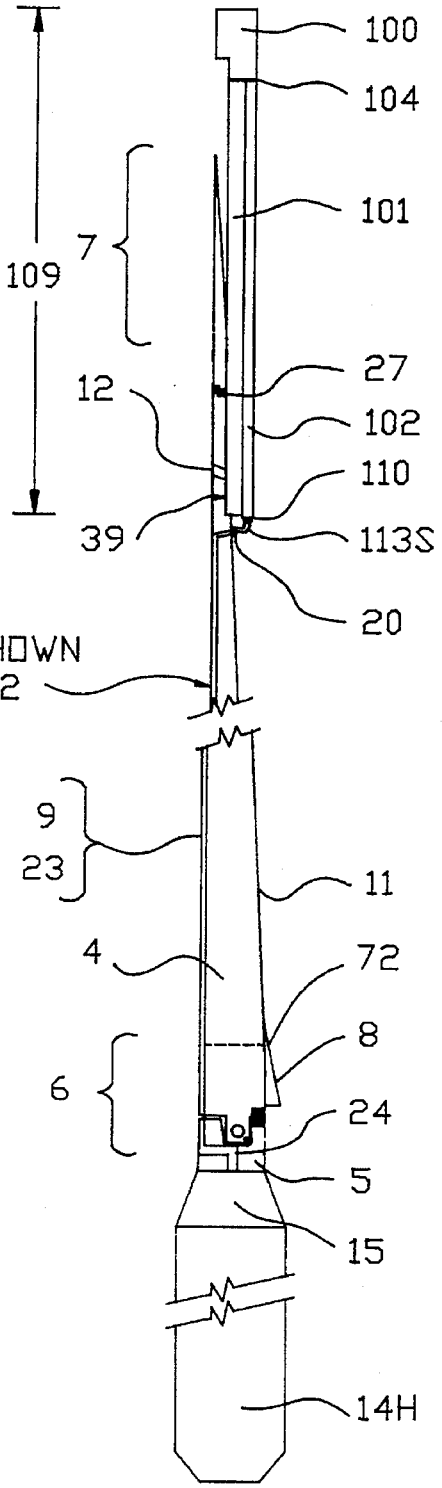
FIG. 8 is a side elevational view of the WHIP-ANCHOR system attached to its respective variant of the Hydraulic Setting Tool.

The setting tool, 2, consists of three subassemblies, which are best illustrated in FIGS. 7 or 8, these being:

the setting tool rectangular bar, 101;

the setting tool fluid line or tubular, 102; and the setting tool sub, 100, often called the top sub.

Figure 9:
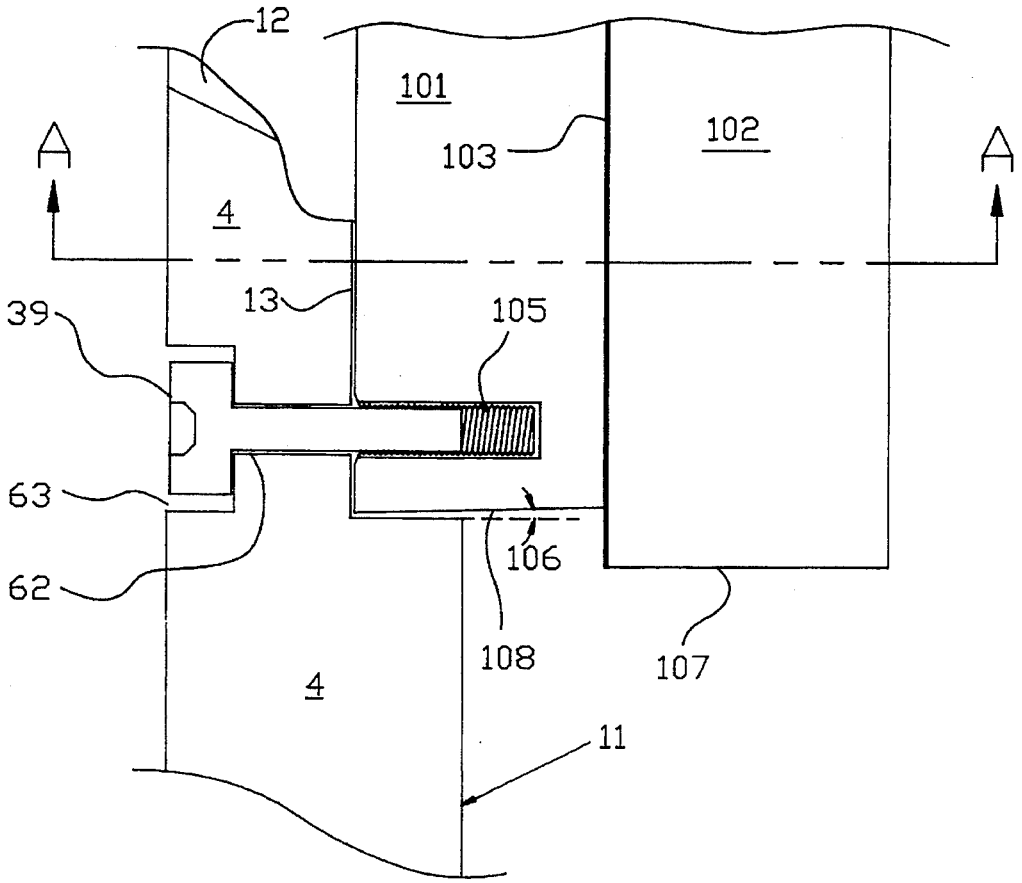
FIG. 9 gives details of attachment of the Setting Tool to the WHIP-ANCHOR.
Figure 9A:
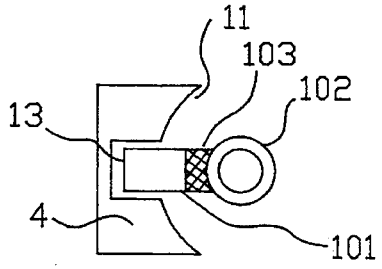
FIG. 9A is a cross-sectional view of the Setting Tool within the WHIP-ANCHOR setting slot taken at AA in FIG. 9.
Figure 10A:
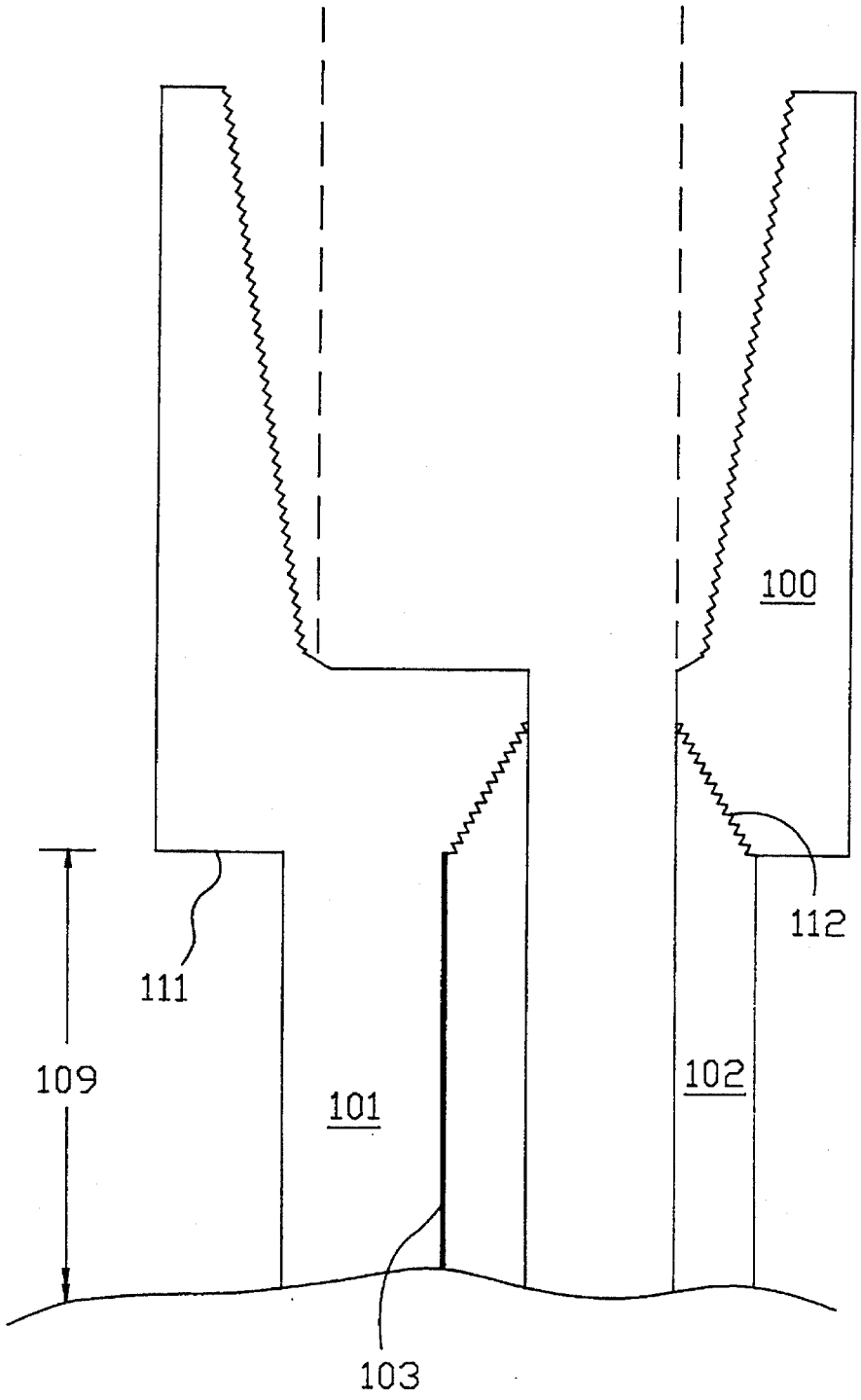
FIGS. 10A and 10B show construction details for the preferred embodiment of the setting tool using a setting bar and tubular welded to a top sub.
Figure 10B:
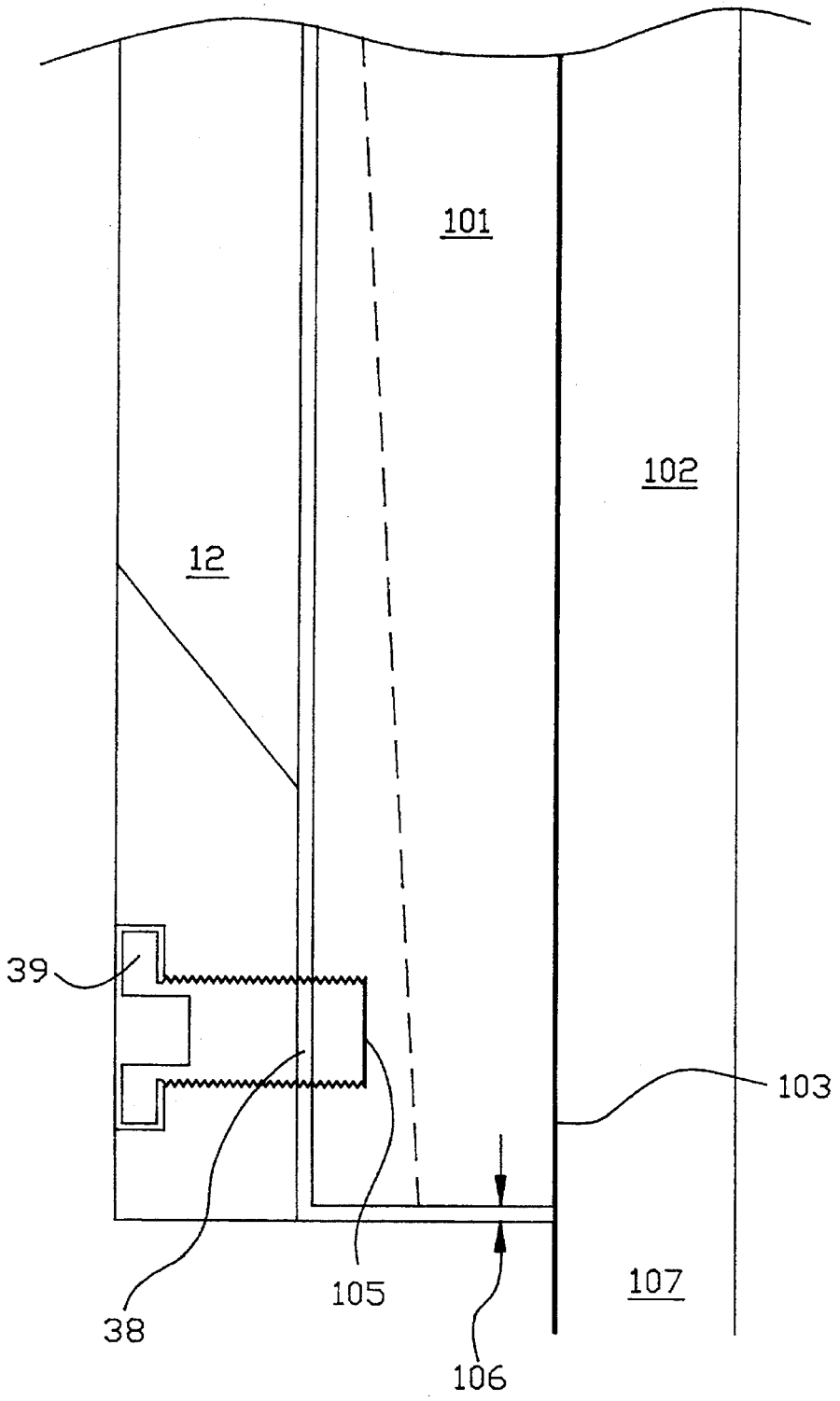

The rectangular bar fits within the setting tool slot, 13, located in the face of the whipstock as previously discussed. In the preferred embodiment of the setting tool the fluid line or tubular, 102, is threaded into the top sub as shown in FIG. 10A. The threads can be back welded if desired. The fluid line or tubular is capable of safely carrying circulation mud or hydraulic fluid under pressure. The bar is welded to the setting tool fluid line or tubular, 102, and in turn to the top sub, 100, which is capable of connection to the drill string. It is possible to weld the tubular directly into a recess in the top sub without using threaded fittings; however, threaded fittings would make construction of the setting tool easier. FIG. 9A illustrates a cross-sectional view of the setting tool, 2, within the setting slot, 13.

The pertinent details of the setting tool will be discussed. Turn now to FIG. 9, which shows a close up view of the tool in the selling slot and at the base of the setting slot and to FIGS. 10A through 10D, which show construction of the tool. The bottom face of the setting tool, 108, has a slight angle, 106, which means that the setting tool bottom rests on the setting slot bottom of the whipstock at the point farthest away from the tool face. There will be a slight gap between the setting tool bottom face, 108, and the setting slot bottom, 25, nearest the whipstock tool face, 11. This gap is on the order of several thousandths of an inch and its purpose will be described later. The setting fluid line or tubular, 102, terminates at a point slightly below the termination of the bar. The actual distance is not critical because it is used to allow for ease of attachment of a hydraulic fitting. The inside of the open end, 107, of the fluid line is threaded to accept a hydraulic fitting. The setting tool is attached to the Whip-Anchor by a shear pin, 39. This shear pin is the same as used in the art for currently setting whipstocks; however, it is scored to assure perfect fracture.

The shear pin, 39, is made of mild steel and is threaded to fit the threaded aperture, 105, in the setting tool. The shear pin passes through a corresponding aperture, 62, in the whipstock. This opening is larger than the shear pin and allows for slight movement of the shear pin within that opening. This is to give the shear pin some relaxation from any applied downward or torsional forces exerted by the Setting Tool in reaction to forces applied to the drill string. This allows the downward force to be applied directly to the bottom of the setting slot and the torsional forces to be directly applied to the side walls of the setting slot. Additionally, this loose fit of the shear pin, 39, in the whipstock aperture, 62, ensures that if sufficient downward force is applied on the setting tool, then the bottom face of the setting tool will fully set down on the bottom of the setting slot. This action will impart a shear force to the spring retaining shear pin, 88, because of the combination of the offset hinge, 6, and the bottom tool face angle, 106, on the setting tool.

It should be noted that if the spring retainer pin, 88, is sheared while the Whip-Anchor is being run into the well bore, the hinge section of the instant invention reverts back to the prior art employed by current whipstock/packer systems using an unpinned hinge. This condition, which could be brought about by having to force the whipstock through a particularly tortuous path and having to exert a great amount of downward force on the setting tool, does not cause any problems in using the instant device. This is because the base of the anchor packer has a larger OD than he slips (wedges or scaling) elements section of the packer and further more is "bullet shaped." (See FIG. 3) The instant invention will operate better than the prior art in a tortuous path for two reasons:

a) a great amount of downward force (of weight) can be applied without any fear of shearing the shear pin because the force is applied directly to the Whip-Anchor via the setting tool sitting in the bottom of the setting slot, and b) because the Whip-Anchor can be rotated without fear of shearing the shear pin due because the torsional force (rotation) is applied directly to the walls of the setting slot.

Additionally the shear pin has a groove, 38, cut axially around the pin at such a location so that when the pin is installed the groove is located slightly inside the setting slot face. This groove assures that the shear pin will shear at the groove. This means that, once the pin has sheared, there will be no material extending from the whipstock shear pin aperture, 62, into the setting slot. The back of the whipstock has a recess, 63, which accepts the Allen Cap Head of the shear pin and assures that no material extends beyond the back side of the whipstock.

TABLE 5

SHEAR STUD PLACEMENT AND SETTING SLOT BASE PARAMETERS

| Whip-Stock Size | Stud Size | Slot Width | Slot Depth | Slot Length | Up from base of Slot | Stud Depth |
|---|---|---|---|---|---|---|
| I | ½" | 1 1/32" | 0.81" | 22¼" | 1" | ⅜" |
| II | ⅝" | 1 17/32" | 0.90" | 19½" | 1¼" | ½" |
| III | ¾" | 2 1/32" | 1.00" | 18" | 1½" | ¾" |

The recess, 63, has an axial groove, 64, which can accept a keeper ring, 37, which will keep the Allen Cap Head within the body of the Whip-Anchor after it is sheared. Any type of retainer mechanism, such as welding could be employed. The table given above is for purposes of illustration of the best mode. It should not be construed as a limitation. All dimensions will be set by strength of material considerations; thus, if the material changes, or if a weakness shows up, a metallurgical engineer would know how to adjust the values given above.

When the setting tool, 2, is used with a mechanical packer, the setting tool fluid line, 102, is left open as shown in FIG. 7. Mud can be circulated through this fluid line and if an MWD tool is attached to the setting tool sub, proper Whip-Anchor tool face orientation may be accomplished. If the operator requires, the fluid line, 102, can be attached to circulate through a mechanical anchor-packer with a check valve to be able to wash to bottom in open (uncased) hole conditions. (This arrangement is not shown and would not impair the operation of the Whip-Anchor. The arrangement would use all of the described hydraulic anchor packing plumbing and the mud would circulate in the same path down through the cross-over sub and out of the bottom of the mechanical packer.)

FIG. 8 shows the arrangement of the setting tool when it is used to set a hydraulic packer. If the setting tool is used with a hydraulic packer, then a hydraulic hose, 113S, would be attached to tubing at the threaded open end, 107, and run to the equivalent hydraulic fitting, 20, on the cupped face of the Whip-Anchor. The procedures (or methods) for using this setting tool with either the hydraulic or mechanical packer will be discussed later. It should be noted that the Whip-Anchor is illustrated in FIG. 8 as being connected to a larger packer via the cross-over sub, 15. The optional spacer, 8, is also shown; however, the hydraulic fittings and hose within the whipstock have been omitted for clarity. Additional illustrations may be found in FIGS. 16 through 19.

Figure 10C:
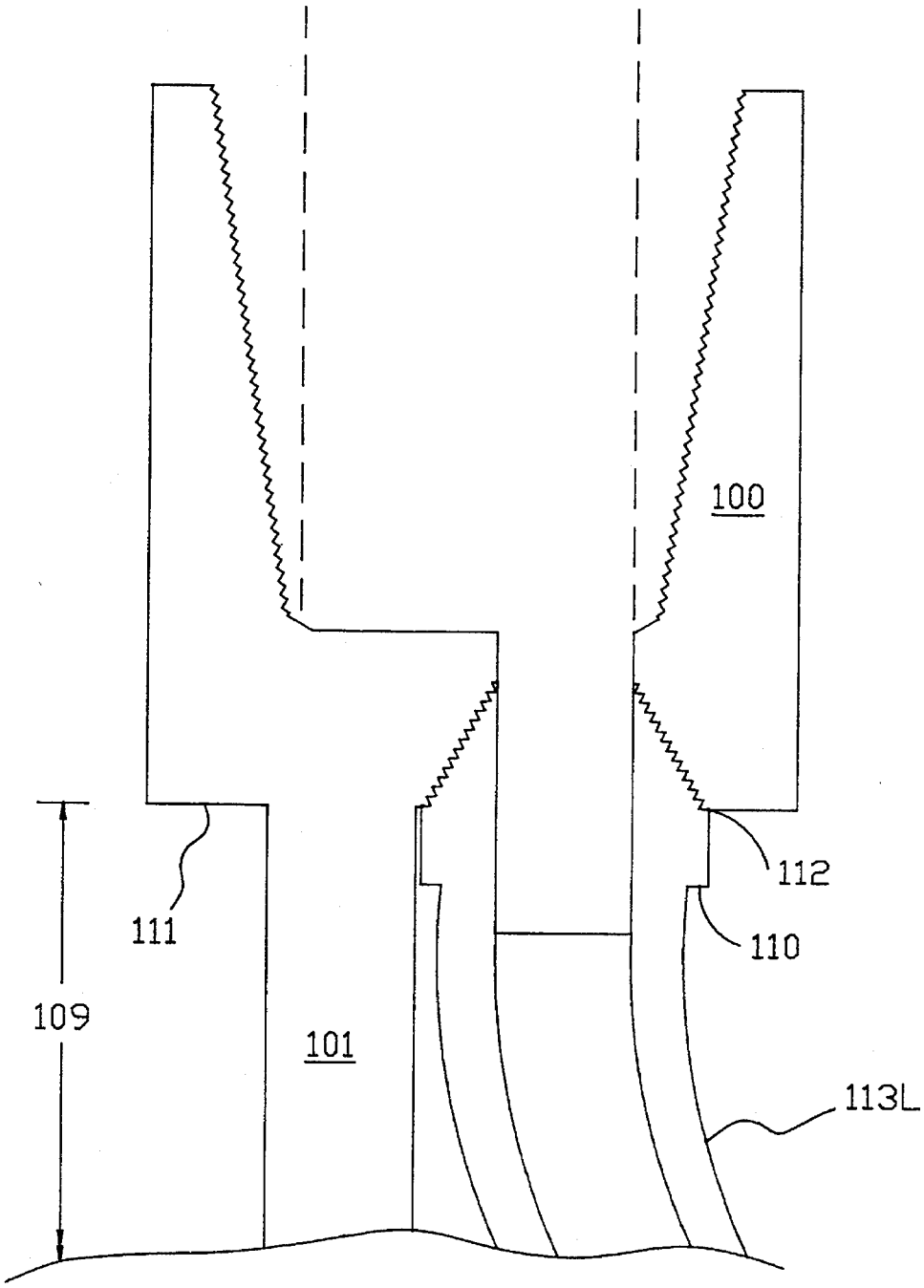
FIGS. 10C and 10D show construction details for an alternate embodiment of the setting tool using a setting bar welded to a top sub with space for attachment of a hydraulic hose.
Figure 10D:
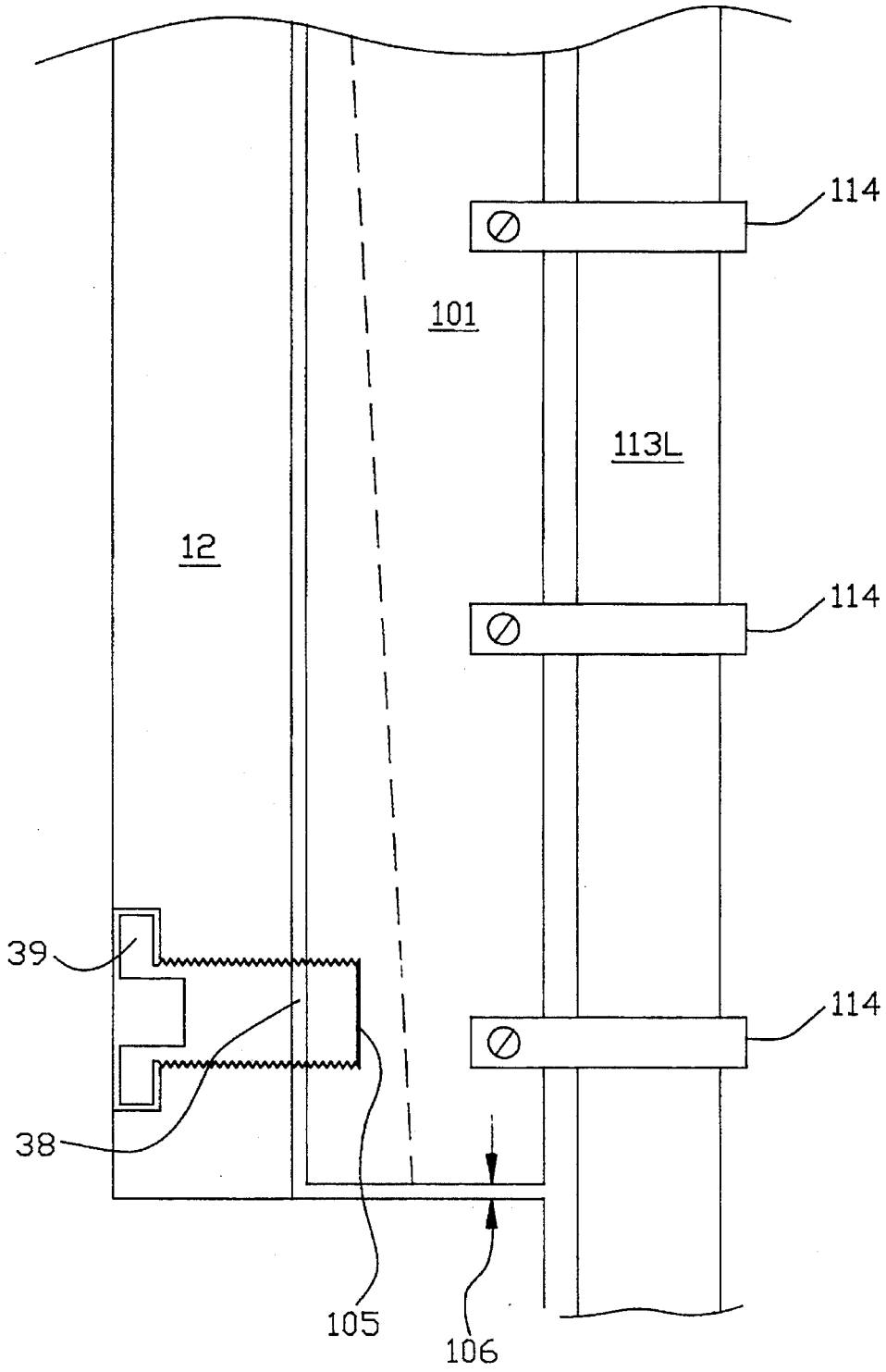

An alternate embodiment of the setting tool is shown in FIGS. 10C and 10D. In this embodiment, the steel fluid line or tubular, 102, has been replaced with a high pressure hydraulic hose, 113L, which runs directly from the threaded tubular recess, 112, on the top sub, 100, to the street-ell fitting, 20, on the Whip-Anchor tool face. This hose would be held in place by stainless steel clamps, 114, and screws (not shown) screwed into the setting bar as needed. In fact, as previously mentioned, the same hydraulic fluid lines can be used in conjunction with a mechanical packer to wash the bottom of the hole with drilling mud in open hole (uncased) conditions, otherwise, when using a mechanical packer, either variant of the hydraulic hose, 113, would be omitted.

A table giving approximate dimensions for the three tools is given below. These dimensions should not be construed as a limitation on the invention, nor should the fact that only three sizes are given be similarly construed, for the reasons given earlier in this discussion of the invention. The table is for illustration only and allows a person skilled in art of whipstocks to choose the proper tool(s) for the proper application.

Figure 12A:
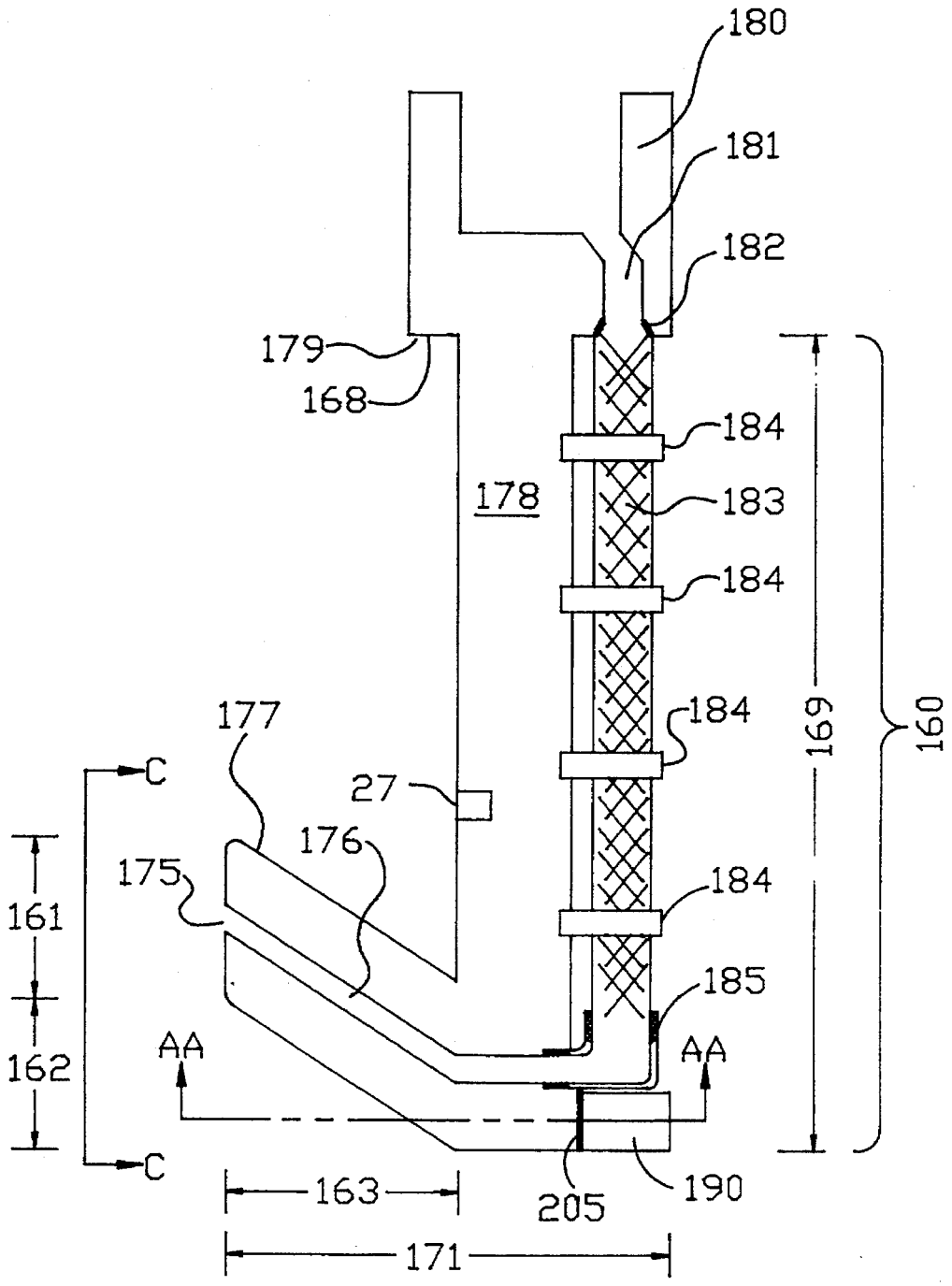
FIG. 12A is a side sectional view of the First Embodiment of the lower section of the retrieval tool.

The preferred embodiment will find greatest use with Type I and Type II Whip-Anchors because the ID of the bore hole limits the size of the Retrieval Tool. Turning then to FIG. 12A, the Retrieval Tool simply consists of a tool joint, 180, a bar, 178, and a specially shaped hook, 177. Although the hook could be welded to the bar, it is much better to manufacture the hook and bar as a unit because of the tremendous forces or weight that the Retrieval Tool will have to endure in releasing the anchor packer (not shown). The tool joint, 180, can have a threaded fitting or a weld fitting for attachment to other Bottom Hole Assembly (BHA) tools, such as the piston sleeve valve assembly or sub, 140, shown in FIG. 12C and which will be discussed shortly. The tool joint is attached to the Retrieval Tool bar, 178, and to the hook, 177, either during manufacture of the Retrieval Tool as a complete unit or by welding the bar to the tool joint. The preference is for a complete integral unit due to, again, the tremendous forces that will present. There is a recess, 179, whose depth, 168, is set by the type of Whip-Anchor being used. The recess permits the Retrieval Tool to centralize itself in the setting slot, 13, of the Whip-Anchor, thus, the depth, 168, will vary with tool type. The retrieval tool latching mechanism, 28, is located on the face of the bar (at location 27) that will engage the retrieval slot. This mechanism and its embodiments will be discussed later.

The hook, 177, has a wash port, 175, located in its face. The wash port, 175, connects directly to a wash passageway, 176, which is cut through the center of the hook, through the bar, and terminates in a threaded outlet at the back (opposite the tool face) of the bar. A hydraulic street-ell, 185, is fitted in this back opening of the wash passage and a hydraulic hose, 183, runs from the street-ell to a threaded port, 182, in the tool joint. The threaded port, 182, connects to the inside of the tool joint via a fluid passageway, 181. The hydraulic hose, 183, is strapped to the back of the bar, 178, by stainless steel clamps, 184, which are in turn, attached to the bar, 178, by stainless steel screws (not shown). An additional piece of metal, 190, is welded to the back of the bar, by weld, 205, to protect the street-ell, 185. It would be possible to form the protector plate, 190, as a part of the complete Retrieval Tool, while manufacturing the bar/hook/tool joint.

TABLE 6

ADDITIONAL SETTING TOOL PARAMETERS

| Whipstock Type or Size | Bar Tool Length, Width, Depth | Fluid Line Size - Rating | Top Sub OD & Connection | Shear Stud Size |
|---|---|---|---|---|
| I - 3½" OD | 40" × 1" × 1" | ⅝" - 4000 PSI | 3⅜" w/2⅜" IFB | ½" |
| II - 5½" OD | 40" × 1½" × 1¼" | ¾" - 4000 PSI | 4¾" w/3½" IFB | ⅝" |
| III - 8" OD | 40" × 2" × 1½" | 1" - 4000 PSI | 6½" w/4½" IFB | ¾" |

Figure 12B:
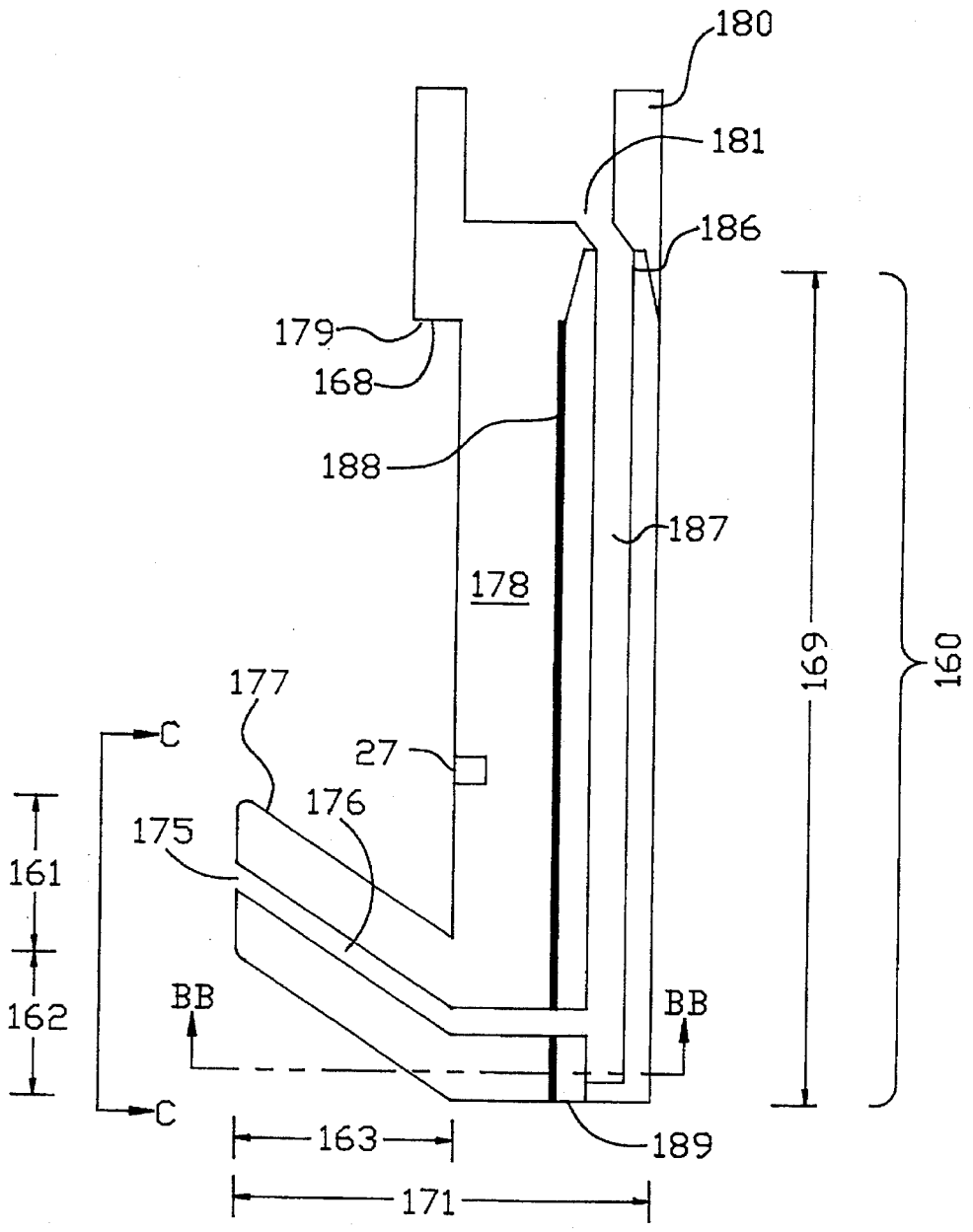
FIG. 12B is a side sectional view of the Second Embodiment of the lower section of the retrieval tool.

The retrieval tool for the Whip-Anchor is designed to engage a retrieval slot located in the upper portion of the whipstock within the setting slot. FIGS. 11A–B and 12A–D show the particulars needed to understand the device. The preferred embodiment for the retrieval tool is shown in FIG. 12A, with a cross-section in FIG. 12AA. The preferred embodiment uses a hydraulic hose to pass fluid to the wash port, located in the face of the hook in the retrieval tool. The alternate embodiment is shown in FIG. 12B, with a cross-section shown in FIG. 12BB. The alternate uses a welded tubular in place of the hydraulic hose, which will increase the strength of the tool and will be the most useful for Type III Whip-Anchors. Any retrieval tool must not exceed the diameter of the Whip-Anchor body (bore), and the tool must be able to withstand three times the force required to release the anchor-packer at the base of the Whip-Anchor.

The wash port, 175, is designed to swab the well bore and the setting/retrieval slots, 12 and 13, as the retrieval tool is making its trip into the well bore. It is realized that during regular drilling operations, involving a deviated hole, cuttings (formation chips) will settle in all crevices within the Whip-Anchor. Thus, the setting slot, 13, which acts as a guide for the Retrieval Tool hook, as well as the actual retrieval slot, could become filled with cuttings. High pressure mud flow will wash those cuttings free of these critical slots.

Figure 14B:
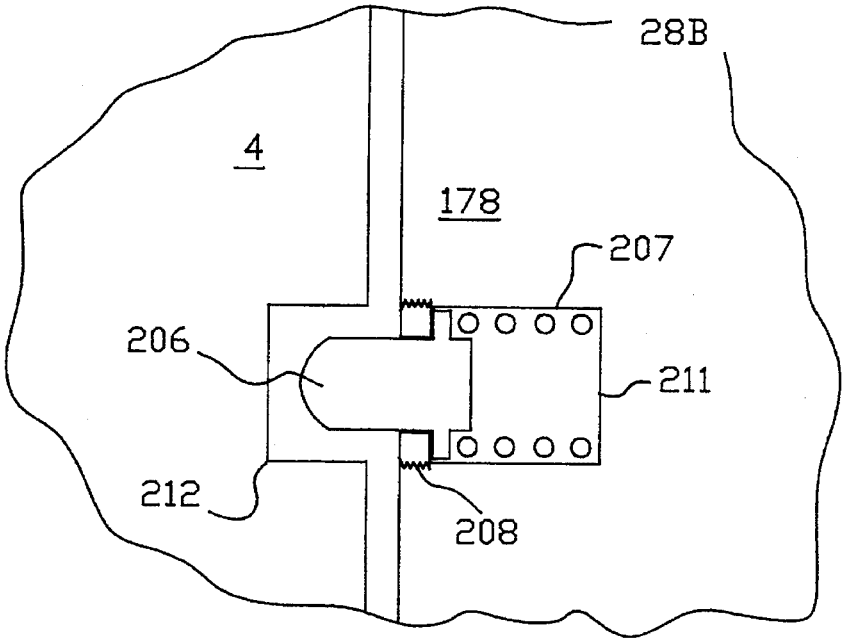
FIG. 14B shows an alternate embodiment of the retrieval tool latching mechanism with the retrieval latch pin in the body of the retrieval tool and the receiving slot in the body of the whipstock (the reverse of FIG. 12A).

The Retrieval Tool hook is carefully shaped to accomplish several ends. Viewed from the bottom, as in FIG. 12AA, the front of the hook is slightly narrower, 165, than the body of the hook, which has the same width, 166, as the Retrieval Tool bar, 178. Furthermore, when viewed end on as in FIG. 12D, it can be seen that the width of the top of the hook, 164, is slightly narrower than the width of the front of the bottom of the hook, 165, which widens to the width of the bar, 166. The Retrieval Tool hook is set at an angle of 35 degrees to the Retrieval Tool bar and all leading edges are rounded for ease of engagement into the retrieval slot, 12. All dimensions of the Retrieval Tool hook, bar, setting slot and retrieval slot are set by strength of material considerations and a representative set is given in table 7 below. There must be sufficient strength for the hook to on pull the Whip-Anchor and break the lower anchor packer loose, plus be able to pull the Whip-Anchor assembly from the hole without material failure. Thus, these dimensions change with the size of the Whip-Anchor. The tables of dimensions give best mode dimensions for accomplishing this purpose; however, with the use of different steels, the dimensions could change and are readily calculated by metallurgical engineers. A suggested set of parameters is given in the table below; these parameters are suggestions only and can easily vary with the material of construction.

disengagement is controlled. The operator can reciprocate the Whip-Anchor; he can reset his fishing jars and he can rotate it without fear of inadvertent disengagement of the Retrieval Tool hook; but, when the tool is completely stuck, the operator can disengage by slacking off hard on the tool, shearing the latch pin, and falling out of the retrieval slot. The operator would rotate the Retrieval Tool by at a quarter turn and trip out of hole. The alternate embodiment of the retrieval latch mechanism, shown in FIG. 14B, is the reverse of the first; however, this is not best mode because the opening for the mechanism, 211, would weaken the Retrieval Tool bar.

An alternate embodiment of the basic Retrieval Tool is shown in FIG. 12B. This embodiment, as previously explained, will work best with the larger Whip-Anchor Types due to the ID of smaller well bores. The Retrieval Tool consists of the same tool joint, 180, Retrieval Tool bar, 178, and hook, 177, as with the preferred embodiment and all the features are similar. The difference is in the use of a tubular,

TABLE 7

RETRIEVAL TOOL DIMENSIONS

| Whip-Anchor Size | Tool Length | Tool Width | Hook Depth | Hook Width | Hook Length | Wash Port ID | Material Strength | Top Connection | Latch OD | Hook Angle |
|---|---|---|---|---|---|---|---|---|---|---|
| I | 54" | 3½" | 1 | 1" × ½" | 4" | ¼" | 100K | 2⅜" IFB | ¼" | 35° |
| II | 56" | 5½" | 1½" | 1½" × 1 | 5" | ⅜" | 120K | 3½" IFB | ⅜" | 35° |
| III | 58" | 7½" | 2" | 2" × 1½" | 6" | ½" | 160K | 4½" IFB | ½" | 35° |

Figure 11A:
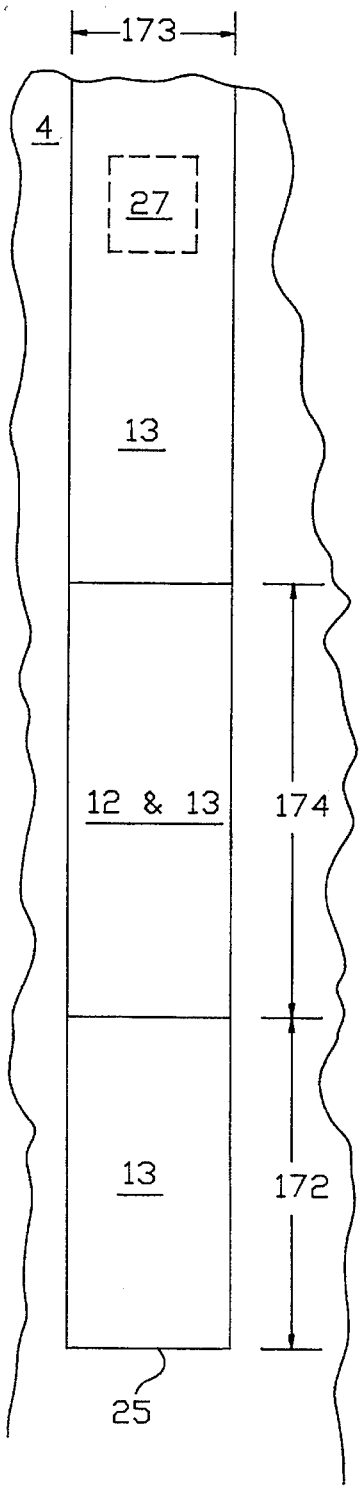
FIG. 11A is a front view of the lower portion of the setting slot giving the location of the retrieval slot.
Figure 11B:
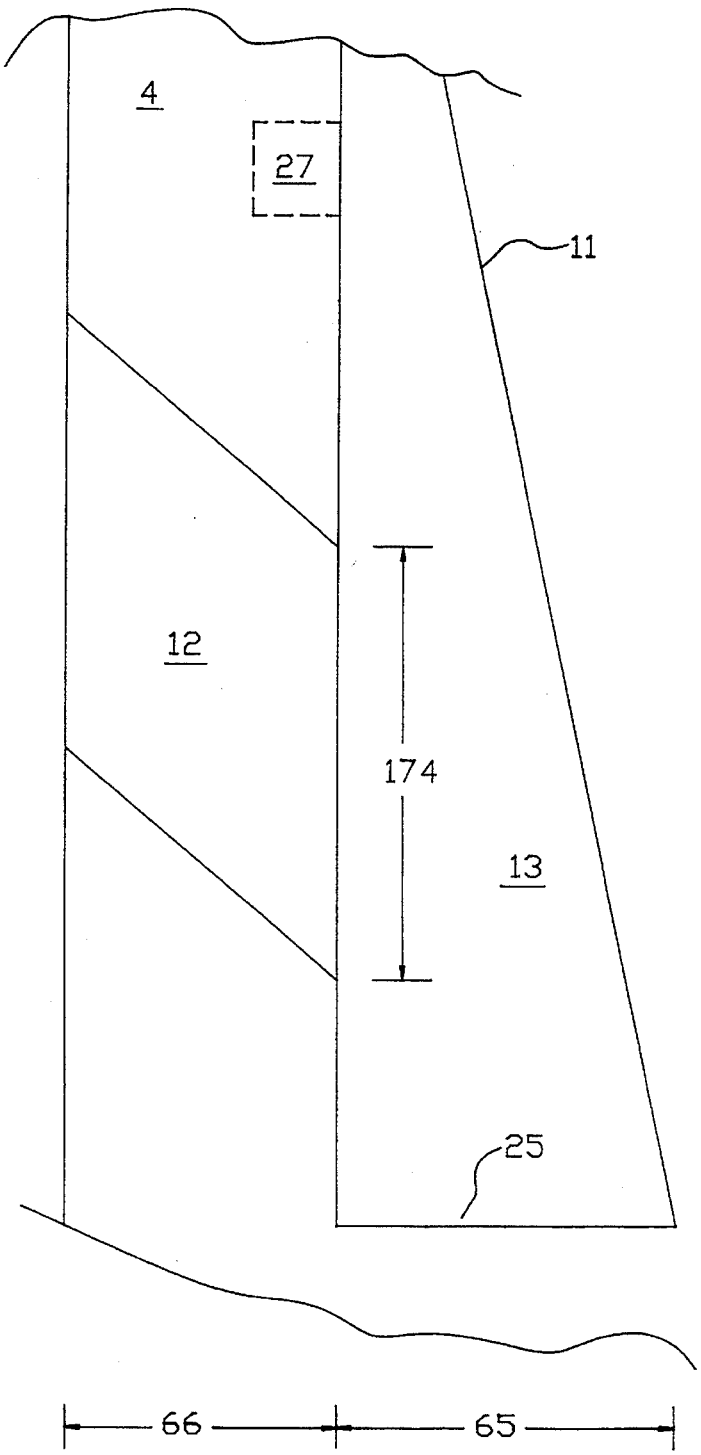
FIG. 11B is a side sectional view of the lower portion of the setting slot shown in FIG. 11A.
Figure 11C:
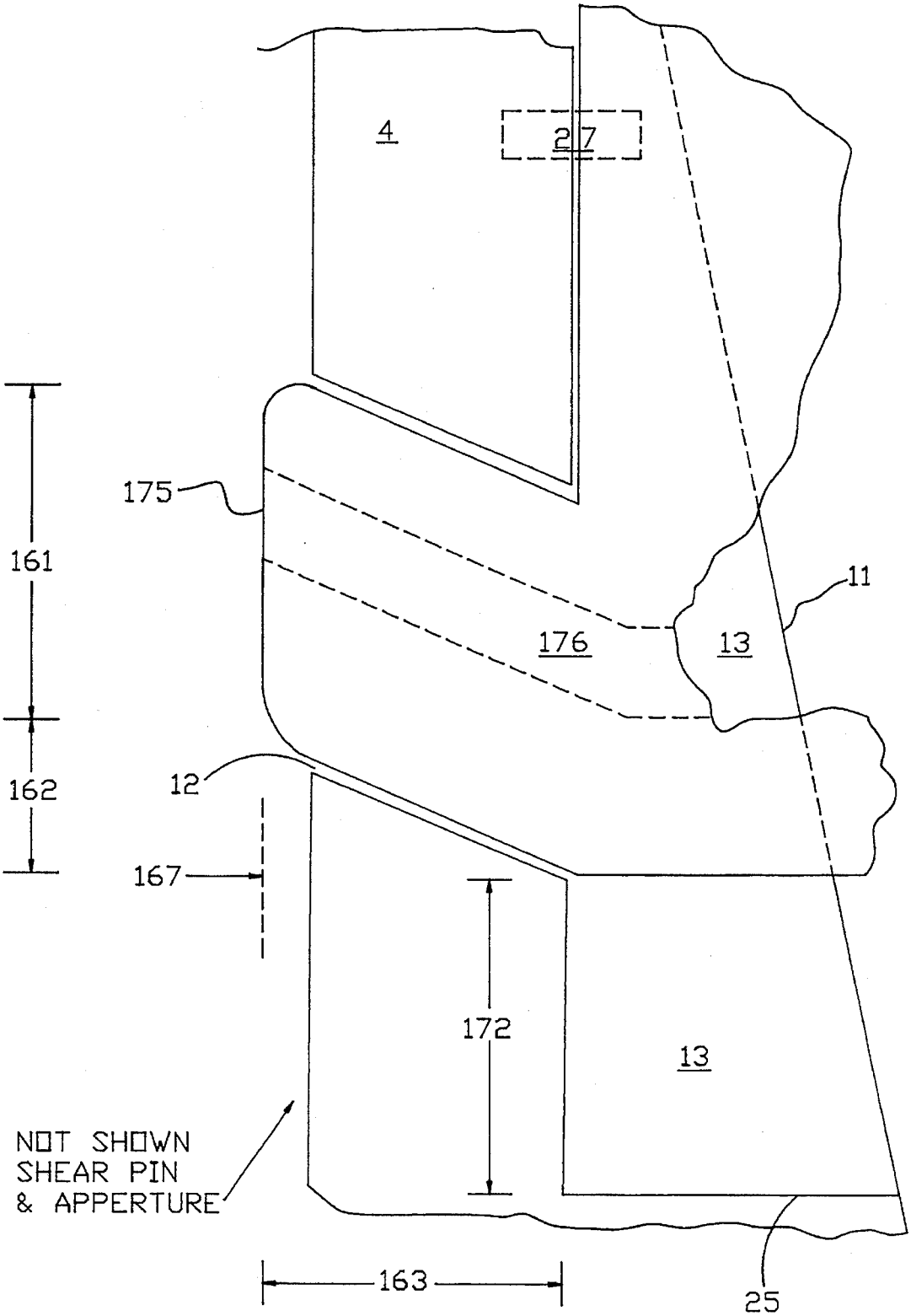
FIG. 11C is a side sectional view of the setting and retrieval slot shown with the retrieval tool latched in place.

FIG. 11C shows the Retrieval Tool hook fully engaged within the retrieval slot, 12. The distance, 172, between the base of the setting slot, 25, and the bottom opening of the retrieval tool is set by strength of material considerations. This length also contains the shear pin aperture, 62, which is NOT shown in the figure. The 35 degree angle for both the retrieval slot and the Retrieval Tool hook is designed to allow the hook to slide backwards and away from the retrieval slot whenever the operator "slacks off" on the weight. This means that the hook can be disengaged if the Whip-Anchor becomes stuck in the bore.

It is important that the hook remains engaged until the operator truly wishes disengagement. For example, if there is a set of fishing jars in the BHA, and the operator wishes to use them, they must be reset each time after use. Fishing jars are reset by slacking off and allow the drill string weight "cock" the jars. Thus, disengagement of the hook must be controlled so that fishing jars can be reset. This can readily be accomplished by the Retrieval Tool latching mechanism, 28, whose approximate location is shown at 27. The latching mechanism consists of a spring loaded shear pin and corresponding opening for the pin to pop into whenever the retrieval tool is fully engaged in the retrieval slot. There are two embodiments for the device.

Figure 14A:
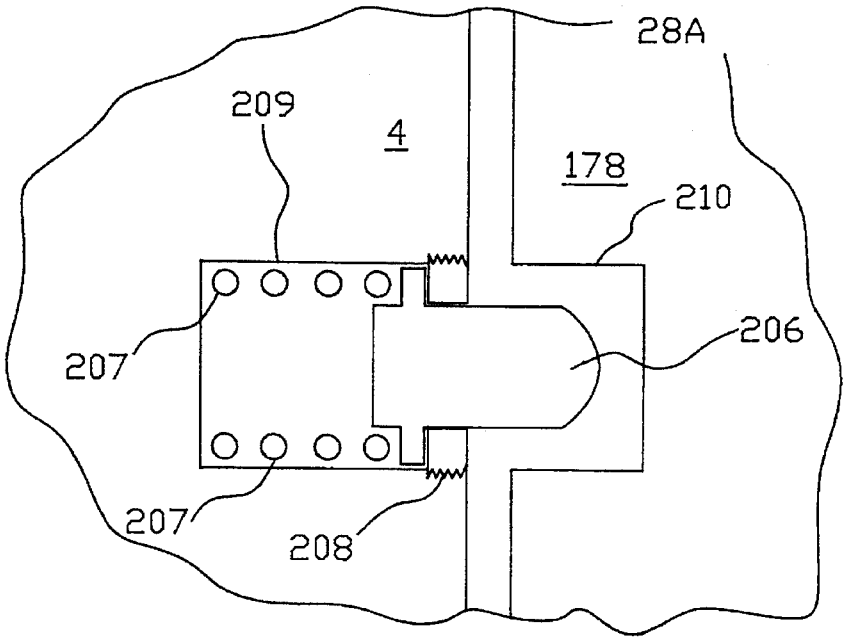
FIG. 14A shows the preferred embodiment of the retrieval tool latching mechanism with the retrieval latch pin in the body of the whipstock and the receiving slot in the body of the retrieval tool.

The preferred embodiment for the Retrieval Tool latching mechanism is shown in FIG. 14A, in which the latch pin, 206, and spring, 207, are retained by a keeper, 208, in an aperture, 209, within the setting slot face of the Whip-Anchor. This position is preferred as best mode because of strength of material considerations. The latch pin, 206, strikes within a corresponding opening, 210, in the Retrieval Tool face. The opening, 210, is larger than the diameter of the pin to ensure engagement. The diameter of the pin (and the corresponding opening) is set by the reset weight requirement of the fishing jars. This latching pin will shear if sufficient weight is applied to the pin; however, the pin is designed to bear the weight of reset for the fishing jars; thus,

187, which is welded to the bar, 178, to conduct fluid to the hook wash port, 175 rather then a hydraulic hose. The tool joint has a fluid passage, 181, which terminates in a weld fitting, 186, in which the tubular, 187, is welded. (It would be possible to use a threaded fitting and back weld the threads if desired.) The tubular is then welded to the back of the Retrieval Tool bar, 178, along the joint, 188, between the two parts. The hook fluid passage, 176, from the wash port is extended into the tubular and the tubular is scaled by a cap or plug, 189. All other details are the same as with the preferred embodiment—hook dimensions, bar dimensions, etc., which are set by strength requirements.

FIGS. 15A through 15D show the Retrieval Tool hook approaching the Whip-Anchor, rotation or alignment with the setting slot and engagement. As explained later in this discussion, the Retrieval Tool with the proper BHA running tools would be tripped into the hole and the Retrieval Tool face alignment would be checked when the tool is near the Whip-Anchor, the drill string rotated (as in FIG. 15B) to align the tool with the setting slot, and further lowered. The setting slot would provide guidance to the Retrieval Tool hook face. The hook would bottom out on the bottom of the setting slot bottom or base, 25. This condition can be observed by a decrease in travelling block load or drill string weight. The string would be pulled upward and the Retrieval Tool hook should engage the retrieval slot. Engagement should be noted by an increase in drill string weight. However, often when pulling a drill sting upward over short distances, the string will jam in the well bore and frictional effects would give higher weight indications; thus, it is possible that a false indication of hook engagement could be observed at the surface. There is a secondary method to indicate proper hook engagement which sends a mud pressure pulse to the surface.

The inventor proposes several different embodiments for sending a mud pressure pulse to the surface. The preferred apparatus for determining hook latch in the retrieval slot may be found in a "piston sleeve valve" which is designed to shut off mud flow when a 'hook load' is applied to the piston sleeve valve. Simply stated a sub containing the piston sleeve valve is attached to the tool joint, 180, and is placed in the BHA immediately above the Retrieval Tool such that whenever weight is 'picked up' by the Retrieval Tool hook, the piston sleeve valve closes and sends a pressure pulse to the surface.

Figure 12C:
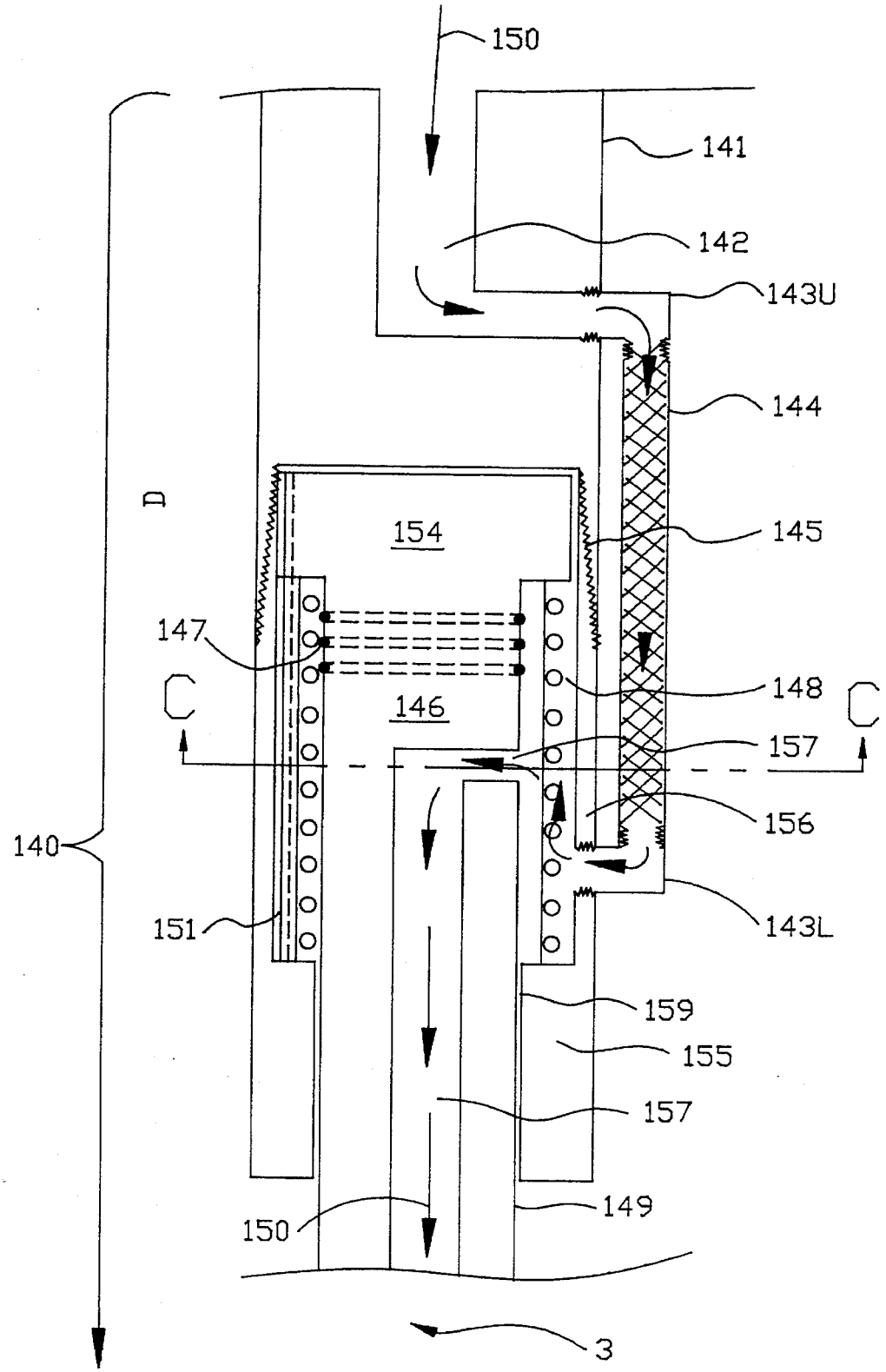
FIG. 12C is a cross sectional view of the Piston Sleeve Valve to be used with the Retrieval Tool of FIG. 12A or FIG. 12B and illustrates the preferred positive retrieval tool engagement indicator.
Figure 12C:
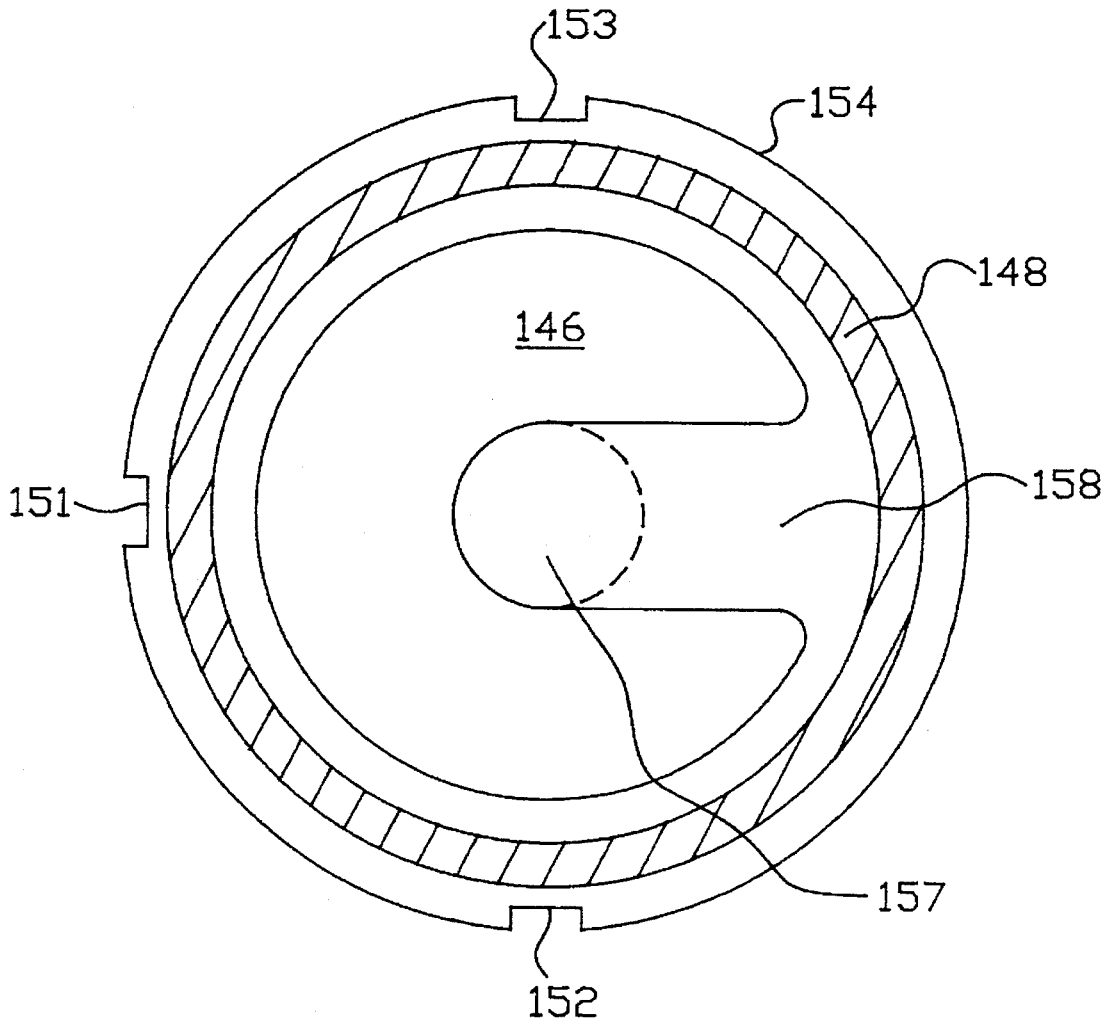
Figure 12B:
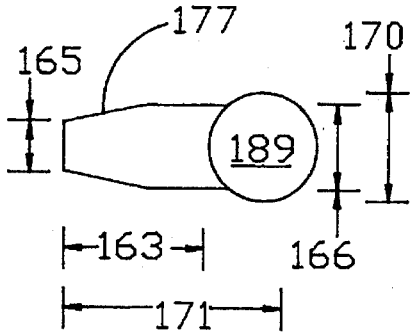
Figure 12A:
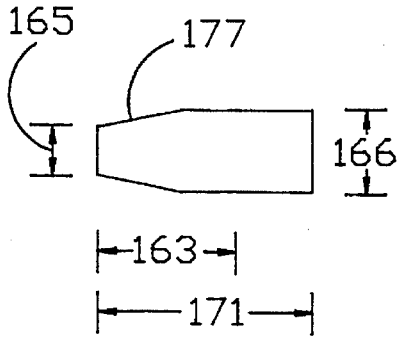
Figure 12D:
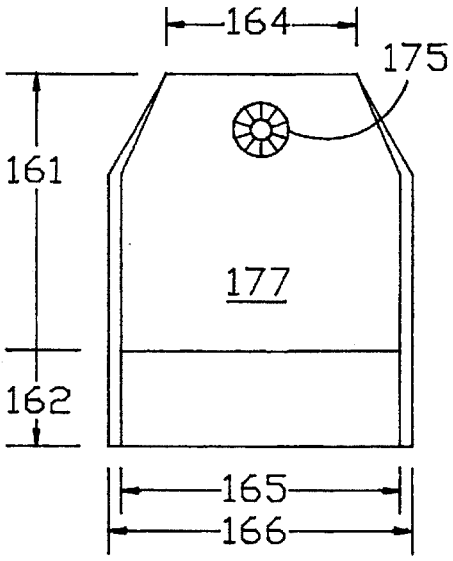
FIG. 12D is a frontal view of the hook face of the retrieval tool taken at C/C in FIG. 12A or FIG. 12B.

FIG. 12C illustrates a piston sleeve valve, 140, but does not show the Retrieval Tool subassembly which would contain the only retrieval tool bar and hook as shown in FIG. 12A or FIG. 12B. The piston sleeve valve starts with a tool joint, 141, in which an upper fluid passageway, 142, has been machined to intersect a cross-passageway, 139. The cross-passageway terminates on the side of the tool join in a threaded opening in which a hydraulic street-ell, 143U, is placed. A hydraulic line (or hose), 144, extends from the upper street-ell to a lower street-ell, 143L. The lower street-ell conducts fluid into the piston chamber, 156, which is machined in the lower section, 160. The lower section of the piston sleeve valve is screwed to the tool joint by buttress threads. 145. The fact that the piston sleeve valve can be opened allows service of the internal parts.

The piston valve, 146, resides within the lower section, 160, and its associated piston chamber, 156. The piston valve, 146, has a piston valve head, 154, which is larger then the piston valve and is capable of supporting the hook load transferred by the Retrieval Tool hook whenever the Whip-Anchor is latched and pulled. A spring, 148, is generally placed between the piston head and the bottom of the piston chamber which helps to support the piston valve up against the tool joint, 141. The piston valve, 146, has a set of piston rings, 147, which will seal the piston valve at area, 159, immediately below the piston chamber, 156. There is a central fluid passageway, 157, in communication with a cross fluid passage, 158, within the piston valve. Fluid flow may occur between the lower street-ell and the piston passageways via the upper piston chamber and around the piston spring, 148.

Normal fluid flow, 150, would enter the top of the tool at the tool joint passage, 142, and follows the path shown by the heavy arrows through the hydraulic hose and the associated street-ells, into the piston chamber, through the piston passageways and out of the bottom of the tool. The force of the fluid acts against the piston head and holds the head (along with some help from the optional spring) tip against the tool joint. When a hook load is transferred to the tool, the piston extension, 149, will transfer the load to the piston, 146, and onto the piston head, 154; thus, compressing the piston spring, if installed, and overcoming the force exerted by the fluid. This will draw the piston across passage below the entry point of fluid at the lower street-ell, 143L, thus, shutting off fluid flow to the lower portion of the piston and onto the Retrieval Tool. The closure of the access port will, of course, send a pressure pulse to the surface which is an indication of Retrieval Tool hook engagement on the Whip-Anchor.

It is possible to increase the circulation pressure at the surface and attempt to force the piston head back up into the tool joint. Thus, complete latching of the Whip-Anchor System, wellbore deviation assembly, or other device can be tested for by increasing mud pressure and seeing if the flow increases. If an increase in pressure does not significantly increase the mud flow, then hook engagement has occurred.

Figure 13A:
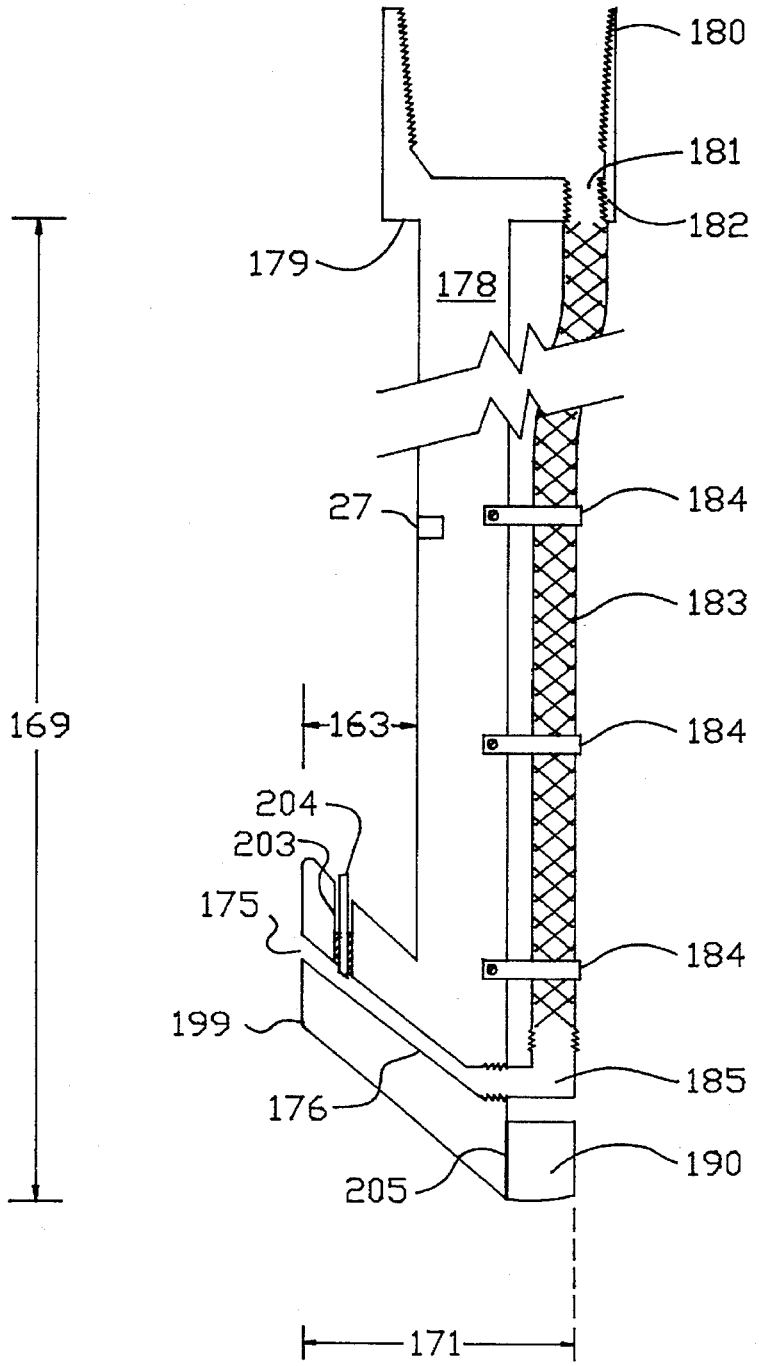
FIG. 13A illustrates a first alternate to a positive retrieval tool engagement indicator which is shown on a tool using the First Embodiment of the lower section of the retrieval tool.
Figure 13B:
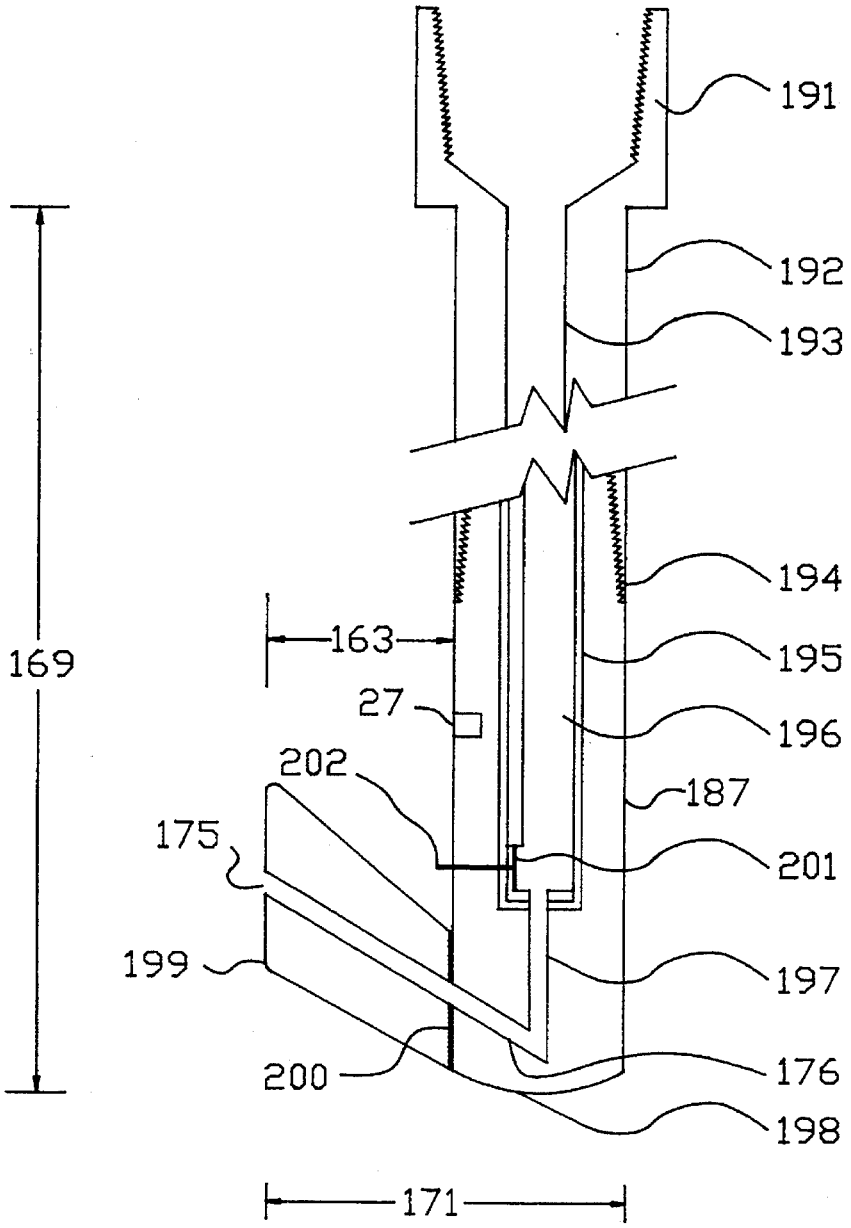
FIG. 13B illustrates a second alternate to a positive retrieval tool engagement indicator which is shown on a tool using the Second Embodiment of the lower section of the retrieval tool.

There are two alternate devices which are capable of producing a pressure pulse at the surface and these are shown in FIGS. 13A and 13B. FIG. 13A shows the preferred embodiment for a Retrieval Tool incorporating a hydraulic pressure hose, 183, to bring fluid to the wash port, 175. This technique will work equally well with the alternative method of applying fluid to the wash port which uses the welded tubular (not shown in FIG. 12B). The mud pressure pulse is produced by stopping the wash port fluid at the wash port, 175, through the use of a valve, 203, located in the hook, 177. The hook valve, 203, is operated by a loaded stem actuator, 204, which protrudes from the top of the hook. When the hook properly engages, the retrieval slot at the top of the slot will squeeze on the actuator, 204, thus, closing the hook valve and sending a mud pressure pulse to the surface. An alternate embodiment is shown in FIG. 13B which uses an internal flapper valve, 201, actuated by a control rod, 202.

The second alternate embodiment uses a full body tubular Retrieval Tool with a hook. The Retrieval Tool is made in several parts. A standard tool joint, 191, is welded to tubular section, 192, which terminates in a threaded connection, 194. A second tubular section, 187, is welded to a Retrieval Tool hook, 177, has a rounded bottom end, 198, and matches the first tubular, 192, at the threaded connection, 194. The second tubular section, or Retrieval Tool tubular, 187, contains a flapper valve sleeve, 195, which restrains and holds the flapper valve, 201. The sleeve provides a slightly offset passage for the fluid, 196, and stops the fluid from getting behind the flapper valve and closing it inadvertently. The sleeve passage, 196, continues through a smaller passage, 197, and joins the wash port passage, 176, which terminates in the wash port, 175. All other details, hook dimensions, lengths, etc. are similar to the preferred embodiment. When the Retrieval Tool hook engages the retrieval slot, the hook is naturally pulled towards the setting slot, which presses against the flapper valve actuator, 202, thus, closing the flapper valve, 201, producing a pressure pulse at the surface.

Figure 32:
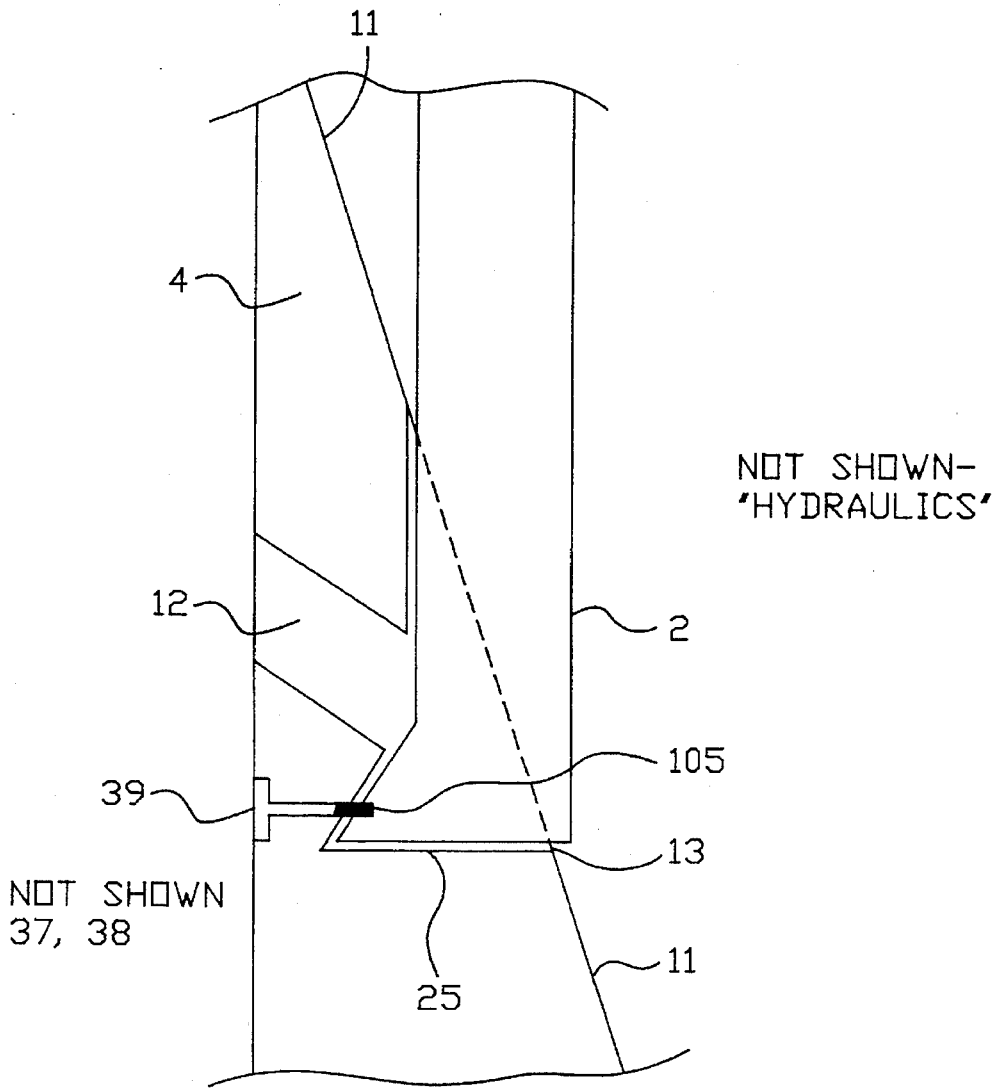
FIG. 32 illustrates an alternate embodiment for the setting tool and setting slot which considers problems raised if the strength of material becomes a factor.

A final alternate embodiment for the setting tool is illustrated in FIG. 32. In this embodiment, the base of the setting tool is extended into the body of the Whip-Anchor. This enlarged base would permit greater downward force to be exerted on the Whip-Anchor. This alternate would compromise the integrity of the Whip-Anchor if it is to be retrieved, for it would be weakened.

The use of the Whip-Anchor does not differ greatly from the prior art; however, this tool simplifies the procedure, actually reduces a step, provides methods whereby only one type of tool need be kept in warehouse stock, provides a whipstock that can be set in tortuous well bore conditions, provides a retrievable whipstock, and provides a tool which permits bottom hole washing in open hole conditions with a mechanical packer, just to name a few of the myriad differences in the apparatus and method of using the present invention. In keeping with the spirit of the previous discussion, the simplest operation will be described initially and the differences between the use of the mechanical anchor packer and the hydraulic packer will be discussed. The various embodiments and how they affect the operator will also be considered.

Reference will be made to FIGS. 15 through 29. Normal drill floor procedures for assembling the Whip-Anchor and choosing the proper combination of downhole running tools is almost the same as with the prior art and it makes little difference, as far as this general discussion is concerned, the Type (size) of Whip-Anchor for a given size bore or whether the well bore is open or cased. Those skilled in the art of setting whipstocks will be able to supply minor missing details and see the minor differences that would occur between cased and unncased holes. The real differences between the instant invention and the prior art will be discussed.

Assume that the operator has made the decision to deviate a well bore, that the operator has properly surveyed the well bore, that the collar locator run has been made, that the operator knows the hole conditions and, that the operator has made the proper trip with a locked up bottom hole assembly, thus, preparing the hole for setting a whipstock. Assume further, that the hole is cased and that the operator has decided to use a mechanical packer, which is the simplest method to describe. This discussion will also assume that the operator will take advantage of the instant invention in that it allows the use of MWD (Measurement While Drilling) and that the operator has chosen to use an MWD tool to orientate the face of the Whip-Anchor.

The Whip-Anchor would normally be brought to the drill floor in an assembled condition. That is, the Whip-Anchor service representative would assemble the tool. Proper choice would be made for the deflector head which would be mounted per the previous discussion. Proper choice would be made for the anchor packer size and that would be mounted to the base of the whipstock using the proper cross-over sub. If the optional spacer is required, then that would be mounted. In other words the tool would look some what like FIG. 1, or FIG. 2, and/or FIG. 3. The assembled Whip-Anchor would be set at the rig staging area while all preliminary procedures (standard) would be undertaken.

Figures 20, 21, 22:
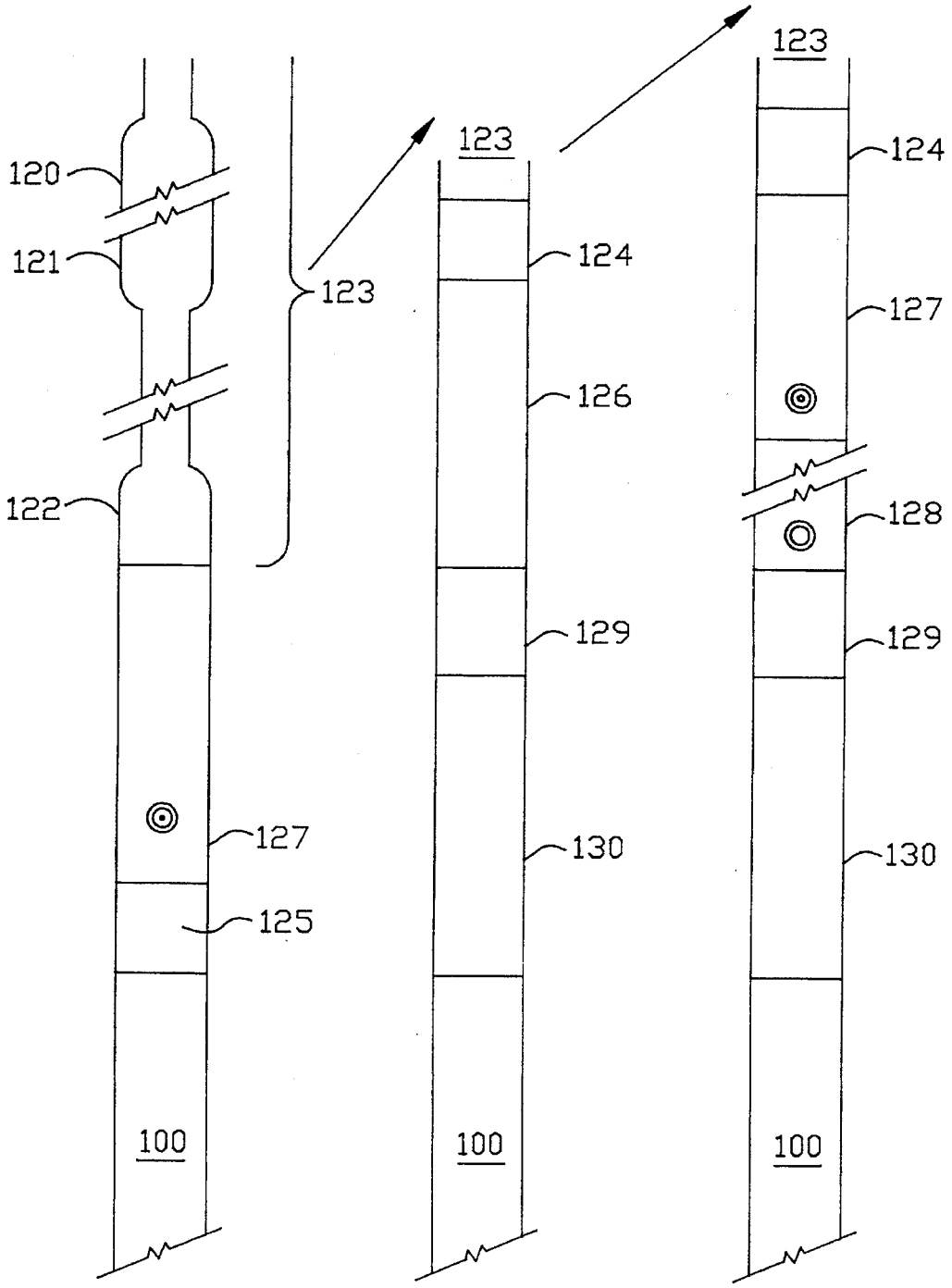
FIG. 20 shows details for the making up of the running arrangement for the WHIP-ANCHOR with a mechanical packer which includes the setting tool, MWD, etc.
FIG. 21 shows details for the making up of the running arrangement for the WHIP-ANCHOR with a hydraulic packer which includes the setting tool, the standard wireline orientation sub, etc.
FIG. 22 shows details for the making up of an alternative running arrangement for the WHIP-ANCHOR with a hydraulic packer which includes the setting tool, MWD, a pinned by-pass sub, etc.

The running assembly, that is the tools which will be attached between the setting tool and the drill string, should be assembled before placing the Whip-Anchor on the rig floor. Normally a single section (or joint) of Heavey Weight Drill Pipe, 122, is picked up with the drill pipe elevators and used as a "handling sub" because of the ease in attaching the tools below it. Any cross-over sub, orientating sub, by-pass valve, piston sub and setting tool, that are required, would be attached to the single joint of heavy weight drill pipe and made up to their proper torque with the rig tongs at this time. FIG. 20 shows an assembly for the assumed conditions given above. These tools are the setting tool, 100, a cross-over sub, 131, if necessary, and MWD tool, 127, or an optional orientation sub (not shown), a single joint of heavy weight drill pipe, 122, and required collars, 121, for attachment onto the drill string, 120. These assembled tools would be stored in the elevators out of the rotary table working area (above or to one side) because the travelling block with drill pipe elevators is not needed in handling the Whip-Anchor assembly.

The Whip-Anchor assembly would be picked up with an "air hoist" or the "cat line" and landed in the rotary table. It is then secured with appropriate slips and clamps. The aforesaid assembled tools would be brought into position, via traveling block and elevators, and the setting tool, 100, would be attached to the Whip-Anchor, using the shear stud, 39. The shear pin keeper ring, 37, should be placed in its proper position on the Whip-Anchor to make certain that the sheared head does not interfere with the operation of the Whip-Anchor. After orientation of the Whip-Anchor tool face to a "mark" on the tool joint of the heavy weight drill pipe because the MWD tool is to be used for orientation, the "blind rams" on the Blow Out Preventer (BOP) system would be opened, if closed, and the total assembled tools would be landed in the rotary table with the tool joint of the heavy weight drill pipe at "working height". Because an MWD tool is to be used, it would be picked up with the drill pipe elevators and traveling block, and aligned with the "mark" on the tool joint of the heavy weight drill pipe.

It might be noted here, that some operators like to run an orientating sub (not shown) above the MWD in case of MWD failure or simply because they want to check the orientation with two different survey instruments; hence, the choice of a wire line device. Also in the prior art, the joint of heavy weight pipe was required to give the needed "fulcrum effect" for the Starter Mill, which was attached to the whipstock, to make the 20 inch (±) starting cut. In the instant invention, although no longer needed in the Whip-Anchor setting run, the joint of heavy weight drill pipe would still be very helpful in picking up and laying down the tools that are used directly above the Whip-Anchor.

It is important to note that with the simplest embodiment it does not matter which embodiment of setting tool is in use. In the preferred embodiment, the opening, 107, in the tubular, 102, is left open. In the alternate embodiment, the threaded opening, 112, is left open.

Now suppose that the operator wished to use this invention to its full potential and wash the hole bottom through the mechanical packer. Before the Whip-Anchor would be lowered into the hole, a high pressure hydraulic hose must be connected between the setting tool and the hydraulic fitting on the Whip-Anchor tool face, it is assumed that the Whip-Anchor service representative has installed the internal plumbing in the Whip-Anchor; namely the extra street-ells, 20, 21, and 22 plus the 'cut-a-way' hydraulic line. The internal plumbing is identical to the plumbing required for a Hydraulic packer. The difference in setting tool embodiments is not much for in the preferred embodiment, a short hydraulic hose, 113S, should be attached between the tubular opening, 107, (via the required hydraulic fitting, 110) to the tool face street-ell, 20, before the Whip-Anchor is lowered into the hole. In the case of the alternate embodiment, a long hydraulic hose, 113L, is attached to threaded recess, 112, and onto the Whip-Anchor tool face street-ell, 20. (Note there is really no difference between this procedure and the procedure required with a hydraulic packer—the only difference is in the type of fluid passing through the plumbing.)

A suggested bottom hole tool assembly for a hydraulic packer is shown in FIG. 21 where the operator chooses to use only a wire line survey for orientation of his Whip-Anchor face. These tools are, the setting tool, 100, a piston sub, 130, a short sub 129, an orientation sub, 126, any required cross-over, 124, followed by the single joint "handling sub", 22. An alternate assembly is shown in FIG. 22 where the operator chooses to use an MWD tool for Whip-Anchor orientation (if an orientation sub were required it would be placed above the MWD tool). The order of the tools is somewhat critical for the pinned by-pass sub, 128, must be placed below the MWD, 127, and above the short sub, 129. The assembly techniques for these tools is similar to that described above and it is known that the short sub, 129, is initially made tap 'chain tight' until after hydraulic fluid is placed in the piston sub.

Figure 29:
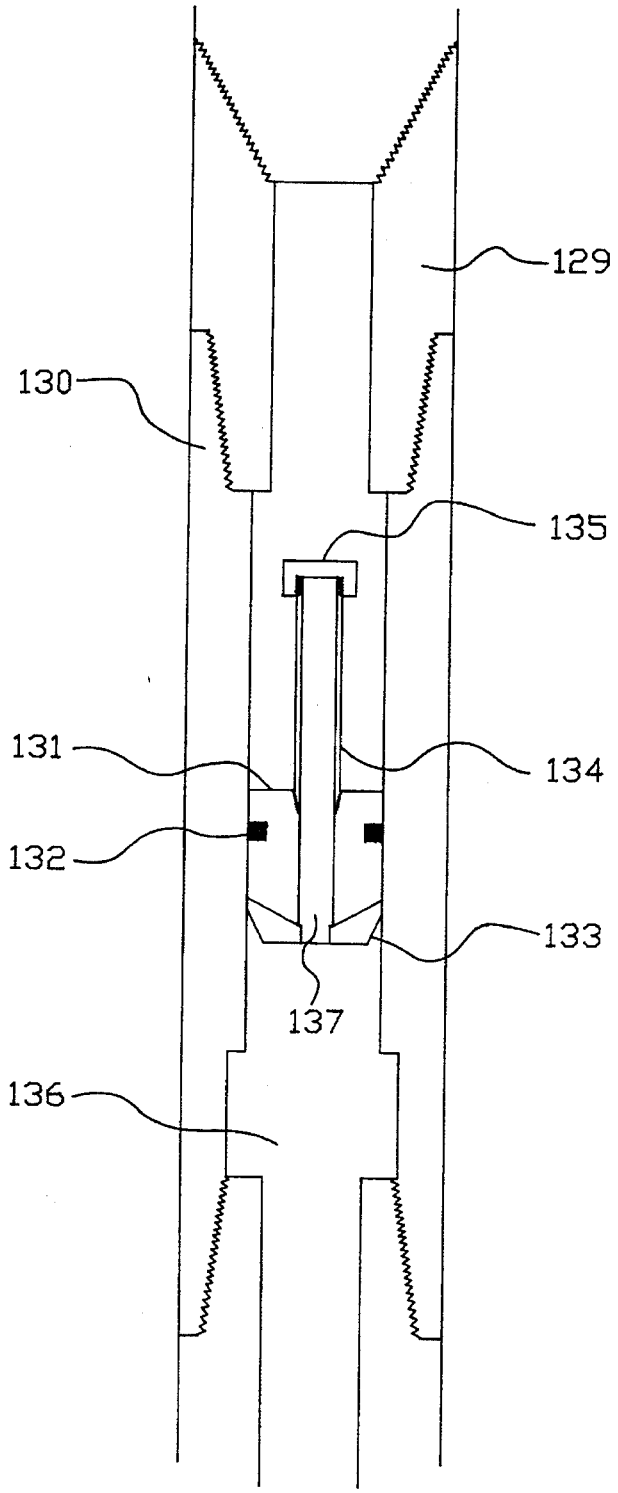
FIG. 29 shows a cross section of a "Sub with Piston" Bottom Hole Assembly (BHA) running tool which is used in the preferred method for setting a WHIP-ANCHOR with a hydraulic packer.

An illustration of a piston sub, 130, which would fit a Type II Whip-Anchor, is shown in FIG. 29. This concept is in relatively common use, but it will be described here because this particular tool serves two functions and will greatly enhance the Whip-Anchor setting process; hence, the use of this tool forms a part of the preferred method of setting the tool. These two functions are:

1) the sub provides isolation between the drill mud fluid and the required clean hydraulic fluid needed to set a hydraulic packer, and
2) the sub provides a simple way for mud to drain from the drill string as it is withdrawn from the bore hole after setting the Whip-Anchor; thus, avoiding the spray of mud on the rig floor when each stand is broken.

The Whip-Anchor will most likely be used in old bore holes and, usually, an oil based drilling mud, which is considered toxic by the regulating authorities, is used. Thus, when pulling out of the hole, it is imperative that the amount of fluid spray coming from a "breaking" tool joint be reduced. This piston sub will accomplish that purpose and is much better than most similar tools currently supplied by major suppliers of whipstocks.

Figure 30A:
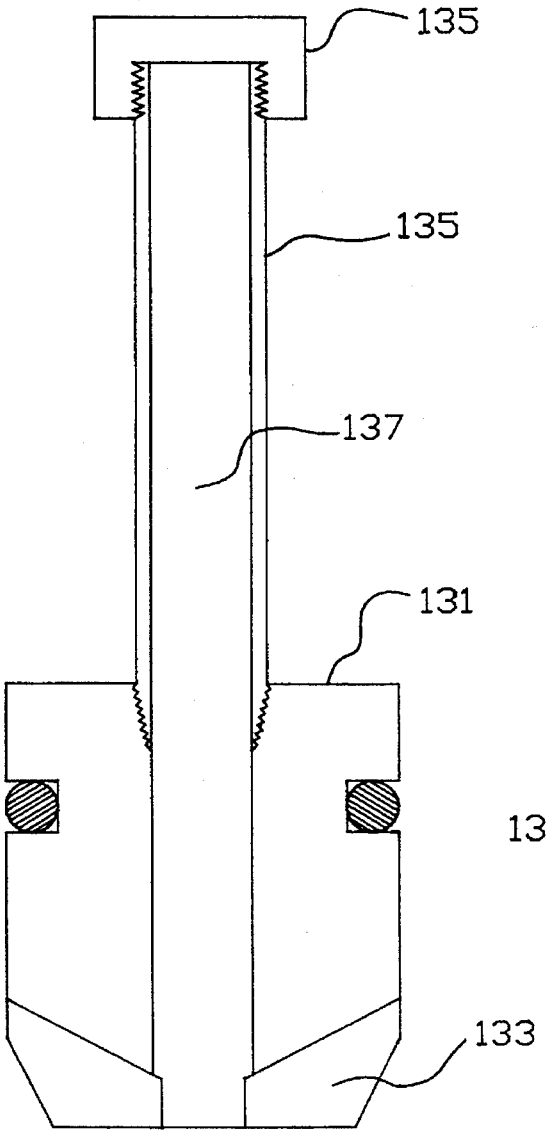
FIG. 30A is an enlarged view of the Piston of FIG. 29.
Figure 30B:
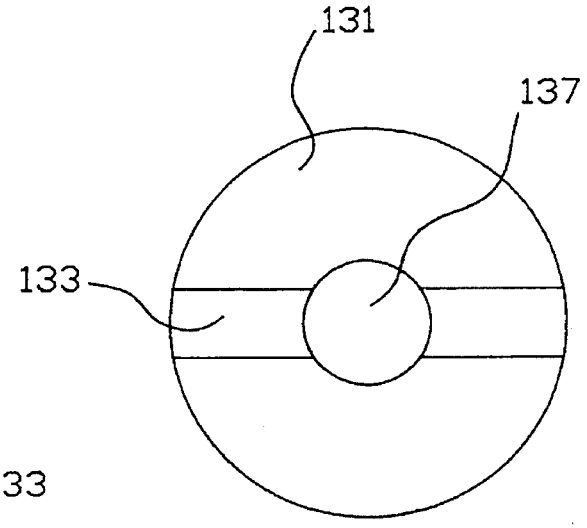
FIG. 30B is a bottom view of the Piston of FIG. 29.

FIGS. 29 and 30A–B, are illustrations of an improved piston sub to be used with a Type II Whip-Anchor. The dimensions of a similar sub for a Type I or Type III Whip-Anchor will change, but only in OD/ID of the sub. The internals will only vary slightly to fit the different sub OD/ID. Thus, anybody skilled in the art will be able to reproduce this tool for different sizes of Whip-Anchor. The improved piston sub consists of a lower sub, 130, about 6 feet long whose dimension is actually set by the volume of hydraulic fluid needed to operate the chosen hydraulic packer; wherein, the ID at the bottom of the lower sub is enlarged to form an enlarged piston landing, 136. A piston, 131, having an o-ring and groove, 132, is placed within the sub. This piston normally seals tightly against the internal wall of the lower sub. The piston has a riser, 134, which passes through the piston and is terminated in a removable cap, 135. When the piston is within the normal bore of the sub, it seals tightly against the wall; however, when the piston is in the landing, 136, the o-ring seal is broken. The piston serves as an interface between drilling mud and clean hydraulic fluid. There are two ⅜-inch circulation channels, 133, that enhance the mud flow past the piston after it reaches the landing.

The complete piston slab assembly, consisting of the upper (short) and lower subs plus the piston riser generally is attached to the setting tool and hydraulic connections made. The short sub, which is only chain tight, is opened and the piston riser, 134, pulled up to the top of the piston sub. The riser cap, 135, is opened and the proper hydraulic fluid required by the hydraulic packer is poured through the riser opening, 137, until the entire volume below the piston, 131, is filled with hydraulic fluid. This volume includes the packer, the hydraulic hose, and fittings in the Whip-Anchor, setting tool, etc. The cap can be replaced along with the upper stub which is then brought to the proper torque, or the riser cap can be left off. If the riser cap is left off, the riser should be filled with heavy lubricant. The heavy lubricant will act as a removable plug or seal between the hydraulic fluid and the drilling fluid, similar to the function performed by the riser cap.

The hydraulic packer is set, in the standard manner, by pressuring the drilling fluid. Hydraulic setting pressure is transferred through the piston in the piston sub. Once the packer is set, the hydraulic line is broken between the setting tool and the packer leaving the entrained hydraulic fluid free to leave the piston sub. The piston freely moves downward. When the piston reaches the enlarged landing, the seal between the piston and the wall of the lower sub is no longer functional and the drilling fluid will proceed past the O-ring and out of the bottom of the piston sub, through the broken hydraulic line and into the wellbore. If the piston does not have channels, then the piston will seat on the bottom of the sub (actually on set of threads belonging to the lower tool) and inhibit fluid flow. If the riser cap is left out of the assembly and the riser filled with heavy lubricant, the drilling fluid will push the lubricant; out of the riser and the riser can provide a backup (or even primary) passage for the drilling fluid.

Once the Whip-Anchor is in place, the hydraulic packer is set by increasing the drilling mud pressure; this mud column pressure is transferred to the hydraulic fluid through the piston sub and the slips will move. As the hydraulic slips move, the fluid in the piston sub will decrease and the piston, 131, will move towards the landing. (A slight decrease in mud pressure is always observed when this happens and this decrease tells the surface observers that the hydraulic packer is beginning to set.) After the hydraulic packer is set, the drill string is released from the Whip-Anchor by pulling upward on the drill string, which shears the shear pin and breaks the hydraulic connection to the Whip-Anchor face. As the drill string is pulled upward, mud column pressure will force the remaining hydraulic fluid from the piston sub and the piston will land. This then allows drilling mud to readily flow around the piston and out of the open/broken hydraulic hose, and the drill pipe will drain as it is pulled out of the hole.

The actual setting procedure for the new style Whip-Anchor will now be discussed. The techniques for running the Whip-Anchor into the well bore, be it used with a mechanical or hydraulic packer, are the same as used in the current art. The Whip-Anchor service representative need not worry as such about inadvertent pin shear in pushing, because the setting tool rests firmly in the bottom of the setting slot. Likewise, the Whip-Anchor service representative need not worry about torsional pin shear because the setting tool is contained by the side walls of the setting slot. These two features will greatly enhance the probability of a successful set. The Whip-Anchor service representative must still be concerned with inadvertent pin shear while reciprocating the Whip-Anchor in order to force the tool through a particularly tortuous path, for the pin will shear as designed, with sufficient upward pull. Assuming that the Whip-Anchor service representative has successfully positioned the Whip-Anchor, that he has surveyed the tool face orientation, and that he is in general satisfied with the operation, all that remains is the set the packer-anchor.

The mechanical packer-anchor is set by slacking off on the drill string and allowing the proper weight to rest on the setting tool. This weight will be transferred to the Whip-Anchor where several things will happen:

1) the torsional twist about the offset hinge will shear the spring retaining pin, and
2) the transferred weight will cause the mechanical packer collet to release, the weight will compress the packing elements and then set the slips.

Figure 23:
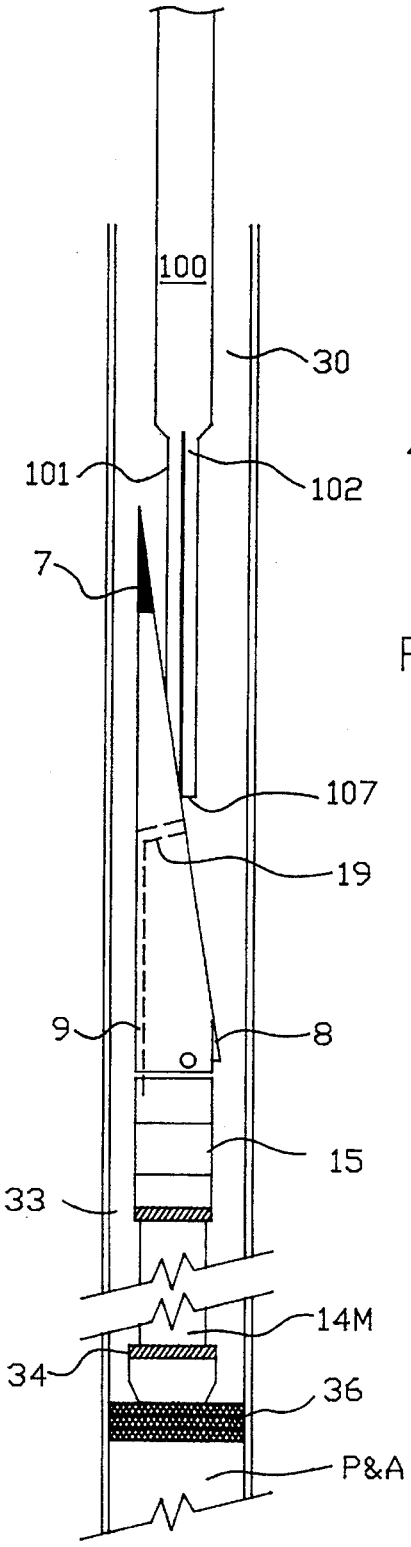
FIGS. 23 and 24 show the drill stem, setting tool, and downhole assembly in place in a well bore before shearing the shear pin for a Mechanical and Hydraulic Packer respectively.
Figure 23A:
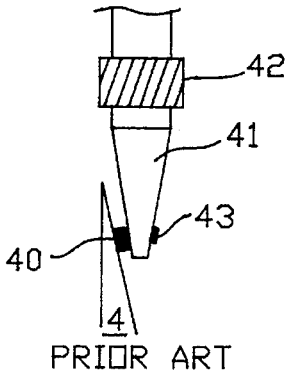
FIGS. 23A and 24A show the respective prior art.

This operation is shown in FIG. 23, which illustrates the preferred embodiment setting tool using the open tubular, 107, immediately prior to setting the mechanical anchor-packer. There are no hose connections between the open tubular, 107, and the hydraulic passageway, 19, on the face of the whipstock. (Note, if the operator were using this system in open hole and desired to bottom wash, there would be a line between the tubular and the whipstock passageway, as previously explained.) If the packer is being used in an open (uncased) hole, the operation is similar, except that mud anchors are used in the mechanical packer instead of casing slips.

Figure 24:
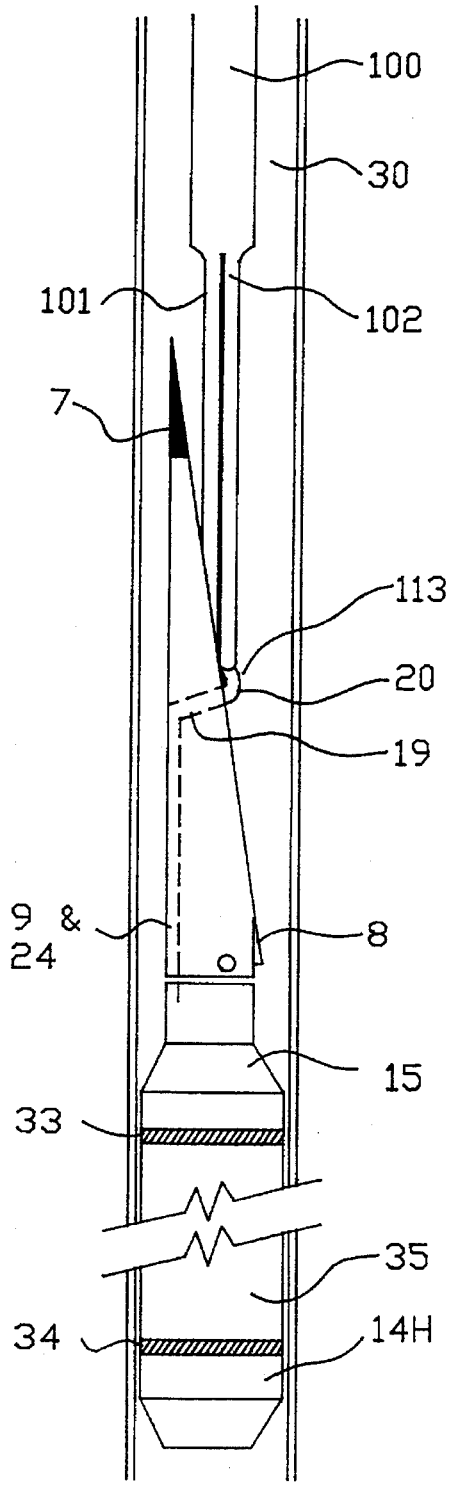
Figure 24A:
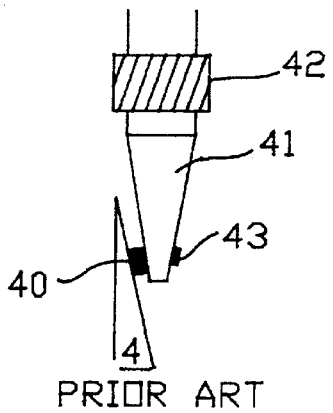

The hydraulic packer is set by well known standard procedures. This operation is shown in FIG. 24, which illustrates the preferred embodiment setting tool using the tubular, 102, with a short hose, 113S, connected between the tubular threaded opening, 107, and a street-ell, 20, fitted in the hydraulic passageway, 19, on the face of the whipstock. Simply stated, the mud pressure is increased. If an MWD tool is in the bottom hole assembly, the associated pinned by-pass valve will release, thus, shutting off mud circulation and allowing mud pressure to increase. The increase in mud pressure is applied to the piston sub, transferred to the hydraulic fluid and onto to the hydraulic packer. The Whip-Anchor service representative looks for the "pressure bobble", as previously explained, which indicates that the hydraulic packer has begun to set. The mud pressure is then increased to whatever pressure is necessary to set the hydraulic anchor-packer.

Figure 26:
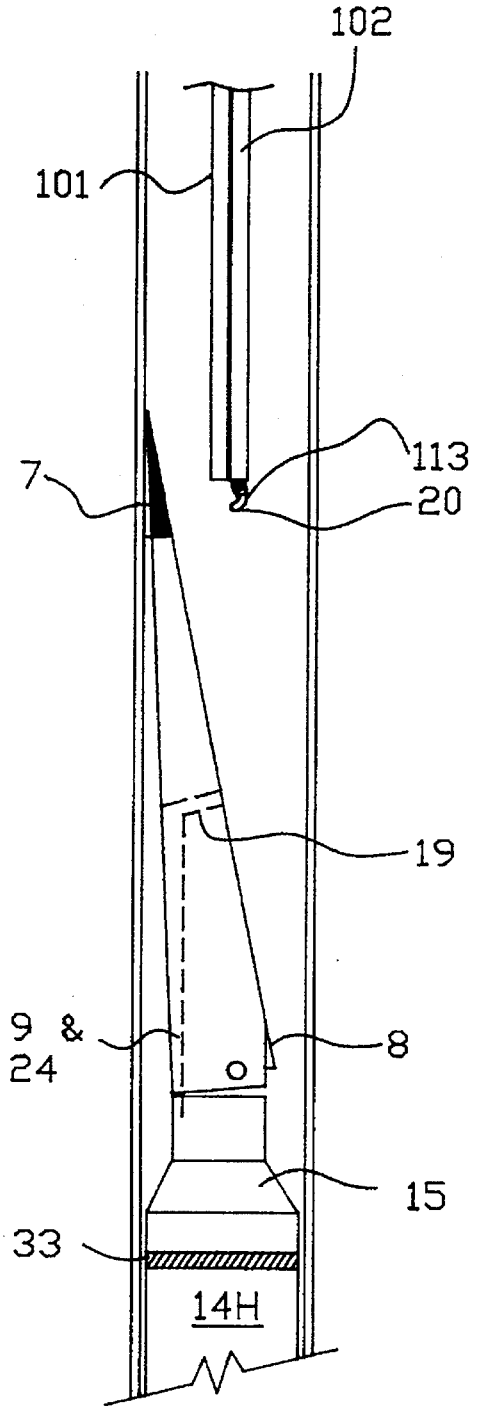
Figure 26A:
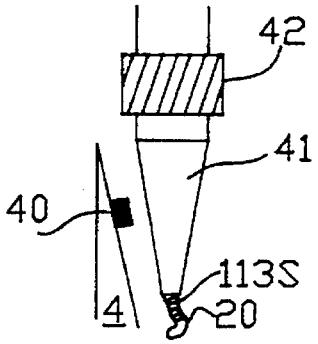
PRIOR ART FIGURE 26A

Once the anchor-packer is set, be it mechanical or hydraulic, the next step is to pull out of hole. In order to do this the Whip-Anchor must be released from the setting tool and, hence, the drill string. A number of well known steps are taken which do not differ from the current art. Essentially, these steps are designed to make certain that the anchor-packer has properly gripped the casing or that the mud slips have firmly embedded the bore hole (formation). The Whip-Anchor service representative generally pulls and slacks off several times on the drill string maintaining the strain each time for about a minute. If the mechanical packer moves, the setting procedure should be repeated. If the hydraulic packer moves, then the Whip-Anchor service representative should follow the normal resetting procedure already practiced with this type of packer. After assuring himself that the anchor-packer has properly set, the Whip-Anchor service representative pulls back on the drill string slowly, increasing the force until the shear pin fractures. The situation for both types of packer is shown in FIGS. 25 and 26. Note that in FIG. 26, the short hydraulic hose, 113S, breaks clear of the whipstock face taking the fractured street-ell, 20, with it. Fracturing of the street-ell, 20, at the face of the whipstock at the point of the threads is assured by careful scoring of the street-ell, 20, before or after it is placed in the whipstock during assembly.

Although the preferred embodiment of the setting tool is shown in these illustrations, the alternative embodiment which uses a long hydraulic hose, 113L, in place of the shorter hose, 113S, operates in the same manner. Upon breaking away from the whipstock, the longer hose will take the fractured street-ell, 20, with it. The entire string is removed from the hole and the second pass tools are prepared for the actual window mill cut.

TABLE 8

| | | SHEAR PULL VALUES | |
|---|---|---|---|
| Whip-Anchor Size | Bore size | Shear Stud Size | Approximate Shear Force* |
| I 3½" OD | 3¾"–5½" | ½" × 1" length | 10, 15 & 20,000 pounds |
| II 5½" OD | 5¾"–8" | ⅝" × 1¼" length | 25 & 30,000 pounds |
| III 8" OD | 8¼"–12½" | ¾" × 1½" length | 30, 35, 40 & 45,000 pounds |

*varies with Whip-anchor size

The approximate values of shear force is given in the table above. It should be remembered that these values are only approximate and the values seen at the surface will vary, depending on the well bore conditions, hole length, etc. The actual shear value of the shear stud will be determined by the shear groove that is cut in the stud. The shear value is carefully chosen using techniques well known in the industry and is set by the size and weight of the Whip-Anchor (the whipstock and its anchor-packer), whether the Whip-Anchor was to later be retrieved, and the hole conditions. For example, a Type I tool with a retrievable hydraulic set anchor packer, used for drilling 4½ inch multiple drain holes, would normally use a 10,000 pound shear stud if hole conditions were good because the tool would be slated for retrieval. On the other hand, a Type I tool used with a permanent hydraulic or mechanical packer would use a 20,000 pound shear stud because the tool would not be retrieved.

The second pass, the actual cutting of the window in the casing or the start of the deviated hole in an uncased hole, is radically different to the prior art. This invention differs from the prior art in that there is no starting mill operation. In the prior art and referring to FIGS. 27A and 27B, a shear pin block, 40, was always welded onto the surface of the whipstock tool face, 11, within about one foot of the top, to which the shear pin was bolted. The shear pin held the starter mill taper, 41, to the block. The starter mill in turn was attached to the drill string with necessary optional tools required for setting the whipstock. Simply put, a similar procedure as described above was used to set the whipstock. The only drawback being that the usual prior art systems were designed to be used with hydraulic packers because sufficient weight, to set a mechanical anchor packer, cannot be imparted to the face of a whipstock through a shear pin.

For example, the minimum set down weights for good set on a mechanical compression packer is as follows:

| | |
|---|---|
| Type I size range | 40,000 pounds |
| Type II size range | 60,000 pounds |
| Type III size range | 80,000 pounds |

Thus, it can be seen that the prior art, which utilizes a shear pin without a setting slot, cannot "set" compression mechanical packers because the shear pin requirements are roughly one-half of the set down requirements. There is one form of mechanical packer that uses a single slip segment which results in a lower set down requirement; however, the procedure for setting this particular packer requires that weight be applied to the packer until the shear pin shears. This means that the "set" of the packer cannot be tested by pulling upward.

In the prior art the initial starter mill accomplished two objectives:

1) the milling off of the shear pin block, 40; thus, preparing the whipstock tool face, and 2) starting an initial up-slope cut, 99, into the casing (or formation in an uncased hole).

The starter mill, 42, would push against the top of the whipstock and be deflected into the side of the casing. An additional fulcrum effect was obtained from the starting mill taper, 41, pushing against the shear block, 40. (Please see prior art insets in FIGS. 23 through 27.) After the starter mill had traveled about 12 inches into the hole, cutting a starter window of some 12 inches in the casing (or formation in an uncased hole), the starter mill would begin to mill the shear block. The maximum distance that the starter mill could travel was about 20 inches before the starting mill taper would hang up on the casing and keep the starting mill from moving along the required deviation path, 45. Quite often the starter mill would cut into the whipstock tool face; thus, damaging the necessary fulcrum point, 49, needed by the watermelon mill. This device replaces the start milling operation with a simple window mill, 48; the window mill being deflected by the deflector head, 7.

Figure 28:
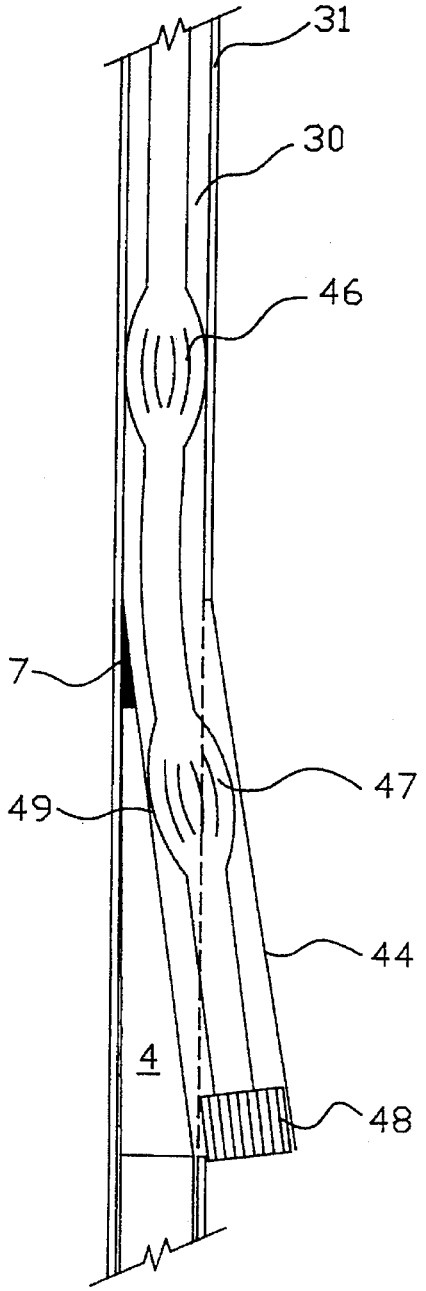
FIG. 28 shows the complete milling assembly at the end of the second pass operation illustrating the open window in a cased well bore for either a Mechanical and Hydraulic Packer respectively.

The second pass downhole tool assembly consists of, a properly sized window mill, 48, and a properly sized watermelon mill 47, (a second watermelon mill, 46, can be added by the operator if a larger window opening was needed in the casing), as shown in FIGS. 27 and 28. These window mill tools are usually attached to a single joint of heavy weight drill pipe to help ensure the proper fulcrum effect; followed by the correct number of drill collars, which provide the necessary milling weight. The prudent operator will add a set of drilling jars which is followed by sufficient drill collars to provide weight for the jars. The additional tools, drill collars, subs and jars are not shown but are well known tools in the practice.

FIG. 27 shows the start of the window milling operation. The window mill, 48, is deflected against the casing (or formation), by the deflector head, 7. The deflector head will carry the full weight of the milling operation until the mill is able to cut into the casing (or formation) at which time more and more mill weight will shift to the well bore side. It is known that the starting mill will make an initial cut into the casing, 99, and then begin to pull itself into the casing riding up onto the initial cut. Approximately the first one foot of milling is the critical length, although this distance will increase with the size of the hole. Please see the deflector head parameter table, table 2. The actual milling parameters are the same as the prior art uses after the initial mill, thus, these techniques and parameters are well known by those skilled in the art and need not be discussed in great detail. The prior art is shown in FIGS. 27A and 27B.

As the window is cut in the casing, the window mill, 48, moves downward and the watermelon mill, 47, begins to enlarge the casing (or formation) cut. The watermelon mill fulcrums off the whipstock tool face, (shown approximately as point 49) to help keep the window mill on its deviation path. Additional fulcrum effects are provided by the single joint of drill pipe (and second watermelon mill, 46, if used) to guide the lower tools. The Whip-Anchor service representative would normally use this set of tools to mill the window and sufficient formation to obtain a total depth of between seven and ten feet (a normal distance presently used in the art). These tools would then be removed and a normal drilling operation would commence on the next trip.

The Whip-Anchor is a retrievable tool which is a highly desired characteristic for use in multiple drain holes or in multiple slim hole exploration. The retrieval of the tool is made convenient through a carefully designed fishing system based on field experience. The major problem in retrieving tools (or any object) from a well bore is being able to get a grip on the object so that it can be withdrawn. The Whip-Anchor is retrievable because it has a specially designed slot and retrieval tool (fishing tool) system which allows for easier gripping of the tool. The operator should properly prepare the hole for retrieval of the tool which should be conducted by a qualified Whip-Anchor service representative. Proper well bore preparation would include a trip with a locked up bottom hole assembly and a good effort to sweep all drill cuttings, which would have come from the newly deviated well bore, from the main well bore.

Figures 31, 31A:
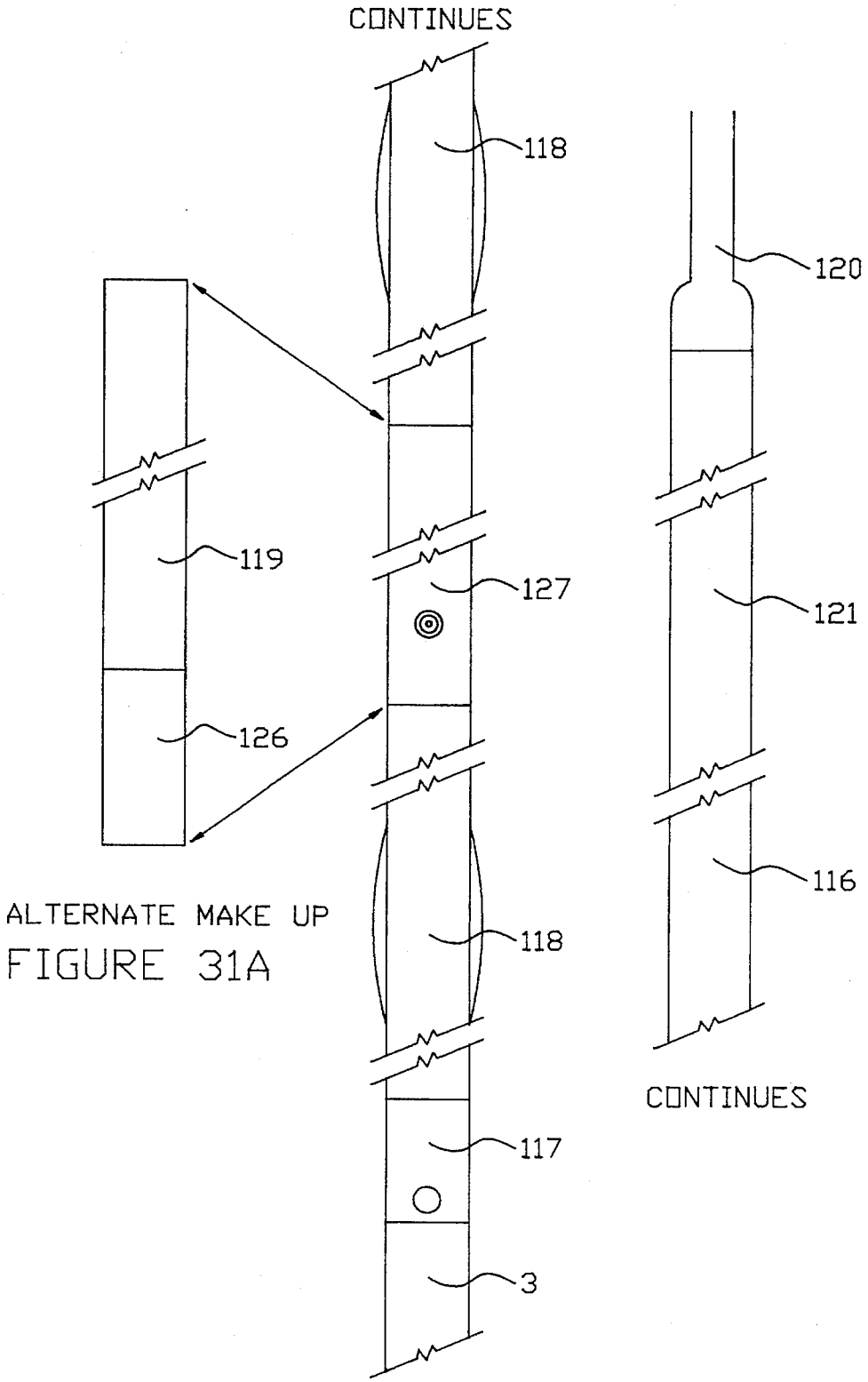
FIG. 31 illustrates a proposed Bottom Hole Assembly (BHA) assembly for use with the retrieval tool.
FIG. 31A illustrates the alternate make up if an orientation sub is used in the place of and MWD tool.

The choice of downhole running tools for a retrieval operation is based on myriad conditions and qualified Whip-Anchor Service Representatives will have no problem in selecting the correct combination of tools to be used with the Whip-Anchor retrieval tool. A suggested centralized Bottom Hole Assembly (BHA) arrangement is shown in FIG. 31, starting with the retrieval tool, 3. The retrieval tool should be followed by an unpinned by-pass valve, 141, because the retrieval tool wash passage, 176, cannot pass sufficient fluid flow to properly ensure drainage of drilling fluid from the drill string when pulling out of hole. Proper drainage of the drill string is essential to assure that mud is not released on the drill floor. (As stated earlier, this device will find its greatest use in old bores or in multiple drain bores which use an oil based mud; considered toxic by the regulatory authorities.) A full Gauge stabilizer, 118, would then follow. At this point, the Whip-Anchor service representative can install an MWD, 121, or an orientation sub, 126, with a single drill collar, 119. Either assembly can be used for orientation of the retrieval hook in the hole, although an MWD tool would be preferred. The orientation tool(s) are then followed by a second full gauge stabilizer, 118. A set of jars, 140, is recommended plus the necessary drill collars, 121, for the jars. For a Type I Whip-Anchor, the Whip-Anchor service representative should use 20,000 pounds weight of drill collars; for the Type II tool, 40,000 pounds is recommended; and for the Type III tool, 60,000 pounds. This complete centralized BHA would be attached to the drill string, 120, and run into the well bore using standard techniques.

Figure 15A:
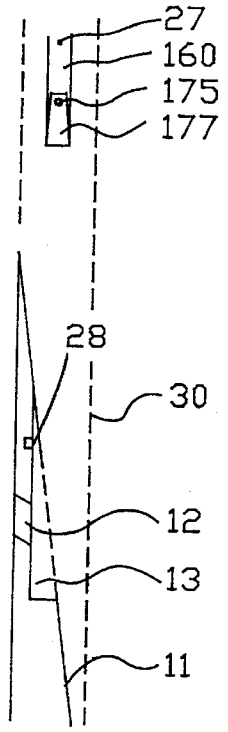
FIG. 15A shows the retrieval tool near the top of the WHIP-ANCHOR about to be orientated to scrub the setting slot.
Figure 15B:
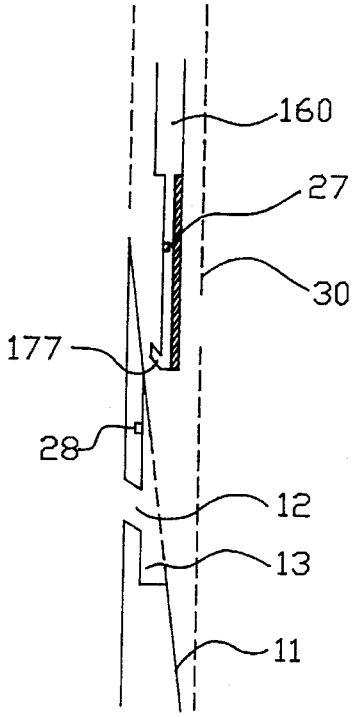
FIG. 15B shows the retrieval tool with its hook face facing the setting slot at the beginning of the scrub of the setting slot.
Figure 15C:
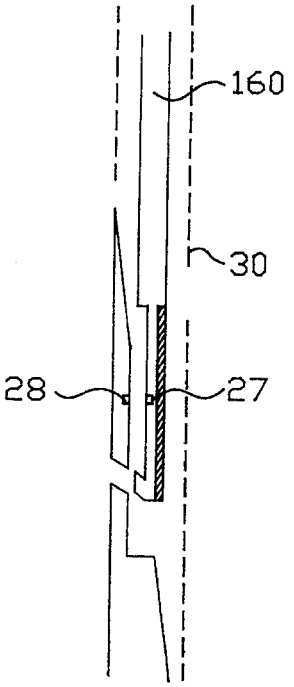
FIG. 15C shows the retrieval tool near the bottom of the setting slot immediately prior to bottoming out on the base of the slot and prior to pulling up to engage the retrieval slot.

The retrieval tool and BHA would be run into the well bore to just above the top of the Whip-Anchor (see FIG. 15A). At this time the Retrieval Tool Hook Face would be orientated to face the setting and retrieval slots (See FIG. 15B). After orientation, the mud pumps would be used, via the wash port, 175, to flush any debris out of the setting slot, 13, and the retrieval slot, 12, on the Whip-Anchor as the Retrieval tool proceeds downhole. The retrieval hook passageway is designed to "scrub" the wall of the well bore and the setting/retrieval slot for a more positive latch, and the centralized BHA described above will ensure that this action indeed happens. If the retrieval tool will not "scrub" due to extreme well bore configurations, adjustments can be made to the tool in order that it will properly "scrub." These adjusts could include adding a bent sub assembly (slot shown) between the retrieval tool, 3, and the by-pass valve, 117. If worst comes to worst, the actual retrieval tool could be bent.

Figure 15D:
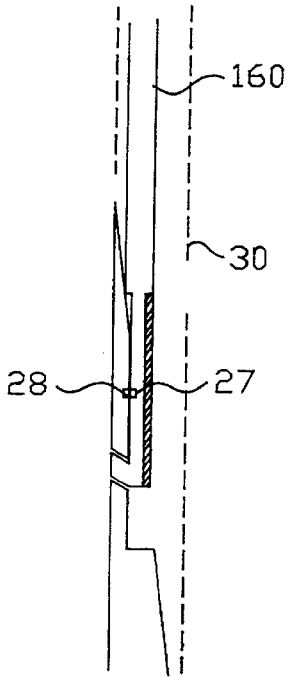
FIG. 15D shows the retrieval tool fully engaged in the retrieval slot, retrieval latching mechanism aligned and latched, and with the hook extending through the back of the WHIP-ANCHOR; thus, drawing the back of the WHIP-ANCHOR away from the well bore.
Figure 16:
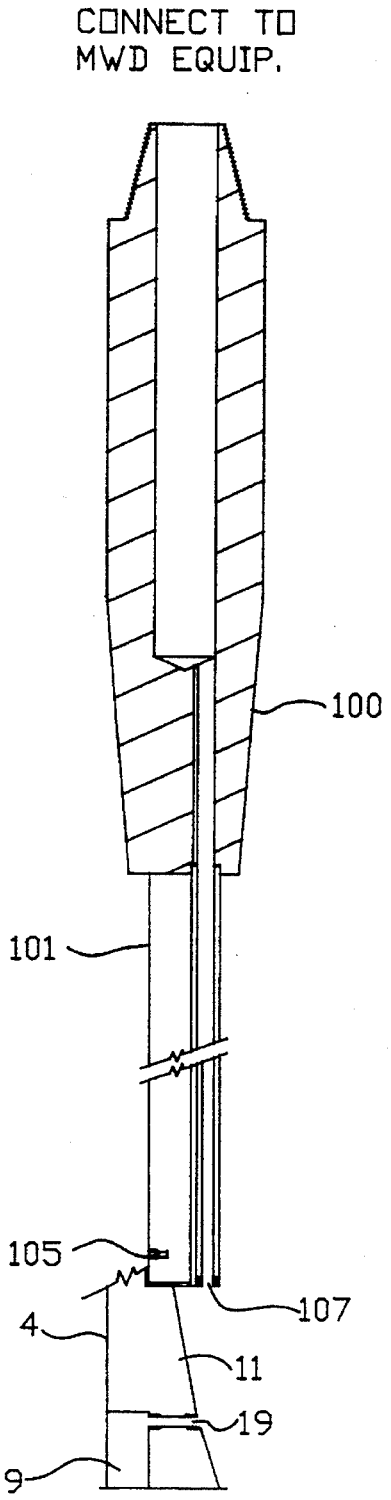
FIGS. 16 through 19 show details for the setting tool showing how one tool is used for both mechanical and hydraulic operations.
Figure 17:
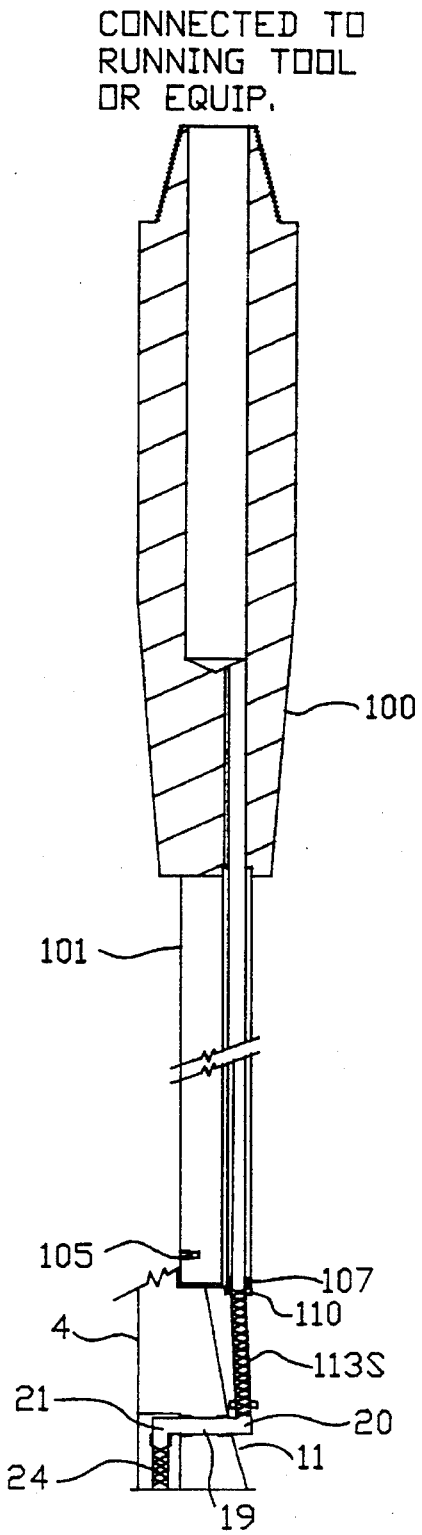
Figure 18:
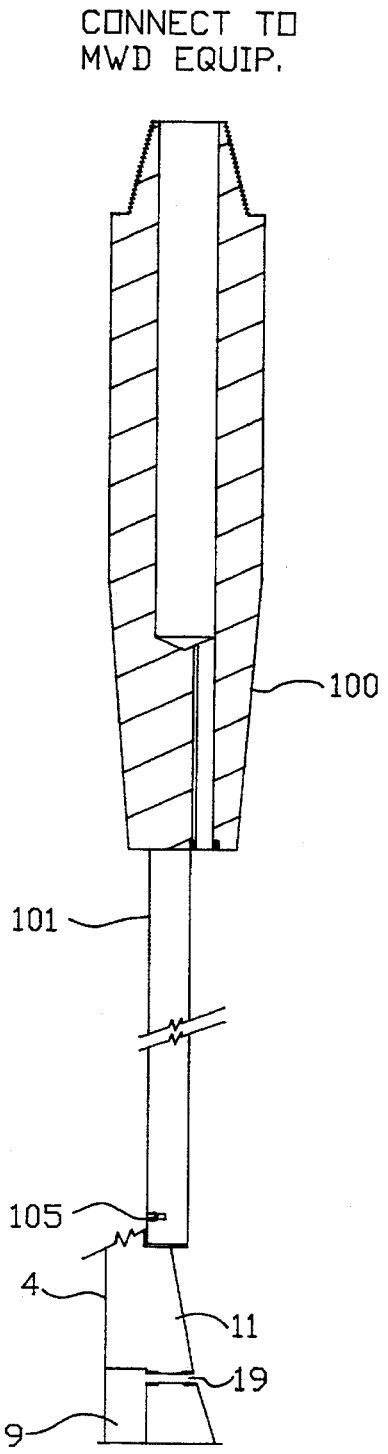
Figure 19:
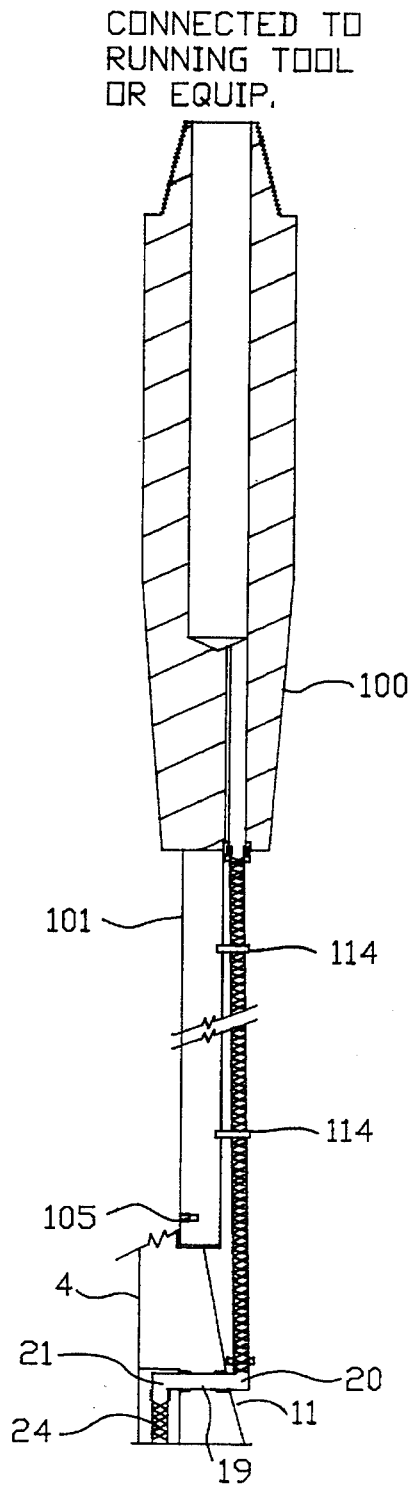

Attempts would then be made, by reciprocating the drill string, to latch the retrieval tool hook, 117, into the retrieval slot, 12. (If an MWD tool is not used, the technique would still be similar, the Whip-Anchor service representative just would not know which way the hook and wash port were facing, and trial and error means would have to be used to wash the slots and hook the retrieval slot. That is reciprocate the drill string, rotate 15 degrees, reciprocate the pipe, and repeat.) Positive latching of the hook in the slot will be indicated at the surface by a sharp increase in mud pressure because the mud flow through the wash port has been stopped by the preferred use of the piston sleeve valve, 140, as described previously. If, however, the alternate positive latch indictor embodiments are used, mud flow will be stopped by closure of the hook valve, 203, which is controlled by the hook valve actuator, 204, being pushed inwards when the hook fully engages the retrieval slot; or by closure of the flapper valve, 201, which is controlled by the flapper valve actuator, 202, being pushed inwards as the retrieval tool face presses against the setting slot. A further indication of positive latching will be a "loss of weight" if the Whip-Anchor service representative slacks off slightly, due to the BHA weight being carried by the latched hook on the retrieval tool. The Whip-Anchor service representative must remember not to slack off greatly or the latch mechanism, 28, shear pin will shear; this will be covered later in the discussion. After the retrieval tool properly engages the retrieval slot, interaction of the sloped slot and hook will draw the back of the Whip-Anchor away from its close contact with the well bore as shown in FIG. 15D as it rotates about the hinge assembly. (The hinge springs will compress due to torsional forces about the offset hinge as the anchor is dragged out of the hole.) This ensures that the top of the Whip-Anchor will not catch against casing joints as it is tripped out of the hole. Additionally, the extra length of the hook that protrudes from the back of the Whip-Anchor, will aid in reducing the possibility of snagging a casing joint.

Once the hook has engaged, the latch pin mechanism, 28, will ensure that the hook does not come out of the retrieval slot if the Whip-Anchor service representative has to reciprocate the drill string in order to free the Whip-Anchor. Once hook engagement has occurred, the Whip-Anchor service representative will slowly increase the pull on the drill stem to the point of known slip shear screw release force. The actual pull force will be greater than the slip shear screw release force because of well bore friction. Once the shear screws have sheared the slips on the anchor will release, the packing will collapse, and the anchor will free itself from the well bore. All that the Whip-Anchor service representative must do is trip out of the well bore.

If the Whip-Anchor happens to stick in the hole during the trip, the Whip-Anchor service representative can use the fishing jars to attempt to work the Whip-Anchor free. The hydraulic fishing jars must be reset, which is done by applying weight on the jars. The retrieval tool latch pin mechanism, 28, (either embodiment as shown in FIGS. 14A or 14B) is designed to provide sufficient strength (i.e. it will not shear) for reset of the fishing jars. The techniques for "fishing" stuck tools from a well bore are well known and will not be discussed in this disclosure. On the other hand, if the Whip-Anchor becomes irretrievably stuck, the Whip-Anchor service representative may apply sufficient down weight, which not only resets the jars, but will shear the latch pin. This allows the retrieval tool hook, 117, to slide downward and out of the retrieval slot. The drill string should then be rotated and reciprocated in order to turn the retrieval hook away from the retrieval slot. Following this, the drill string can be tripped out of the hole anti the stuck Whip-Anchor either abandoned or retrieved using other well known and expensive fishing techniques.

Finally, it must be realized the present art whipstocks using hydraulic (or mechanical) anchor packers can be converted to incorporate some of the salient features of the instant invention and such conversion is considered to be within the scope of this invention. The conversion may be made by cutting a setting tool slot in the current state of the art whipstock and using the techniques described above to set the converted whipstock attached to either a mechanical or hydraulic packer. If the user desires, a retrieval slot can be cut in the whipstock and the retrievable features of the above disclosure can be used. It is recommended that the top section of existing art whipstocks hardened to the equivalent of the deflector head; or, alternatively that, the top section of existing art whipstocks be cut and the deflector plate of the instant invention be used in its place. Either recommendation will ensure proper starting of the window cut. It should be noted that converted whipstocks can only be used in the size of well bore for which they were originally designed and will have a "full bore" cross-section.

There has been disclosed heretofore in the above discussion the best embodiment and best mode of the present invention presently contemplated. It is to be understood that the examples given and the dimensions may be changed, that dimensions are based on strength properties of the material chosen to manufacture the Whip-Anchor, and that modifications can be made thereto without departing from the spirit of the present invention.

INVENTION DRAWING NUMBER INDEX

Terminology=Two conventional whipstocks are available.

PACK-STOCK™ and BOTTOM TRIP

The Packstock is a whipstock and packer assembly combination that forms a single integral unit downhole. Note that Pack-Stock™ is a trade name other trade names are used in the industry. In this patent the term Whip-Anchor (or variants) will be used to describe the combination of a whipstock and its anchor packer. The bottom trip has a plunger that sticks out of the bottom of the whipstock which when set down on the bottom of the hole will release a spring loaded wedge/slip which in turn sets the tool.

001 The Whipstock Invention generally - not including anchor-packer
002 The Whipstock Setting Tool generally
003 The Retrieval Tool generally
004 Top section of whipstock generally
005 Bottom section of whipstock generally
006 Hinge section of whipstock generally
007 Deflector head section of whipstock generally
008 The optional spacer
009 Whipstock cut-a-way for hydraulic pressure line
010 The complete downhole tool generally - whipstock, head, spacer, and packer
011 The cupped face of tile whipstock (tool face side)
012 Retrieval slot section of whipstock generally
013 Setting slot section of whipstock generally
014H Hydraulic anchor packer generally
014M Mechanical anchor packer generally
015 Cross-over sub (bet›een packer and whipstock)
016 Running tool (converts mud pressure to hydraulic pressure)
017 MWD tool
018 Other string tools generally
019 Upper Hydraulic passageway - within whipstock
020 Hydraulic street-ell connection within whipstock face
021 Hydraulic street-ell connection within whipstock back
022 Hydraulic street-ell connection within whip)stock base
023 Hydraulic line within hydraulic cut-a-way
024 Base Hydraulic passageway - within base
025 Setting slot base (or bottom)

-continued

026 Whipstock/deflector head joint in general
027 Location of Retrieval Tool Shear Pin Aperture or Mechanism.
028 Retrieval Tool Latch Pin Mechanism mi General
029 Conventional Whipstock Profile
030 Borehole generally - can be cased or uncased
031 Casing
032 Cement between casing and formation
033 Upper Slips/Wedges
034 Lower Slips
035 Packing
036 Bridge Plug
037 Keeper Ring
038 Shear Pin Groove
039 Shear Pin
040 Prior Art - Shear Pin Block
041 Prior Art - Starting Mill Taper
042 Prior Art - Starting Mill
043 Prior Art - Shear Pin
044 Actual Deviated Bore Hole
045 Planned Deviated Bore Hole
046 Second watermelon mill
047 First watermelon mill
048 Window Mill
049 Fulcrum Point (approximate) on tool face
050 Leading edge of deflector plate
051 PCD Inserts
052 Joint between Deflector Head and Whipstock Body
053 Retainer Pins
054 Retainer Phi Hole
055 Deflector Head Sloped Side
056 Deflector Tool Face (continuation of 11)
057 Curved back of Deflector Head
058 Deflector Head effective length
059 Deflector Head Ridge
060 Deflector/whipstock joint backside weld gap
061 Weld Bead
062 Shear Pin Aperture
063 Shear Pin Recess
064 Keeper Ring Groove
065 Depth of Bottom/Base of Setting slot
066 Depth of Retrieval slot
067 End of Tool Face
068 Threaded stud aperture - oil whipstock body
069 Whipstock /joint backside weld gap
070 Whipstock Ride
071 Whipstock Tool Face (continuation of 11)
072 Spacer extended tool face (continuation Of 1 1)
073 Spacer back
074 Spacer Stud
075 Spacer Stud opening
076 Spacer base length
077 Spacer depth
078 Spacer length
079 Spacer width
080 Hinge pin opening - upper section
081 Hinge pin opening - base section
082 Hinge section - upper section
083 Right Spring opening - upper section
084 Left Spring opening - upper section
085 Right spring opening - base
086 Left spring opening - base
087 Hinge Pin
088 Spring retainer shear pin
089 Sloped back of hinge base
090 Top sloped back of hinge base
091 Hinge Phi snap ring
092 Hinge Pin Snap Ring, Groove
093 Spring retainer snap ring
094 spring retainer snap ring grove
095 Hinge spring
096 Spring retainer shear pin opening - upper section
097 Spring retainer shear pin opening - base section
098 Hinge section - base section
099 Casing Initial Cut Point
100 Setting Tool Sub
101 Setting Tool Rectangular Bar
102 Setting Tool Fluid Line or Tubular
103 Weld between Bar and Fluid Line/Tubular
104 Weld between bar/line and sub
105 Shear Pin Threaded Aperture mi setting tool bar -continued 106 Setting Tool bottom face angle
107 Open end of fluid line - threaded female
108 Bottom Face of Setting Tool
109 Setting Tool Length (measured from sub)
110 Hydraulic Hose Male Fitting
111 Setting Tube Recess or Offset
112 Setting Tool Threaded Tubular Recess
113S Hydraulic Hose - Short (Preferred)
113L Hydraulic Hose - Long (Alternate)
114 Stainless Steel Hydraulic Hose Strap
115
116 Fishing Jars
117 By-pass Valve (unpinned)
118 Stabilizer
119 Single Drill Collar
120 Drill String
121 Drill Collars
122 One Joint High Grade Drill Pipe
123 Combination of 120, 121 and 122 - upper string assembly
124 Cross-over sub
125 Cross-over sub
126 Orientation sub
127 MWD tool
128 Pinned by-pass valve tool (or sub)
129 Short sub (for filling piston sub)
130 Lower Sub
131 Piston
132 Piston O'ring and Groove
133 Circulation Channel(s)
134 Piston Riser
135 Riser Cap
136 Enlarged Piston Landing
137 Riser Opening,
138
139 Cross Passageway
140 Optional Piston Valve (or Sleeve Valve) in General
141 Tool Joint
142 Tool joint fluid passage,e
143 Hydraulic Street-ell
144 Hydraulic High Pressure Hose
145 Buttress Threaded Connection for Access to Piston Valve
146 Piston valve
147 Piston valve ring,s
148 Piston valve spring
149 Piston valve extension, attaches to retrieval tool
150 Heavy Arrows showing, fluid flow
151 Piston valve Spline
152 Piston valve Spline
153 piston valve Spline
154 Piston valve head
155 Lower piston valve sleeve
156 Upper piston valve sleeve
157 Piston valve central fluid passage
158 Piston valve cross fluid passage
159 piston valve seal point
160 The Retrieval Tool Generally (w/0 top works)
161 Lengths of Tool
162 "
163 "
164 "
165 "
166 "
167 "
168 Lengths of Tool
169 "
170 "
171 "
172 "
173 "
174 "
175 Wash Port
176 Wash Passageway
177 Hook
178 Retrieval Bar,
179 Retrieval Tool Recess or Offset
180 Retrieval Tool Top Sub
181 Fluid Passageway
182 Threaded opening
183 Retrieval Tool Hydraulic Hose
184 Stainless Steel Hydraulic Hose Retainer Clamp -continued 185 Hydraulic Street-ell
186 Threaded or Smooth Tubular Opening
187 Retrieval Tool Tubular
188 Weld
189 Tubular Plug
190 Protector, Plate
191 Tool Joint
192 Tubular
193 Passageway
194 Threaded Connection
195 Flapper Valve Sleeve
196 Flapper Valve Passageway and Holder
197 internal Fluid Passage
198 Curved lower bottom
199 Sloped face of hook
200 Hook Weld to Tubular
201 Flapper Valve
202 Flapper valve Actuator
203 Hook Valve
204 Hook Valve Actuator
205 Protector Plate Weld Bead
206 Retrieval Tool Latch Pin
207 Retrieval Tool Latch Spring
208 Retrieval Tool Latch Pin Retainer
209 Retrieval Tool Latch Aperture - pin and spring side it, WHIP-ANCHOR
210 Retrieval Tool Latch Phi Opening - opening side in Retrieval Tool
211 Retrieval Tool Latch Aperture - pin and spring side in Retrieval Tool
212 Retrieval Tool Latch Pin Opening - opening side in WHIP-ANCHOR
213

I claim:

1. A method for setting a whip-anchor assembly, incorporating an elongated setting slot, with a drill string in a wellbore for changing the direction of drilling wherein the whip-anchor assembly is releasably secured within the elongated setting slot to a rectilinear setting tool supported on the drill string comprising the steps of:

(a) lowering the whip-anchor assembly into the wellbore;

(b) orientating the whip-anchor assembly;

(c) anchoring the whip-anchor assembly in the orientated position in the well bore; and (d) releasing the rectilinear setting tool from the whip-anchor.

2. A method for setting a slotted face wellbore deviation assembly with a drill string in a wellbore for changing the direction of drilling wherein the wellbore deviation assembly incorporates a whipstock fitted with an elongated setting slot, attached to an anchor-packer, and further is releasably secured to a rectilinear setting tool supported on the drill string within the elongated setting slot comprising the steps of:

(a) lowering the slotted face wellbore deviation assembly into the wellbore;

(b) orientating the slotted face wellbore deviation assembly;

(c) setting the anchor-packer; and, (d) releasing the rectilinear setting tool from the whipstock.

3. A method for setting a slotted face wellbore deviation assembly with a drill string in a wellbore for changing the direction of drilling wherein the slotted face wellbore deviation assembly incorporates a whipstock fitted with an elongated setting slot, an upper hydraulic passageway and internal plumbing, attached to a hydraulic anchor-packer, and further is releasably secured to a rectilinear setting tool supported on the drill string within the elongated setting slot comprising the steps of:

(a) attaching a shearable hydraulic fitting to the upper hydraulic passageway;

(b) attaching a hydraulic line between said shearable hydraulic fitting and the rectilinear setting tool;

(c) lowering the slotted face wellbore deviation assembly into the well bore;

(d) orientating the slotted face wellbore deviation assembly;

(e) setting the hydraulic anchor-packer; and, (f) releasing the rectilinear setting tool from the whipstock.

4. The method for setting a slotted face wellbore deviation assembly of claim 3 comprising the additional step of:

(b-1) attaching a hydraulic isolator between the rectilinear setting tool and the drill string, following step (b).

5. The method for setting a slotted face wellbore deviation assembly of claim 3 comprising the additional step of:

(b-1) attaching an improved piston sub between the rectilinear setting tool and the drill string, following step (b).

6. A method for setting a slotted face wellbore deviation assembly with a drill string in a wellbore for changing the direction of drilling wherein the slotted face wellbore deviation assembly incorporates a whipstock fitted with an elongated setting slot, attached to a mechanical anchor-packer, and further is releasably secured to a rectilinear setting tool supported on the drill string within the elongated setting slot comprising the steps of:

(a) lowering the slotted face wellbore deviation assembly into the well bore:

(b) orientating the wellbore deviation assembly;

(c) setting the mechanical anchor-packer by placing the required setting weight on the drill stem; and, (d) pulling up on the drill stem to release the rectilinear setting tool.

7. A method for setting a slotted face wellbore deviation assembly with a drill string in a wellbore for changing the direction of drilling while bottom washing the well bore, wherein the slotted face wellbore deviation assembly incorporates a whipstock fitted with an elongated setting slot, an upper hydraulic passageway and internal plumbing, attached to a mechanical anchor-packer, and further is releasably secured to a rectilinear setting tool supported on the drill string within the elongated setting slot, comprising the steps of:

(a) attaching a shearable hydraulic fitting to the upper hydraulic passageway;

(b) attaching a hydraulic line between said shearable hydraulic fitting and the rectilinear setting tool;

(c) lowering the slotted face wellbore deviation assembly into the wellbore while maintaining circulation;

(d) orientating the slotted face wellbore deviation assembly;

(e) setting the mechanical anchor-packer by placing the required setting weight on the drill stem; and, (f) pulling up on the drill stem to release the rectilinear setting tool.

8. A method for setting an improved whipstock incorporating a slotted face with a drill string in a wellbore for changing the direction of drilling wherein the whipstock is fitted with an elongated setting slot, attached to an anchor-packer, and further is releasably secured to a rectilinear setting tool supported on the drill string within the elongated setting slot comprising the steps of:

(a) lowering the improved whipstock into the wellbore;

(b) orientating the improved whipstock;

(c) setting the anchor-packer; and, (d) releasing the rectilinear setting tool from the whipstock.

9. A method for setting an improved whipstock incorporating a slotted face with a drill string in a wellbore for changing the direction of drilling wherein the whipstock is fitted with an elongated setting slot and internal hydraulic plumbing, attached to a hydraulic anchor-packer, and further is releasably secured to a rectilinear setting tool supported on the drill string within the elongate setting slot comprising the steps of:

(a) attaching a shearable hydraulic fitting the internal hydraulic plumbing of the improved whipstock:

(b) attaching a hydraulic line between said shearable hydraulic fitting and the rectilinear setting tool;

(c) lowering the improved whipstock assembly into the well bore;

(d) orientating the improved whipstock assembly;

(e) setting the hydraulic anchor-packer; and, releasing the rectilinear setting tool from the whipstock.

10. The method for setting an improved whipstock assembly, incorporating a slotted face, of claim 9 comprising the additional step of:

(b-1) attaching a hydraulic isolator between the rectilinear setting tool and the drill string, following step (b).

11. The method for setting an improved whipstock assembly, incorporating a slotted face, of claim 9 comprising the additional step of:

(b-1) attaching an improved piston sub between the rectilinear setting tool and the drill string, following step (b).

12. A method for setting an improved whipstock incorporating a slotted face with a drill string in a wellbore for changing the direction of drilling wherein the whipstock is fitted with an elongated setting slot, attached to a mechanical anchor-packer, and further is releasably secured to a rectilinear setting tool supported on the drill string within the elongate setting slot comprising the steps of:

(a) lowering the improved whipstock assembly into the well bore;

(b) orientating the improved whipstock assembly;

(c) setting the mechanical anchor-packer by placing the required setting weight on the drill stem; and, (d) pulling up on the drill stem to release the rectilinear setting tool.

13. A method for setting an improved whipstock incorporating a slotted face with a drill string in a wellbore for changing the direction of drilling while bottom washing the hole, wherein the whipstock is fitted with all elongated setting slot and internal hydraulic plumbing, attached to a mechanical anchor-packer, and further is releasably secured to a rectilinear setting tool supported on the drill string within the elongate setting slot, comprising the steps of:

(a) attaching a shearable hydraulic fitting the internal hydraulic plumbing of the improved whipstock;

(b) attaching a hydraulic line between said shearable hydraulic fitting and the rectilinear setting tool;

(c) lowering the improved whipstock assembly into the wellbore while maintaining circulation;

(d) orientating the improved whipstock assembly;

(e) setting the mechanical anchor-packer by placing the required setting weight on the drill stem: and, (f) pulling up on the drill stem to release the rectilinear setting tool.

14. A method for drilling a deviated hole utilizing a drill string in a wellbore incorporating a slotted face wellbore deviation assembly without a shear block assembly comprising:

(a) setting the slotted face wellbore deviation assembly;

(b) tripping out of the well bore;

(c) attaching a window mill bit, and a water melon bit to the drill string;

(d) tripping into the well bore;

(e) milling a window in the side of the well bore; and, (f) tripping out of the well bore.

15. The method of claim 14 wherein step (c) includes a plurality of water melon bits.

* * * * *